US012768606B2

(12) United States Patent
Ader

(10) Patent No.: US 12,768,606 B2
(45) Date of Patent: Oct. 20, 2026

(54) FIREARM PISTON AND FIRE CONTROL MECHANISM

(71) Applicant: Geoffrey Louis Ader, Acton, MT (US)

(72) Inventor: Geoffrey Louis Ader, Acton, MT (US)

( * ) Notice: Subject to any disclaimer, the term of this patent is extended or adjusted under 35 U.S.C. 154(b) by 0 days.

(21) Appl. No.: 19/193,897

(22) Filed: Apr. 29, 2025

(65) Prior Publication Data

US 2025/0334360 A1 Oct. 30, 2025

Related U.S. Application Data

(60) Provisional application No. 63/640,391, filed on Apr. 30, 2024.

(51) Int. Cl.
*F41A 3/26* (2006.01)
*F41A 3/90* (2006.01)

(52) U.S. Cl.
CPC . *F41A 3/26* (2013.01); *F41A 3/90* (2013.01)

(58) Field of Classification Search
CPC ..... F41A 3/26; F41A 3/90
See application file for complete search history.

(56) References Cited

U.S. PATENT DOCUMENTS 4,461,203 A * 7/1984 Jawdat ..... F41A 3/46 89/181
4,580,484 A * 4/1986 Moore ..... F41A 5/18 89/187.02
4,615,132 A * 10/1986 Smith ..... F41A 15/14 42/75.01
5,078,043 A * 1/1992 Stephens ..... F41A 21/30 89/14.4
5,129,172 A * 7/1992 Brennan ..... F41A 3/68 D22/104
6,393,751 B1 * 5/2002 Liebenberg ..... F41A 3/64 42/75.01
6,789,342 B2 * 9/2004 Wonisch ..... F41G 1/26 42/75.02
7,287,456 B2 * 10/2007 Spielberger ..... F41A 9/55 89/196

(Continued)

FOREIGN PATENT DOCUMENTS

DE 3432537 A1 3/1986

OTHER PUBLICATIONS

Https://www.forgottenweapons.com/garand-primer-activated-1924-trials-rifle/.

(Continued)

*Primary Examiner* — Michelle Clement
(74) *Attorney, Agent, or Firm* — NIXON & VANDERHYE

(57) ABSTRACT

A firearm comprising of a chassis, a barrel, a slide, and a reciprocating block connected to the chassis. The reciprocating block is operable to reciprocate with respect to the barrel between a chamber open position in which a face portion of the block is spaced apart from the breech end of the barrel and a chamber closed position in which the face portion of the block is proximate the breech end of the barre. A locking element selectively engages the slide and the block and operable to prevent rearward movement of the block when the slide is in the battery position, and to enable rearward movement of the block when the slide has moved rearward with respect to the block by a limited distance to an intermediate position forward of the recoil position.

16 Claims, 52 Drawing Sheets

(56) References Cited

U.S. PATENT DOCUMENTS

| | | | | |
|---|---|---|---|---|
| 7,299,581 | B2 * | 11/2007 | LaFleur | F41A 17/32 42/70.02 |
| 7,377,066 | B2 * | 5/2008 | Moore | F41A 3/54 42/25 |
| 7,398,614 | B2 * | 7/2008 | Rozhkov | F41A 3/56 42/2 |
| 7,726,230 | B1 * | 6/2010 | Erdem | F41A 3/64 89/184 |
| 8,453,555 | B1 * | 6/2013 | Karfiol | F41A 5/04 89/163 |
| 8,555,537 | B2 * | 10/2013 | Pflaumer | F41A 3/34 42/14 |
| 8,695,262 | B2 * | 4/2014 | O'Clair | F41A 3/12 42/71.02 |
| 8,935,871 | B2 * | 1/2015 | Bardy | F41A 19/14 42/70.08 |
| 9,546,831 | B2 * | 1/2017 | Bandini | F41A 3/78 |
| 10,018,433 | B2 * | 7/2018 | Tuason | F41A 3/46 |
| 10,203,172 | B2 * | 2/2019 | Dechant | F41A 5/06 |
| RE47,335 | E * | 4/2019 | Wolf | F41G 1/00 |
| 10,415,905 | B2 * | 9/2019 | Bubits | F41A 3/14 |
| 11,067,348 | B1 * | 7/2021 | Ribic | F41G 1/30 |
| 11,821,703 | B2 * | 11/2023 | Santa | F41A 3/12 |
| 12,410,977 | B2 * | 9/2025 | Okenka | F41A 3/86 |
| 2004/0144245 | A1 * | 7/2004 | Wonisch | F41G 1/26 89/196 |
| 2011/0017057 | A1 * | 1/2011 | Loganchuk | F41A 19/32 42/16 |
| 2012/0291324 | A1 * | 11/2012 | Bandini | F41F 1/08 42/6 |
| 2017/0184365 | A1 * | 6/2017 | Zajk | F41C 3/00 |
| 2022/0299280 | A1 | 9/2022 | Sunseri | |
| 2025/0102249 | A1 * | 3/2025 | Ribic | F41G 1/30 |
| 2025/0334360 | A1 * | 10/2025 | Ader | F41A 3/26 |
| 2025/0341372 | A1 * | 11/2025 | Hubbell | F41A 3/72 |

OTHER PUBLICATIONS

McCollum, Ian. "Garand Primer-Activated 1924 Trials Rifle." Forgotten Weapons, Aug. 13, 2018, www.forgottenweapons.com/garand-primer-activated-1924-trials-rifle/ , pp. 1-2. (Previously Submitted Without Date).

McCollum, Ian. "Garand Primer-Activated 1924 Trials Rifle." YouTube, uploaded by Forgotten Weapons, Aug. 13, 2018, www.youtube.com/watch?v=WejY6KEotoU , (Transcript Provided, pp. 1-30). (Previously Cited, But Not Submitted and Without Date).

International Search Report and Written Opinion of the International Searching Authority, issued in International Application No. PCT/US2025/027109 dated Apr. 9, 2026.

* cited by examiner

FIREARM PISTON AND FIRE CONTROL MECHANISM

CROSS-REFERENCE TO RELATED APPLICATIONS

This application claims priority to U.S. Provisional Patent Application No. 63/640,391 filed on Apr. 30, 2024 entitled "FIREARM PISTON AND FIRE CONTROL MECHANISM," hereby incorporated by reference in its entirety for all that is taught and disclosed therein.

FIELD OF THE TECHNOLOGY

The present disclosure relates to firearms, specifically mechanisms of actions.

BACKGROUND

Firearms such as handguns typically operate by using the force generated from activated propellant or gunpowder to exert a rearward force on the slide of the firearm to push the slide or bolt back far enough to allow a spent cartridge casing to be expelled. An alternative method was developed by John Garand for a primer actuated system that pushes the primer partially out of the cartridge case to push the rifle bolt rearward. Versions of the rifle utilized a downward-tilting locking lug at the rear of the bolt, similar to the design of the 1886 Mannlicher. The primer moving back pushed on a sleeve that disengaged the locking lug for the bolt. The advantage to this approach is that the sleeve is housed behind the breech face of the firearm so a firearm can have a locked breech system without anything attached to the barrel (gas port system, piston, etc). However, the approach had several disadvantages that made it non-conducive for use in pistols and left room for improvement for use in long guns. The original designs were optimized for rifles and relied on a locking lug that needed a strong and rigid surface to brace against. In a handgun, accommodating this would take up valuable space and would require structural reinforcement beyond what is typical in modern pistol frames and/or chassis, which are often made of polymer or aluminum. Additionally, the locking lug in Garand's design directed forces asymmetrically, introducing uneven stress on internal components and further complicating integration into compact and precision platforms.

Furthermore, the conventional approach to a pistol utilizes a tilting barrel design with a moveable barrel. This can result in decreased accuracy and challenges feeding ammunition from an alternating feed (also known as a "double feed") magazine. Using a primer actuated system with a barrel fixed to a chassis allows for increased accuracy and easier feeding from alternating feed magazines. Conventional fixed barrel systems in pistols also have disadvantages. Direct blowback does not lock the breech, necessitating a very strong recoil spring to absorb the energy of the slide for many popular pistol cartridges. It also results in large amounts of carbon buildup deposited behind the chamber. Gas retarded blowback uses the gases of the pistol to slow the rearward movement of the slide. Due to this design capturing hot gases to use as a buffer, gas retarded blowback systems get hot and uncomfortable to shoot after shooting a relatively low number of shots.

SUMMARY

Therefore, a need exists for a new and improved firearm that utilizes a primer actuated approach to the cycling of a firearm action.

To attain need and novelty for the solution, the embodiment of the present disclosure essentially a firearm comprising of a chassis; a barrel connected to the chassis and having a breech end defining a chamber; a slide operable to reciprocate with respect to the chassis between a forward battery position and a rearward recoil position; a reciprocating block connected to the chassis and operable to reciprocate with respect to the slide between a block rear position in which a first limit surface of the slide abuts the block, and a block forward position in which the block is spaced apart from the first limit surface of the slide; the reciprocating block operable to reciprocate with respect to the barrel between a chamber open position in which a face portion of the block is spaced apart from the breech end of the barrel and a chamber closed position in which the face portion of the block is proximate the breech end of the barrel; a locking element selectively engaging at least the slide and the block and operable to prevent rearward movement of the block when the slide is in the battery position, and to enable rearward movement of the block when the slide has moved rearward with respect to the block by a limited distance to an intermediate position forward of the recoil position.

There has thus been outlined, rather broadly, the more important features of the disclosure in order that the detailed description thereof that follows may be better understood and in order that the present contribution to the art may be better appreciated

BRIEF DESCRIPTION OF DRAWINGS

The subject matter regarded as the present embodiment is particularly pointed out and distinctly claimed in the concluding portion of the specification. The embodiment, however, both as to organization and method of operation, together with objects, features, and advantages thereof, may best be understood by reference to the following detailed description when read with the accompanying drawings in which:

DETAILED DESCRIPTION OF THE DISCLOSURE

Figure 1:
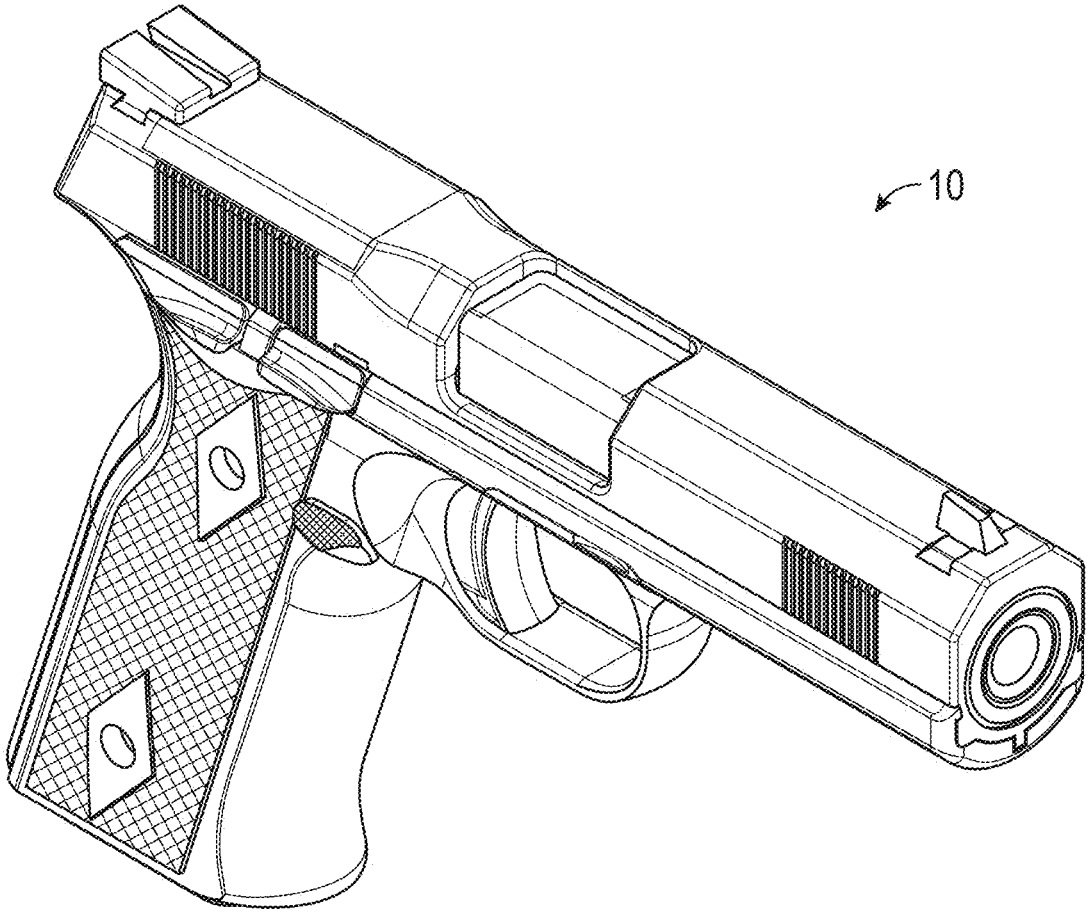
FIG. 1 shows an isometric view of the firearm.

In the following detailed description, numerous specific details are set forth in order to provide a thorough understanding of embodiments. However, it will be understood by those of ordinary skill in the art that the embodiments may be practiced without these specific details. In other instances, well-known methods, procedures, and components have not been described in detail so as not to obscure the embodiments and disclosures. Non-limiting and non-exhaustive embodiments will be described with reference to the following figures, wherein like reference numerals refer to like parts throughout the various figures unless otherwise specified.

An embodiment of the firearm of the present disclosure is shown and generally designated by reference numeral 10.

FIG. 1 shows an isometric view of the firearm 10 with all components assembled.

Figure 2:
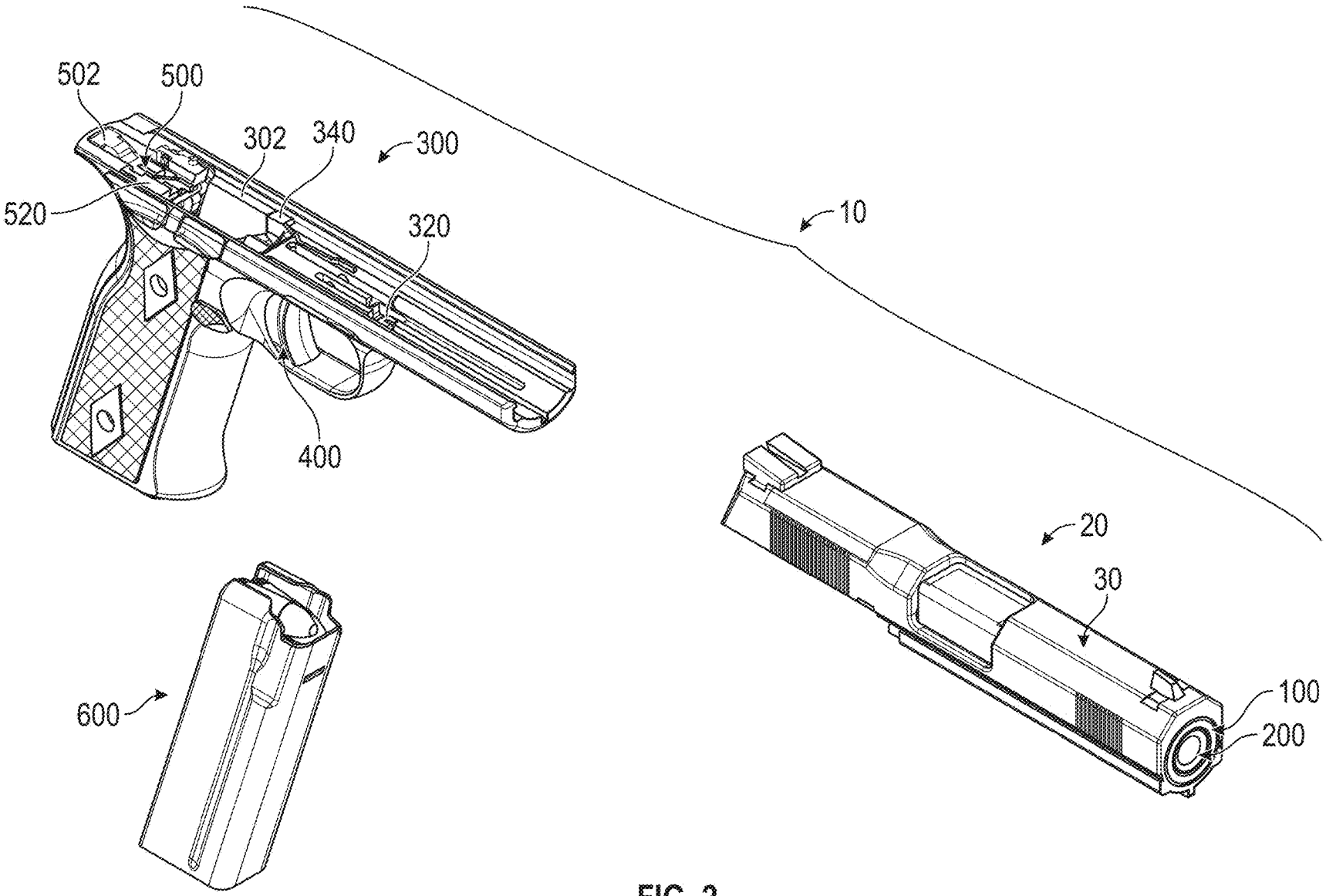
FIG. 2 shows an isometric view of the firearm with its slide assembly, chassis grip module assembly, and magazine assembly separated.

FIG. 2 shows a partially exploded view of the firearm 10 having a slide assembly 20 including reciprocating block 100 and a barrel 200, a chassis grip module assembly 300, and a magazine assembly 600. The slide assembly includes a slide 30, and a reciprocating block 100. The chassis grip module assembly includes a chassis 302 that houses a fire control unit assembly 400, hammer housing assembly 500, and backstrap assembly 580.

FIGS. 3 through 7 (excluding FIG. 4) show exploded and alternate views of the firearm 10 slide assembly 20, chassis assembly, also referred to as a grip module assembly 300, fire control unit assembly 400, hammer housing assembly 500, and magazine assembly 600. The parts identified and discussed therein are applicable to corresponding numberings and shapes in subsequent figures.

Figure 4A:
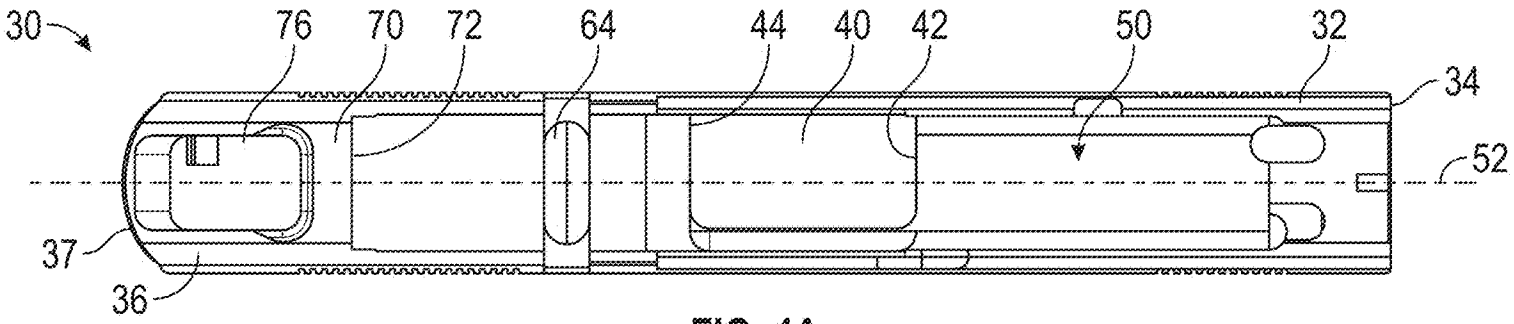
FIG. 4A shows an upward view of the slide.
Figure 4C:
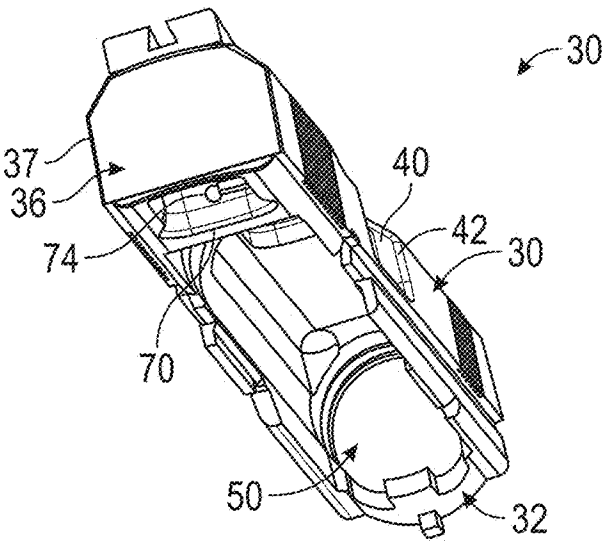
FIG. 4C shows a selectively angled rearward upward view of the slide.
Figure 4B:
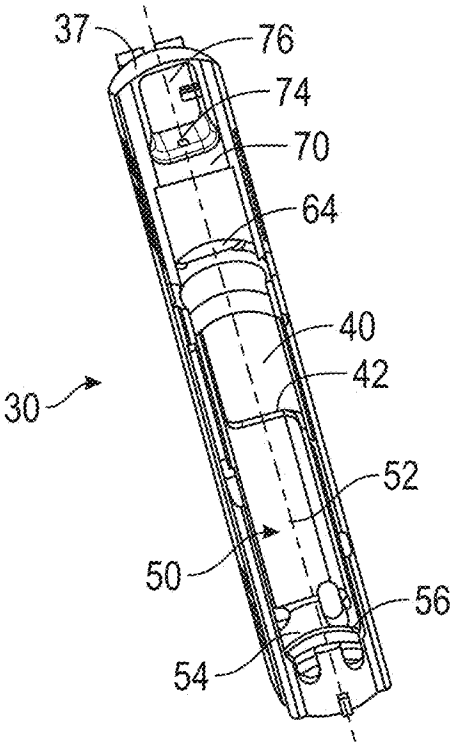
FIG. 4B shows a selectively angled upward view of the slide.

FIG. 4 shows there is a slide 30 having a first end 32 with a front face 34, and second end 36 having a rear surface 37 with an ejection port 40 between the ends. The ejection port has a forward end 42 closer to the first end and a rear end 44 closer to the second end. The slide defines a bore 50 along a bore axis 52 extending from the front face of the slide towards the second end of the slide, terminating at a dividing section 70 (see FIGS. 4A through 4C). The slide has an internal first diameter portion 54 and an internal second diameter portion 56, also referred to as the slide groove. The second diameter portion is shown here as a circumferential recessed area within the slide at the first end, having a greater diameter 57 than the first diameter portion defining the bore behind the slide groove. Aft of the first diameter portion is a recoil spring retainer cutout 60 (shown clearer in FIG. 4, FIG. 9A, and elsewhere). The second end has an internal cutout 64 behind the second end of the ejection port. A dividing section 70 has a first limit surface 72 and defines a rear bore 74 that extends towards a rear internal space 76 between the dividing section and rearmost end of the slide.

A reciprocating block 100 fits within the slide 30. The block has a first end 102, also referred to as a locking element holder portion and an opposing second end 110, referred to as a face portion, and defines a bore 120 that is in line with bore axis 52. The first end defines at least one receptacle 104, shown here as a through hole. The second end 110 of the reciprocating block has a breech face 112 oriented towards the first end. The reciprocating block further defines an open intermediate portion 130 between the first end and breech face such that lateral bars connect and distinguish the first end and second end. The second end further defines an internal firing pin channel 132, a top channel 134, and cross top channel 136. The firing pin channel extends from the breech face along the entire length of the second end. The top channel extends partially along a partial length of the second end, is closed at its end towards the breech face and open at the channel's opposing end. The cross top channel perpendicularly intersects the top channel and spans a partial transverse length across the width of the face portion. A piston retainer 140 defines a hole 142 and is biased away from the reciprocating block by at least one spring 146 over a corresponding guide 144 contained within the cross top channel. A firing pin 152 is slip fit within a piston 150 which is slip fit within part of the firing pin channel and both pass through the piston retainer hole. The firing pin has a forward tip end 154 and an opposing rearward hammer end 156. The firing pin, piston, and firing pin channel are in line with bore axis 52.

The reciprocating block fits inside the slide 30 and is able to move forward and backward within the slide. A locking element 106 goes between the slide 20 and barrel 200 by being within a receptacle 104 of the locking element holder portion such that a portion of the locking element can protrude partially into the second diameter portion 56 of the slide or partially into a second diameter portion 214 of the barrel, also referred to as a front barrel groove. This allows the reciprocating block to be selectively engaged with the slide. In the present embodiment the locking element is a ball bearing, three shown, that selectably engage a recessed ring 56 at the forward end 32 of the slide and are restrained by the receptacle, shown as a radially oriented through-holes, defined by the locking element holder portion. Other embodiments could include, but are not limited to, the locking element holder portion being a recessed ring running circumferentially around the locking element holder portion and the slide utilizing a plurality of recessed areas as opposed to a single circumferential groove.

The barrel 200 has a first end 202, also known as the muzzle end, a second end 204 also referred to as the breech end, and defines a bore 206 that is along the same axis 52 as the slide bore 50. The barrel has a cylindrical exterior surface 210 with a first diameter portion 212 and a second diameter portion circumferential groove 214 towards the muzzle end, also referred to as a front barrel groove. The breech end has a third diameter portion 220, also referred to as a rear barrel groove, and defines a chamber 222. The second and third diameter portions are circumferential grooves that have a diameter less than that of the first diameter portion but do not necessarily share a same lesser diameter. The barrel fits within the reciprocating block 100 with the breech end towards the breech face 112 of the reciprocating block and the muzzle end towards the first end 102 of the reciprocating block.

The slide assembly 20 further has a barrel housing 80 that interfaces with a barrel housing cover 82. The barrel housing has a forward end oriented with the muzzle end of the barrel 200 and defines a bore 84 that contains a recoil spring 90 having a diameter greater than the barrel 200 retained by a recoil spring retainer 170, which defines a hole 172 with a diameter lesser than the recoil spring but larger than the barrel through which the barrel passes. The recoil spring retainer has an upper end 173 and opposing lower end 174 having an endmost tab 176. The forward upper protrusion 86*a* and lower protrusion 86*b* at the forward end of the barrel housing contact the upper end 173 and lower end 174. At the opposing end is a horseshoe 94, which slip-fits into a cutout 64 in the slide and has inward facing tabs, 96*a* and 96*b* at the open end that reciprocate within cutouts 114*a* and 114*b* in the block respectively. A barrel key 160 is installed into the bottom of the barrel housing and engages the rear barrel groove 220 to secure the barrel in place. An extractor 180 is also within the assembly.

The barrel fits within the reciprocating block 100, as described above, which fits inside the slide 30 and is able to move forward and backward within the slide. A locking element 106 is between the slide 20 and barrel 200 by protruding partially from a receptacle 104 of the locking element holder portion such that a portion of the locking element may protrude into the second diameter portion 56 of the slide while being restrained from traveling radially inward by the cylindrical exterior surface 210 of the barrel and, in another condition, another portion of the locking element may partially protrude into the second diameter portion 214 of the barrel while being restrained from traveling radially outward by the first diameter 54 of the slide 30. This allows the reciprocating block to be selectively engaged with the slide. In the present embodiment the locking element is a ball bearing, three shown, that selectably engage a recessed ring 56 at the forward end 32 of the slide and are restrained by the receptacle, shown as a radially oriented through-holes, defined by the locking element holder portion.

The grip module assembly 300 includes a chassis 302 having forward end 304, rearward end 306, grip 310 with internal magazine well 312, and trigger guard 314. In other embodiments a frame may be used instead of a chassis. Within the grip module assembly are a fire control unit assembly 400, hammer housing assembly 500, and backstrap assembly 580. The magazine assembly 600 is inserted into the magazine well.

Figure 5:
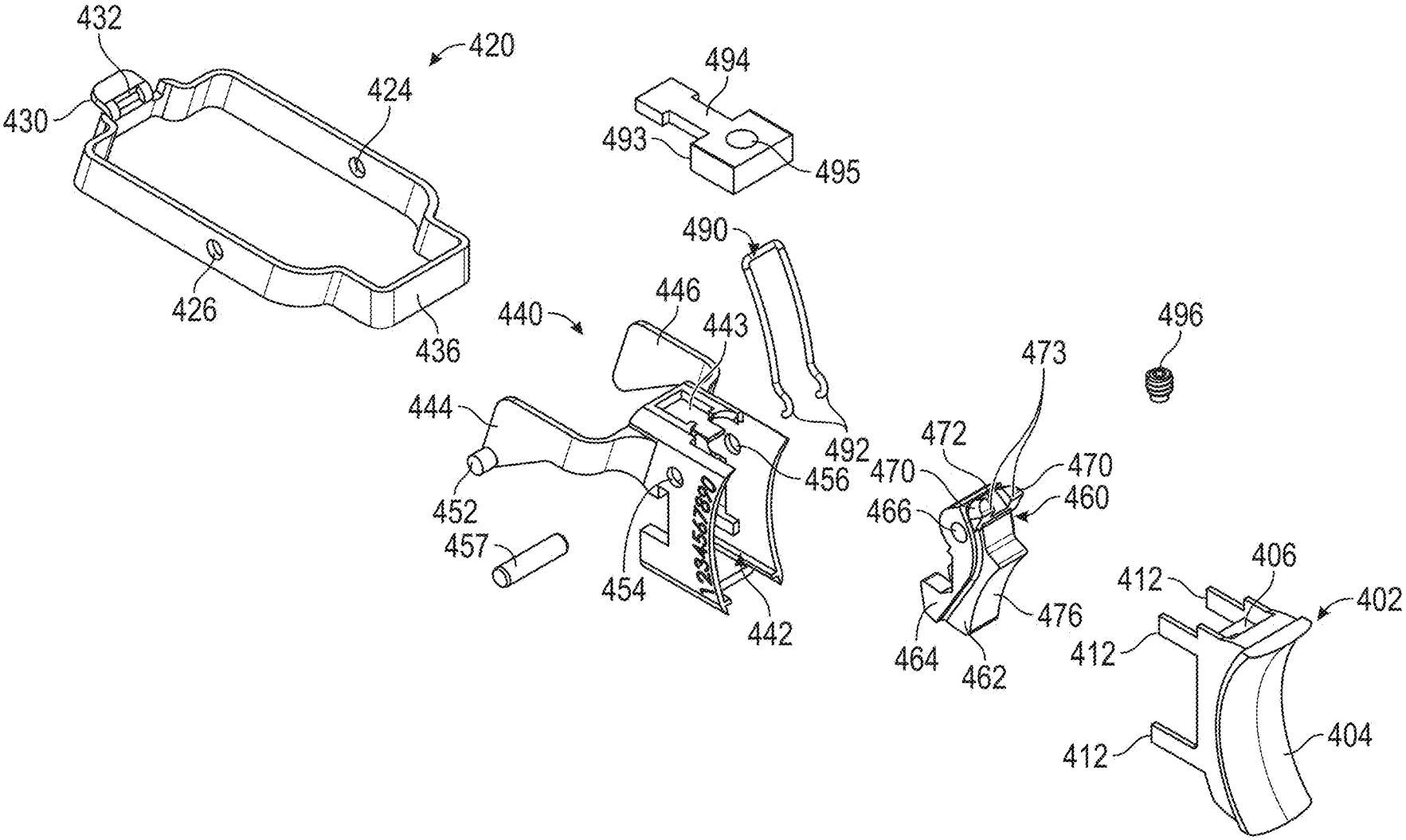
FIG. 5 shows an isometric exploded view of the fire control unit assembly.
Figure 7:
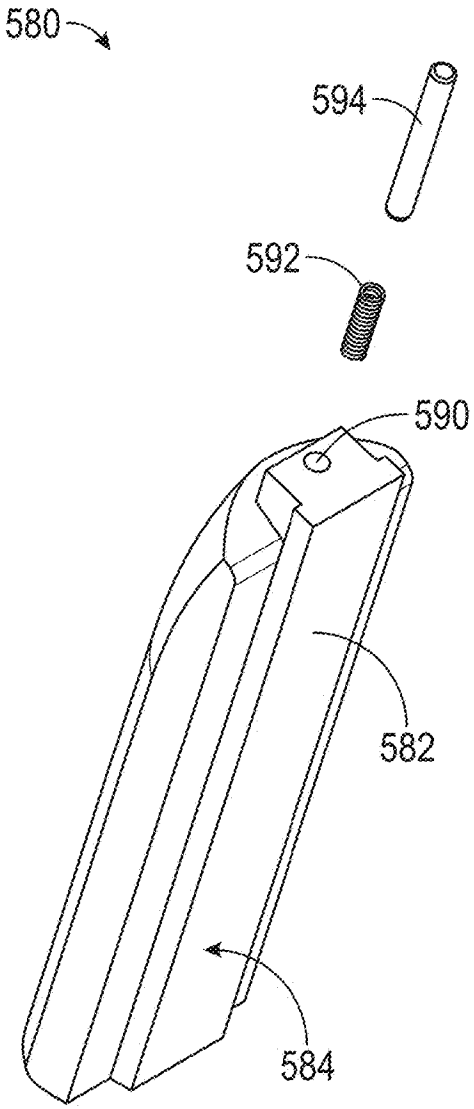
FIG. 7 shows an isometric exploded view of the backstrap assembly.

As depicted more clearly in FIG. 5, the fire control unit assembly 400 resides within the chassis 302 and trigger guard 330. A trigger shoe 402 having a front face 404, a rearward upper receptacle 406 decided to receive trigger actuator 494, a rearward lower portion 410 (not visible in FIGS. 2 through 7 but shown in FIGS. 9G and 9H), and rearward lateral bracket 412. In other embodiments such as that shown in FIGS. 9-18, the trigger actuator 494 is eliminated and instead the trigger shoe 402 itself has a rearward surface 493 that acts on the radii on the secondary sear 473. A primary sear 420 is at the opposite end of the assembly. The primary sear has an elongated body 422 defining two lateral holes 424 and 426 registered with one another, a rearward tab 430 with engagement surface 432, and a forward nose 436. A fire control housing 440 is between the primary sear and trigger shoe. The housing has a forward cavity 442 and two rearward wings 444 and 446 that are externally lateral to the primary sear forward nose. The tabs each further have a lateral protruding boss 450 and 452 projecting in opposite directions from one another. The cavity defines two lateral holes 454 and 456 that are registered with one another through which a control housing pin 457 passes. A secondary sear 460 that has a front portion 462 and rear portion 464 that defines a transverse pivot hole 466 therebetween. The front side has an upper engagement facility 470 and a lower engagement portion 476. The upper engagement facility has a cutout 472 and groove 474. The rear side (shown in other figures) has a sear ledge 480 above a reset ramp 482 with a sear face 484 between the two. The bottom of the secondary sear defines a lower cutout 486.

The secondary sear 460 is placed within the trigger shoe 402 such that the front face 404 and front portion 462 are oriented in the same direction, the lower engagement facility 476 may be limited in travel by the rearward lower portion 410 of the trigger shoe, which is laterally restrained by the brackets 412. The shoe and secondary sear are placed within the fire control housing 440 forward facing cavity 442. The primary sear 420 is inserted into the opposite side of the housing with the forward nose 436 going under the wings 444 and 446 to engage the secondary sear. The forward-facing nose abuts the rearward facing sear face 484 of the secondary sear so that it is below the sear ledge 480 and above the reset ramp 482 until the trigger is pulled, at which point the sear ledge is pulled away from interfering with the upper face of the nose, and the upper face of the nose is able to rise past the sear ledge. A trigger spring 490 rests in the groove 474 of the upper engagement facility such that two hooked legs 492 flank the lower engagement facility 476 of the secondary sear and bias the rearward lower portion 410 of the trigger shoe away from the secondary sear. This is clearly shown in FIGS. 9G and 9H. Shown in FIG. 5, a trigger actuator 494 defines a hole 495 into which a trigger screw 496 goes through and into the trigger shoe to mate the two parts to move as one. Surface 493 of the trigger actuator 494 (or surface 493 of the trigger shoe 402 when discussing embodiments such as those shown in FIGS. 9-18 where the roles of the trigger/trigger shoe assembly is accomplished by just a trigger shoe) contacts radii 473 of the secondary sear to register the movement of the trigger with the rotation of the secondary sear. The trigger goes into a fitted portion 443 at the top end of the housing and moves forward and backward with the rotation of the secondary sear.

Figure 3:
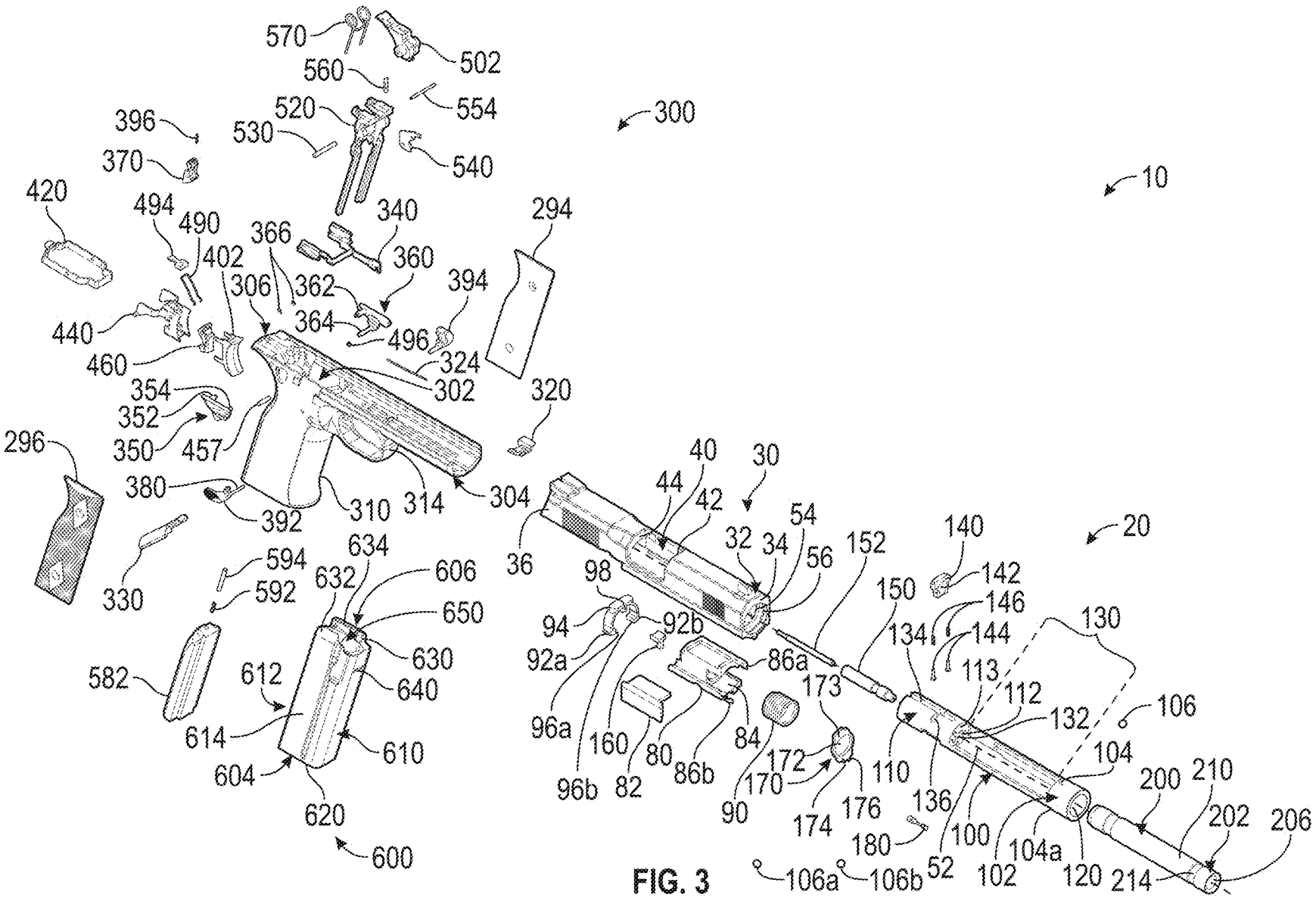
FIG. 3 shows an exploded view of the firearm assembly components.
Figure 6:
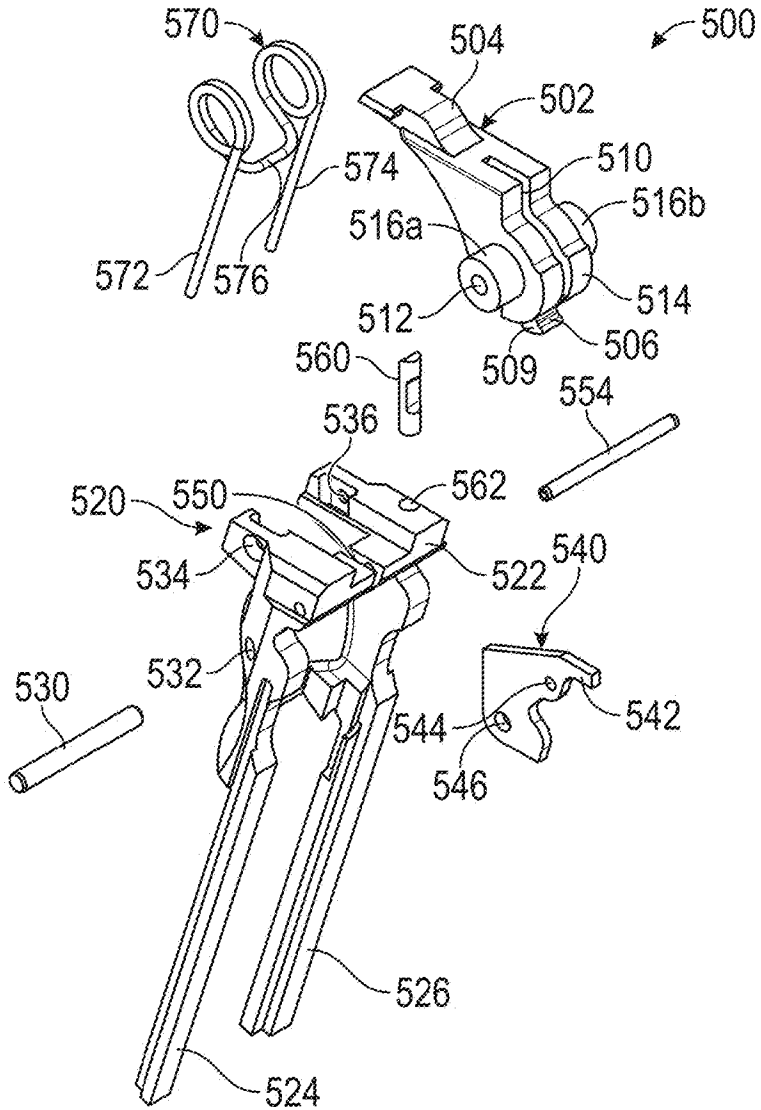
FIG. 6 shows an isometric exploded view of the hammer housing assembly.
Figure 9A:
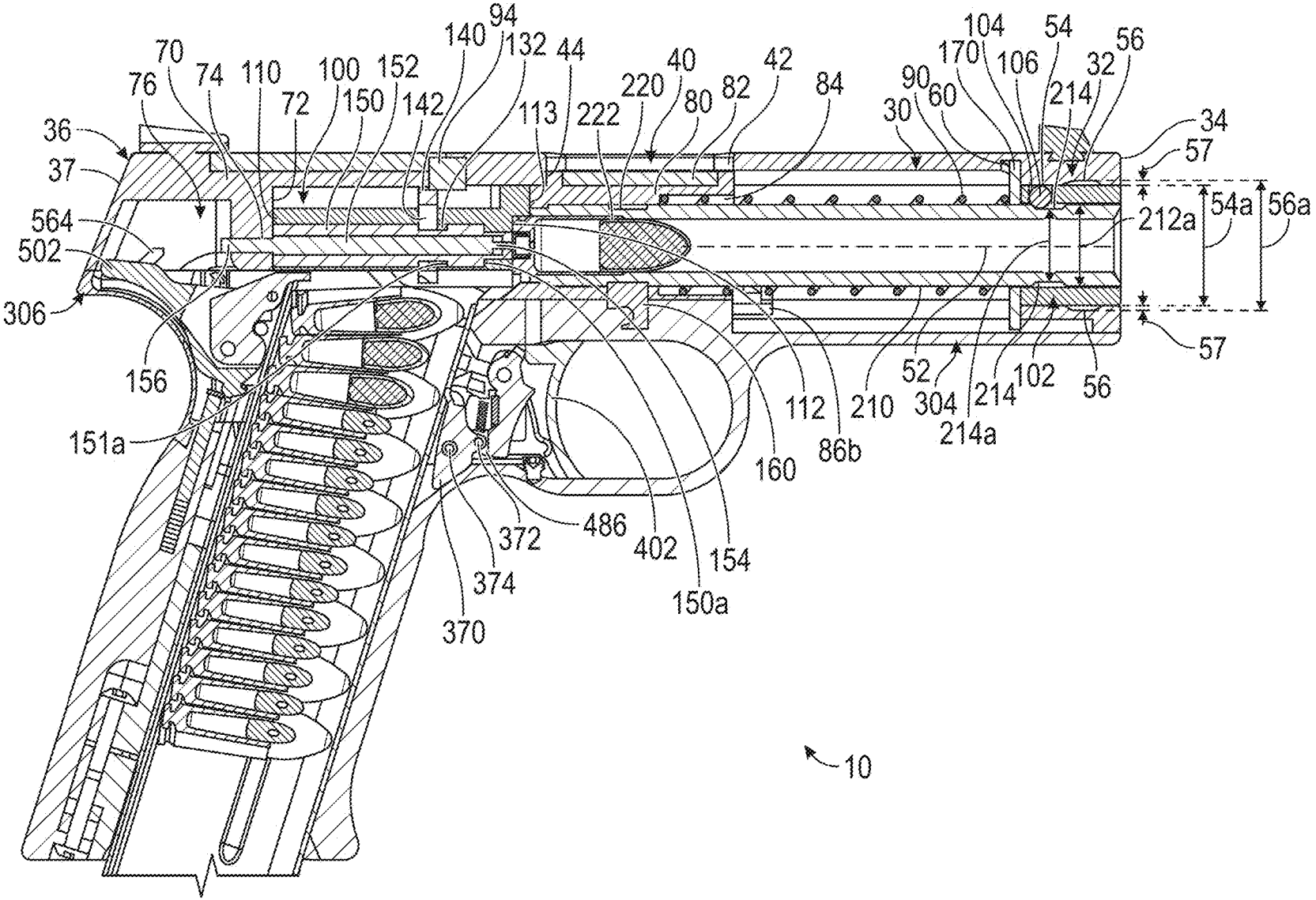
FIG. 9A is a right-side section view of the firearm in a ready to fire condition.
Figure 9B:
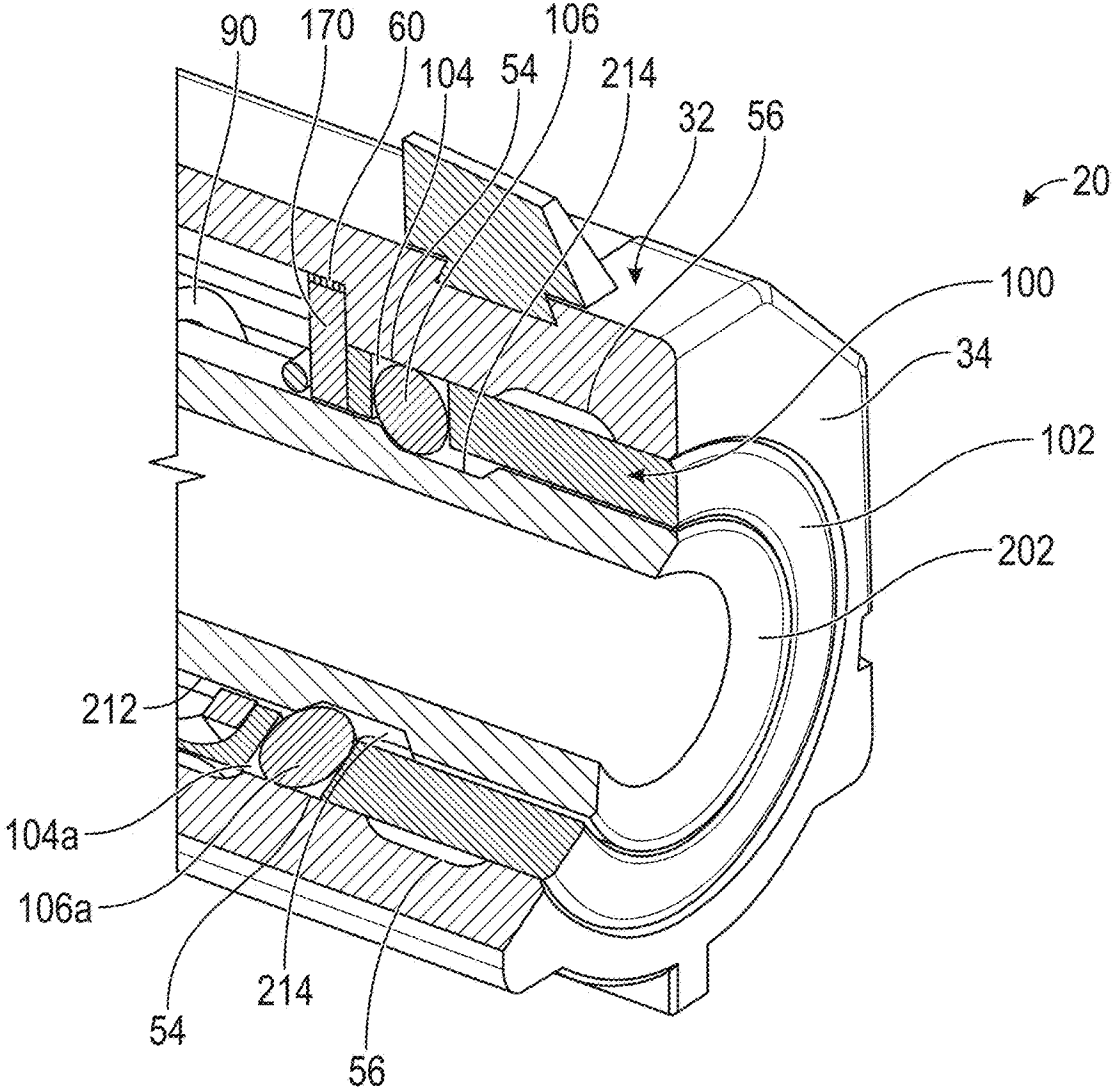
FIG. 9B is a selectively angled two-thirds section view of the forward end of the slide assembly.
Figure 9C:
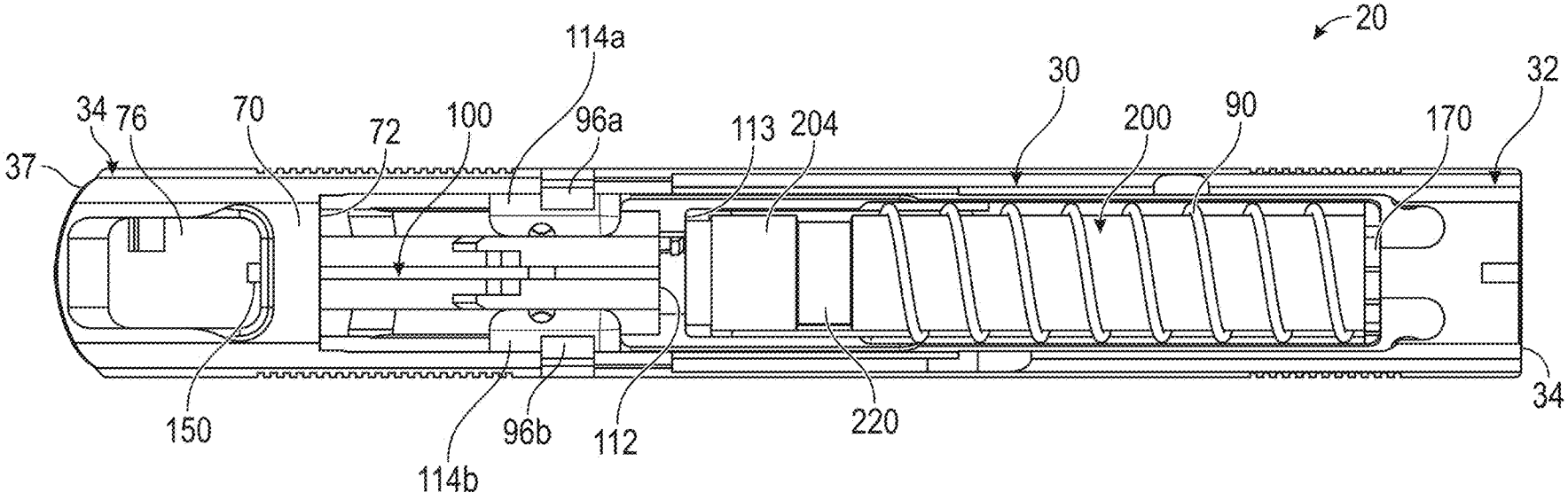
FIG. 9C is an upward view of the slide assembly in FIG. 9A with barrel housing and barrel key removed.
Figure 9D:
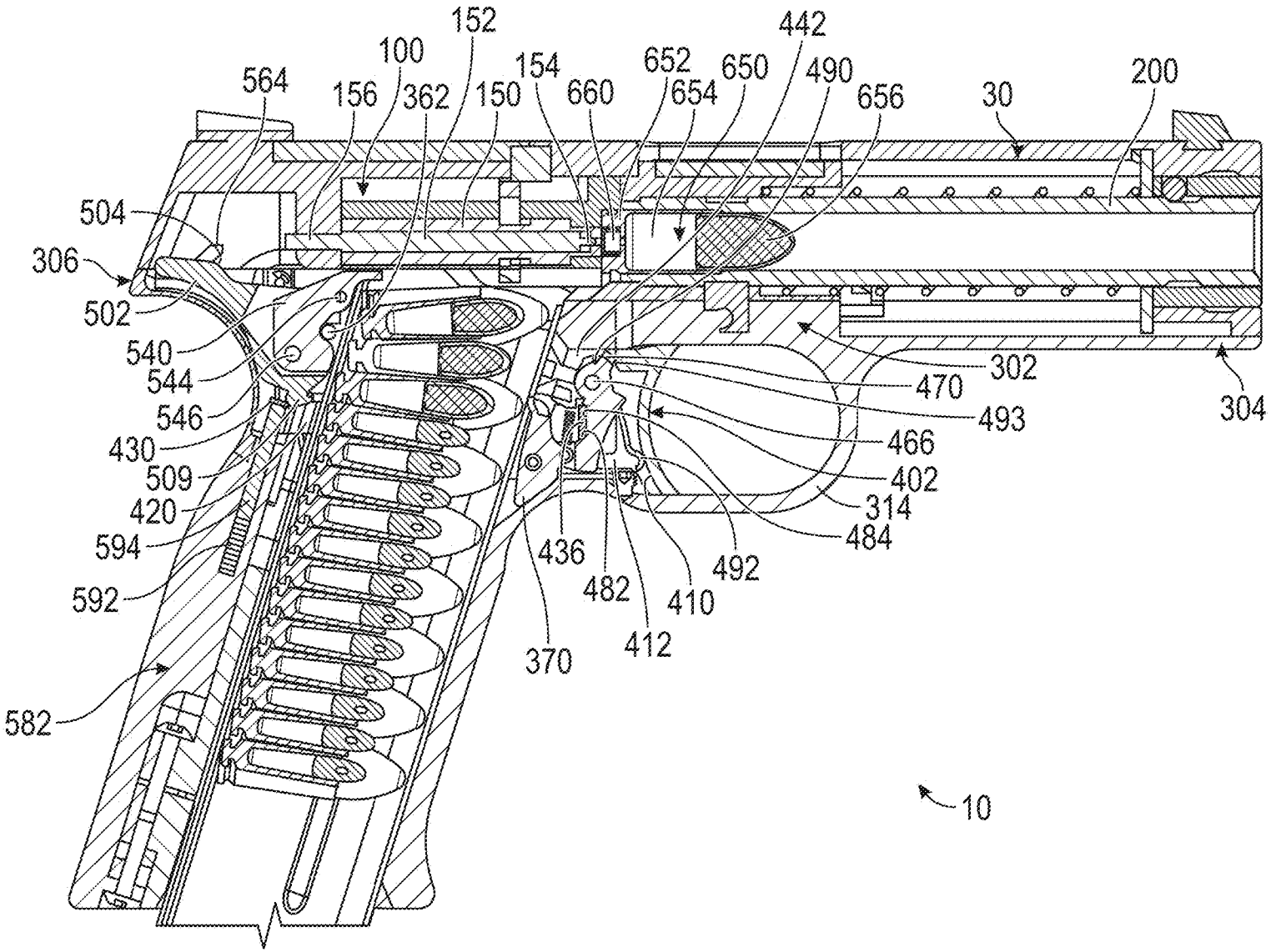
FIG. 9D is a side section view of the firearm in a ready to fire condition.
Figure 9G:
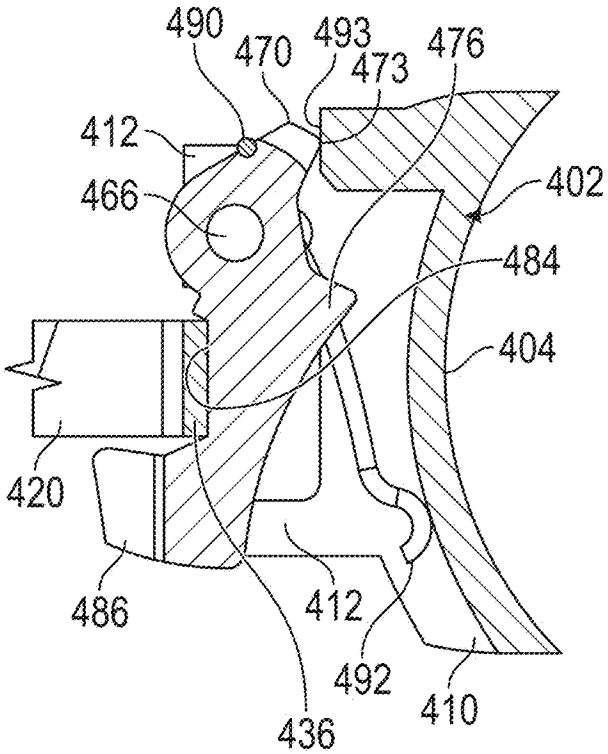
FIG. 9G is a partial side section view of some of the components of the fire control housing assembly as they are in FIG. 9D.
Figure 9F:
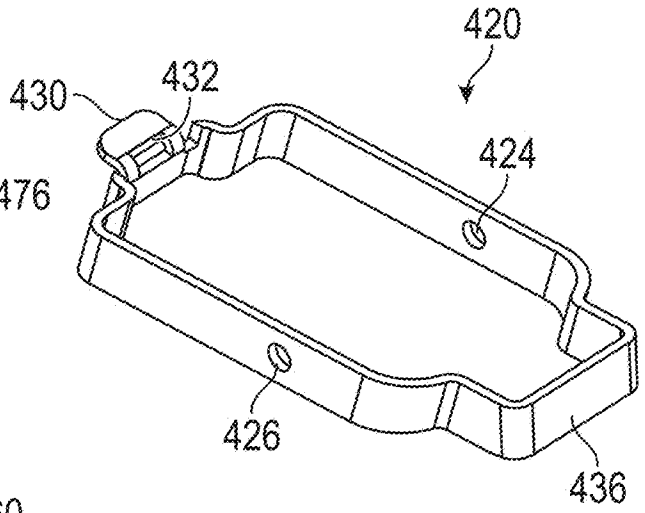
FIG. 9F is a selectively angled view of the primary sear.
Figure 9E:
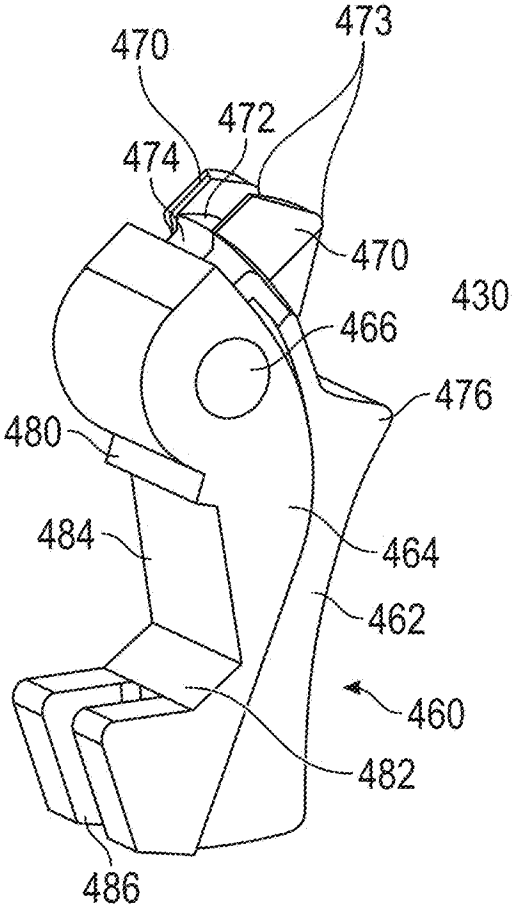
FIG. 9E is a selectively angled view of the secondary sear.
Figure 9H:
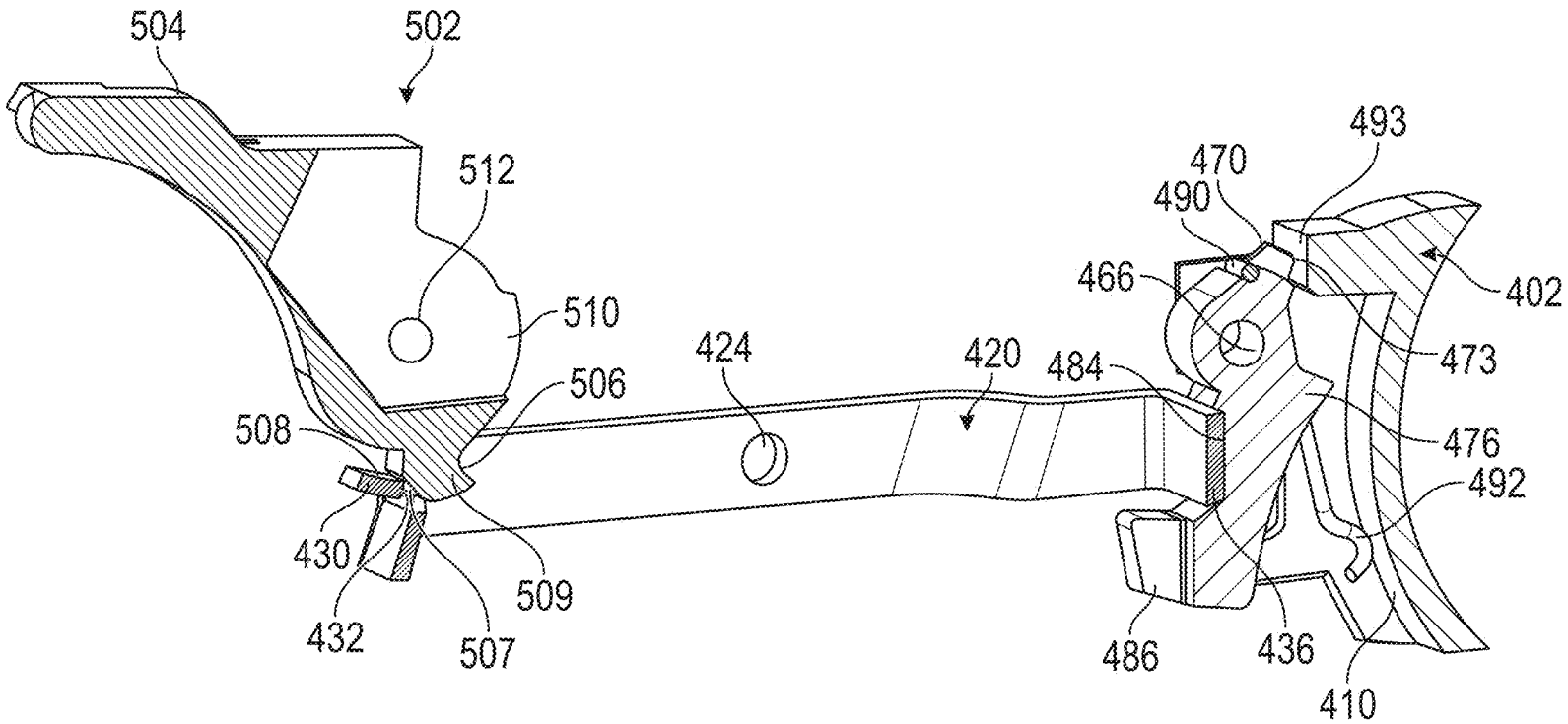
FIG. 9H is a partial selectively angled side section view of selected components of the fire control housing assembly in FIG. 9D.
Figure 9I:
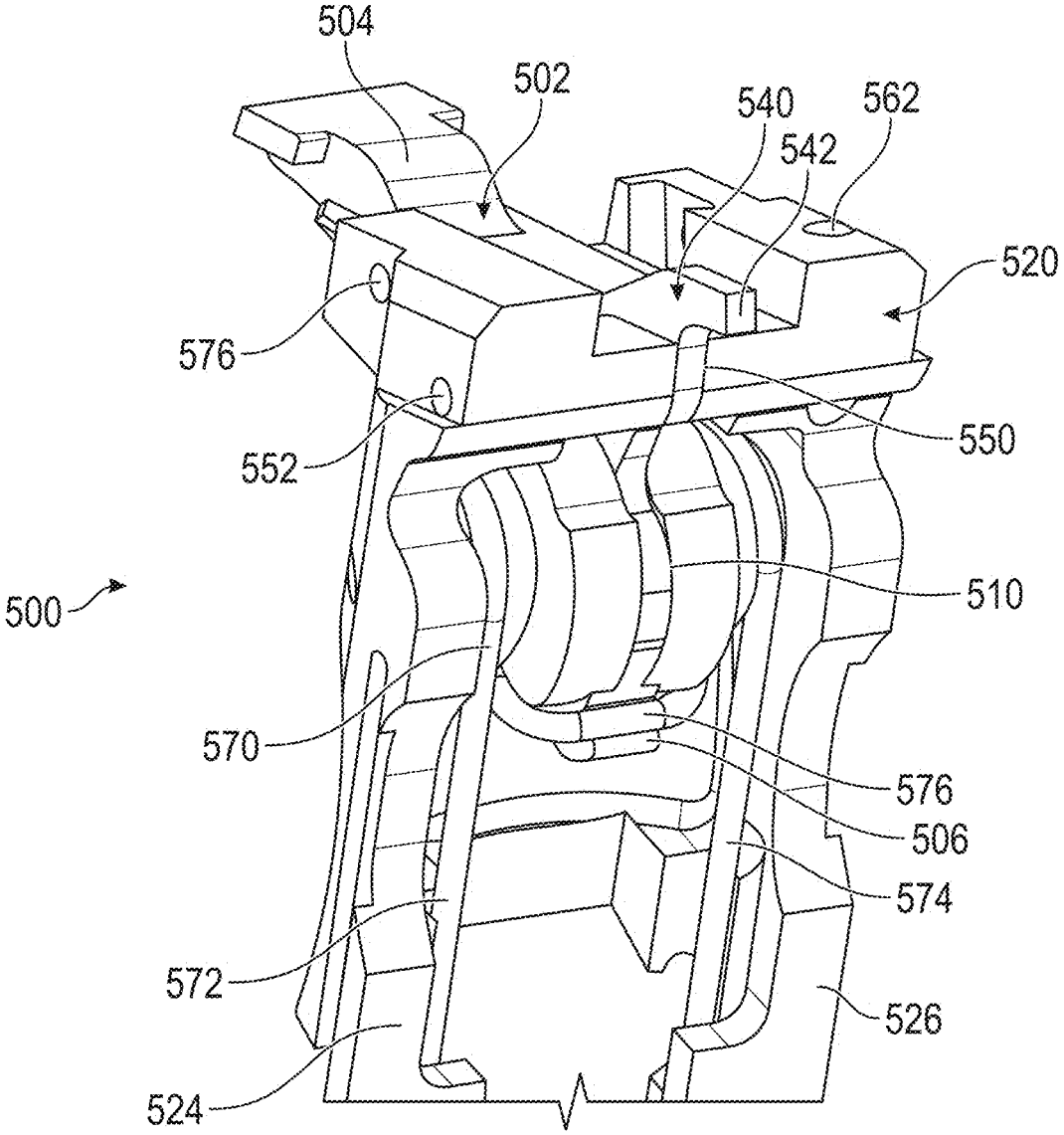
FIG. 9I is a selectively angled front view of some of the components of the hammer housing assembly as they are in FIG. 9D.

FIG. 3 further shows the hammer housing assembly 500, shown in greater detail in FIG. 6 and FIG. 9I, which has a hammer 502, hammer housing 520, hammer pin 530, hammer spring 570, ejector 540, ejector retainer 554, and safety actuator pin 560. The hammer has a strike face 504 at its rear end and a hammer tooth 509 below a rounded forward end 514 and consisting of a spring notch 506, a ramp 507, and bent 508, also referred to as a hammer sear notch (see FIG. 9H). The hammer 502 also defines a vertical channel 510 along its medial plane. Between the strike face and rounded forward end there is a right boss 516*a* and left boss 516*b* that define a transverse pivot hole 512 that crosses the medial channel.

The housing 520 has a body section 522 from which a right leg 524 and left leg 526 protrude predominantly downward. The middle of the body has a division 550 separating the body into a right and left half. The body section defines a predominantly downward thru-hole 562 located on the left half above the second leg, into which the actuator pin goes. The actuator pin rests on boss 364 of the left safety selector and is retained via a relieved section of the actuator pin accepting the ejector retaining pin 554. The housing body further defines a forward transverse bore 552, through which the ejector retainer is inserted, a hammer pin bore 532 behind the legs through which the hammer pin is inserted, and two registered transverse holes 534 and 536 through which the right and left safety selectors are inserted respectively.

The ejector 540 defines a first hole 544 and second hole 546 and has a protruding nose 542 above and in front of both holes. The hammer spring 570 is a torsion spring having a right leg 572 and a left leg 574 with a middle section 576 therebetween.

The hammer 502 is set partially within the housing 520 between the right housing leg 524 and left housing leg 526 such that the pivot hole 512 and housing's hammer pin hole 532 are registered. The ejector goes into division 550 between the left and right half of the housing and in the hammer medial channel 510 such that the first ejector hole 544 registers with the ejector retainer bore 552 of the housing and the second ejector hole 546 registers with the hammer pivot hole 512 and housing hammer pin hole 532. The hammer and ejector are secured by the hammer pin 530 going through the hammer pin bore 532, hammer pivot bore 512, medial channel 510, and second ejector hole 546. The hammer spring 570 goes around the hammer such that the right leg 572 goes around the right boss 516*a* of the hammer and down the right leg 524 of the housing, the left leg of the spring 574 goes around the left boss 516*b* of the hammer and down the left leg 526 of the housing, and the middle section 576 is held in place by the spring notch 506 of the hammer tooth 509 of the hammer 502. The legs of the spring press against the legs of the housing. As the hammer face 504 is rotated backward, the hammer notch rotates forward, causing the spring to bias the hammer to rotate forward.

FIG. 3 shows a backstrap assembly 580 and its components, which include a backstrap 582 that has a bottom end 584 and a top end 586, which defines a blind hole 590 in which a sear spring 592 biases a sear plunger 594 away from the bottom end. In other embodiments, one leg of a torsion spring used for the magazine release may be used to bias the sear instead of the separate spring and plunger. The backstrap assembly components are shown in greater detail as an isolated exploded view in FIG. 7.

FIG. 3 shows that the grip module assembly 300 further includes a locking spring slider 320 with an accompanying slider spring 324, takedown lever 330, slide stop 340, left safety selector 360, a right safety selector 350, two safety selector retainers 366, a magazine catch 370, right magazine release actuator 392 and left magazine release actuator 394, magazine release spring 396, a left grip panel 294 and a right grip panel 296.

FIG. 3 shows the magazine assembly 600, which is a double feed magazine that includes a magazine body 602 defining a butt end 604 and feed end 606, a forward facing bullet end 610 and an opposing casing end 612, a right side 614 and an opposing left side 616 (not visible here). The bottom end restrains a floor plate 620 (not visible here) that supports a magazine spring 622 (not visible here) that biases a follower 624 (not visible here) to advance ammunition 650 upward, The feed end defines an opening 630 flanked by a first feed lip 632 and a second feed lip 734 that allow double feed of ammunition as opposed to a single feed approach. The feed end also defines a magazine catch hole 640 on the forward end of the magazine body.

The addition of a secondary sear 460 acts as a counterbalancing object for trigger drop safety. Using a mass, in this case the secondary sear, to counteract trigger inertia provides for a safer trigger. The concept is applicable to both linear and pivoting triggers. The counterbalancing object, secondary sear, does not need to be directly connected to the trigger, but can instead be a tangent contact, pinned, or separate. Dropping the firearm rear end of the chassis 306 first can cause normal trigger movement but the movement is cancelled out by the counterbalancing movement of the secondary sear.

In other embodiments the secondary sear may not be a distinct component, but instead machined directly into another part of a trigger housing assembly. For example, the primary sear may reset by direct engagement with a ramped surface or via a spring-loaded interaction. In an alternative embodiment, the primary sear pivot point can be positioned variably rather than being fixed near its center as shown by the pivot holes 424 and 426, and can rotate in different directions. The reset ramp 482 positioning may be modified to achieve a reset function in inverted or alternative layouts. The interaction between the primary sear and secondary sear can be modified in alternative embodiments for different levels of engagement force and reset behavior.

Figure 8B:
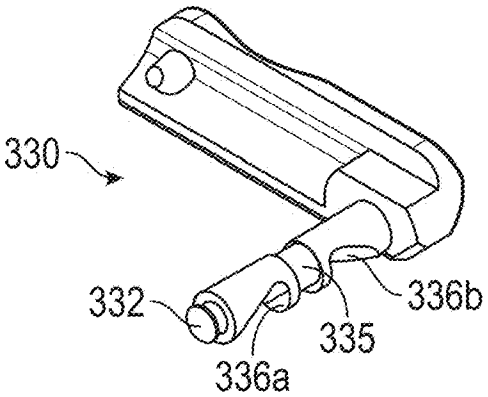
FIG. 8B shows a selectively angled view of the takedown lever.
Figure 8D:
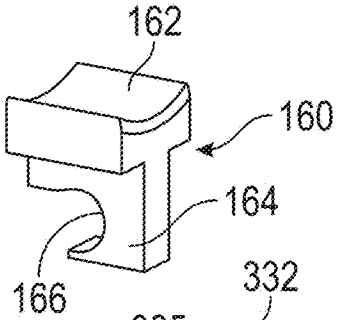
FIG. 8D shows selectively angled views of the barrel key and takedown lever.
Figure 8D:
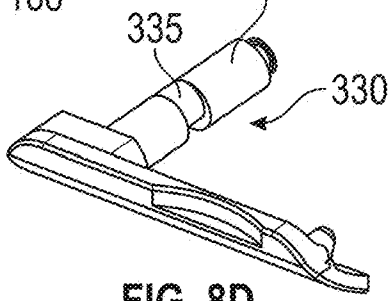
Figure 8A:
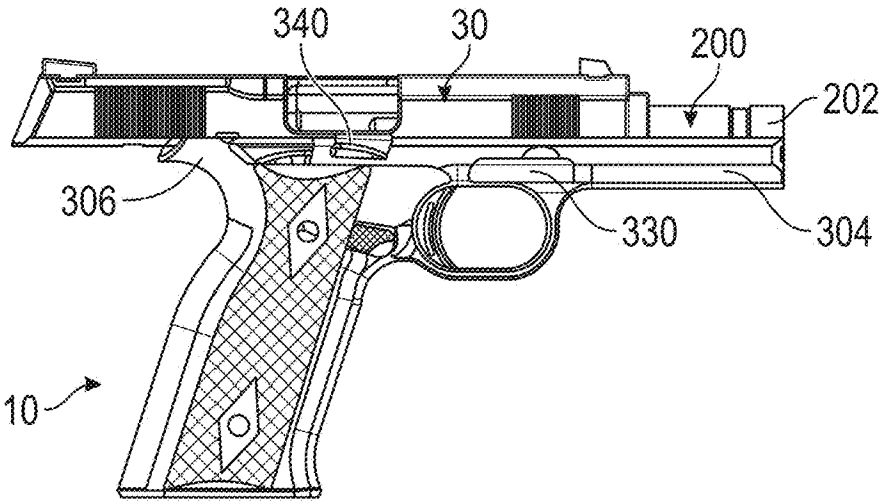
FIG. 8A shows a right-side view of the firearm with the slide assembly all the way to the rear and slide catch actuated.
Figure 8C:
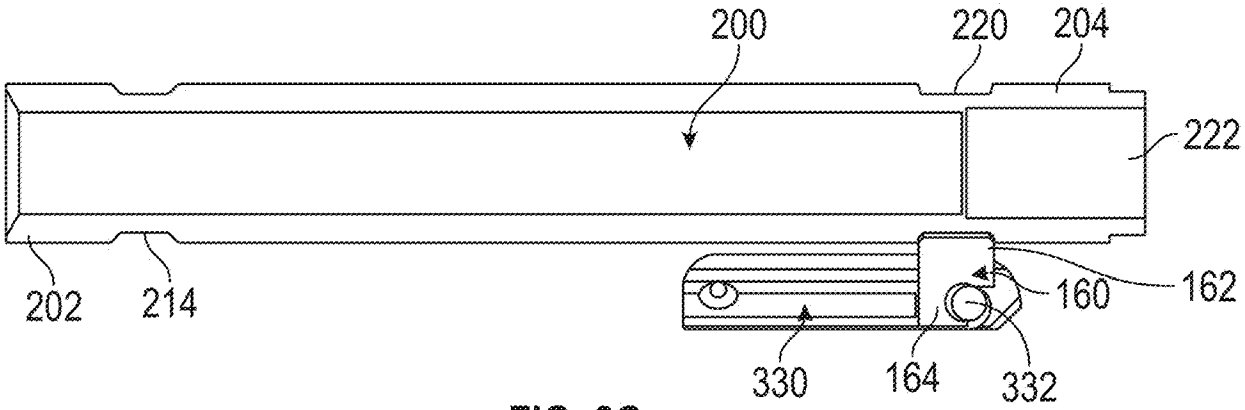
FIG. 8C shows a left side section view of the barrel, barrel key, and takedown lever.
Figure 8F:
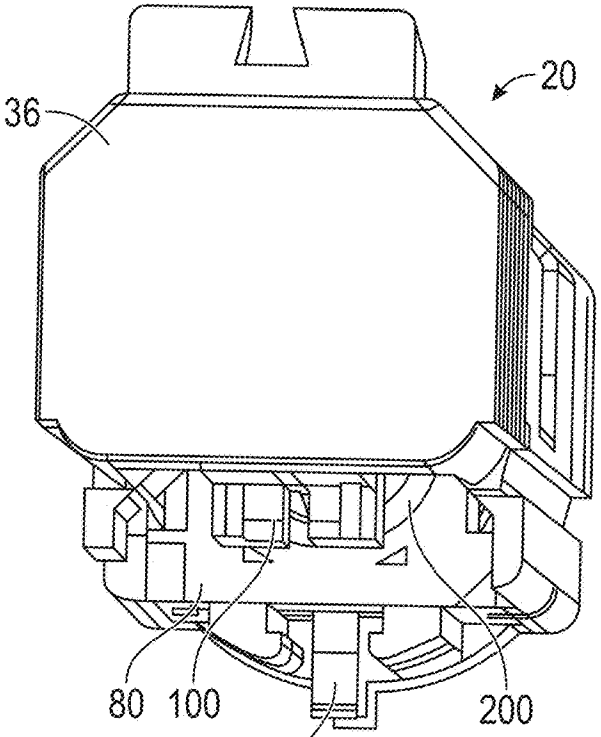
FIG. 8F shows a selectively angled upward view of the takedown lever, barrel key, and barrel housing within the slide.
Figure 8E:
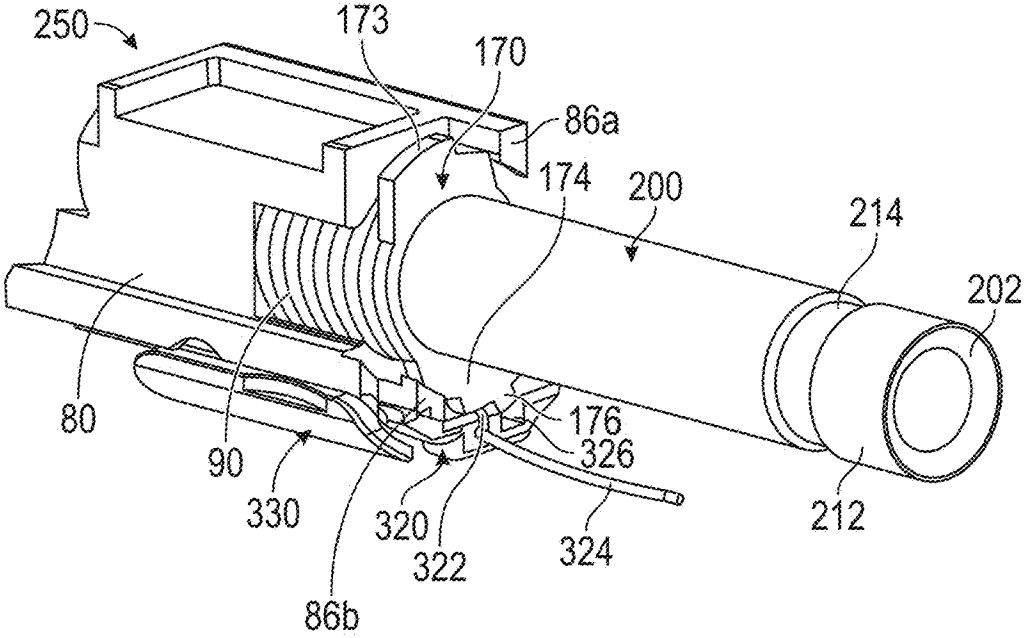
FIG. 8E shows a selectively angled view of the barrel assembly.

FIG. 8A through FIG. 8F show additional views of parts in relation to one another, specifically the barrel 200, takedown lever 330, barrel key 160, and locking spring slider 320. FIG. 8A shows the firearm 10 with the slide 30 in a locked back position. The muzzle end 202 of the barrel is visible as is the circumferential groove 214. The slide is held back by the slide stop 340 being in an upward position. FIG. 8B shows the takedown lever 330 with an arm 332 having a pair of notches 336*a* and 336*b* and a recess 335 there between. FIG. 8C shows a side-section view of the barrel 200, takedown lever 330, and barrel key 160. The barrel key has a circumferential top end 162 that is positioned in the circumferential groove 220 at the breech end 204 of the barrel. The lower end 164 of the barrel key has a notch 166 that fits into the recess 335 of the takedown lever. FIG. 8D shows isometric views of the barrel key and takedown lever, clearly depicting the circumferential top end 162 and notch 166. FIG. 8E shows the barrel assembly 250. It shows the barrel 200 with its breech end 204 in the barrel housing 80 and passing through the recoil spring 90 and recoil spring retainer 170. The recoil spring is fully compressed and the recoil spring retainer upper end 173 contacts the upper end of the housing and abuts the upper protrusion 86*a*. The lower end 174 abuts the lower protrusion 86*b* of the housing. The takedown lever is below the housing, as more clearly depicted in the selectively angled bottom view of FIG. 8F. The locking spring slider 320 is inboard of the takedown lever and below the housing. It has a channel 322 that retains a slider spring 324. The locking spring slider further has a passage 326 into which the endmost tab 176 reciprocates through.

FIGS. 9A through 16B show side section views of the firearm 10 and selectively angled or isolated views of corresponding parts at different stages of operation. Figures with the letter A designation are side section views, with other letter designations being alternative views or isolated combinations of individual parts. FIGS. 9A, 9B, and 9C serve as a basis for identification of predominantly slide assembly 20 parts and their relation to one another in an assembled firearm during a full forward battery condition. FIGS. 9D through 9I serve as a basis for identification of predominantly grip module assembly 300, subassemblies, and their individual parts with relation to one another in an assembled firearm in a full forward battery condition.

The slide 30 interfaces with the grip module 302 along its entire length. The first end of the slide 32 interfaces with the forward end 304 of the chassis, and the second end of the slide 36 interfaces with the rear end of the chassis 306. The chassis further has a grip 310 and trigger guard 314.

The slide 30 defines an ejection port 40 between the first end 32 and rear end 36 of the slide. The ejection port has a front end 42 oriented towards the front end of the slide and a rear end 44 oriented towards the rear end of the slide. The front end of the slide has a front face 34 and defines a bore 50 along bore axis 52 that extends from the face to a dividing section 70 at the second end of the slide. The dividing section has a first limit surface 72 that defines a rear bore 74 extending rearward to a rear internal space 76. The muzzle end of the slide has an internal first diameter portion 54 with a first diameter of 54*a*, and an aft internal second diameter portion 56 with a second diameter of 56*a*. The second diameter portion is shown here as a circumferential recessed area within the slide at the first end, having a greater diameter 57 than the first diameter portion.

Inside the slide 30 is a barrel 200 with a first end 202, also known as the muzzle end, oriented towards the first end of the slide 32, and an opposing second end 204, also known as the breech end, oriented towards the second end of the slide 36, ending just aft relative to the rear end 44 of the ejection port when in the forward battery position as shown in FIG. 9. The barrel has an exterior cylindrical surface 210 and is predominantly uniform along the length of the barrel. The first end of the barrel has an external first diameter portion 212 having a first diameter 212*a*, and an external second diameter portion 214 having a second diameter 214*a* aft of the first diameter portion. In this embodiment the second diameter portion is a circumferential groove having a lesser diameter 214*a* than the first diameter 212*a*. The breech end of the barrel has an external third diameter portion 220 and further defines an internal chamber 222. The barrel is fixed to the chassis 302 by the barrel housing 80 and barrel key 160, which is pushed into the third diameter portion 220, also referred to as a rear barrel groove, of the barrel at the breech end 204.

The barrel housing 80 encases the breech end 204 of the barrel along with part of the recoil spring 90. The recoil spring is constrained between the bore 84 of the housing and a recoil spring retainer 170, which is able to reciprocate between barrel housing protrusions 86*a* and 86*b* and the forward end of the slide 32 and is restrained by the slide's recoil spring retainer cutout 60, resulting in the retainer moving forward and backward with the reciprocation of the slide. The front of the piston 150 is flush with the breech face 112 of the reciprocating block when the slide is in the forward battery position.

The reciprocating block 100 is shown to have a forward locking element holder portion 102 at the forward end 32 of the slide and an opposing face portion 110 abutting a first limit surface 72 of a dividing section 70 towards the rear end 36 of the slide. The reciprocating block has an internal firing pin channel 132 within which is a moveable piston 150 containing a moveable firing pin 152. Shown more clearly in FIG. 10E, the piston has forward end internal shoulder 150*a* that restricts forward movement of the firing pin when it is inside the piston, and a middle section 151 with an external first middle shoulder 151*a* towards the tip end of the firing pin and an opposing external second middle shoulder 151*b* towards the hammer end of the firing pin.

FIG. 9B is a selectively angled cut-away view of the front portions of the slide assembly 20. It further depicts how the second diameter portion 56, also referred to as a slide groove, of the slide is a circumferential groove having radial edges. It likewise more clearly depicts the second diameter portion 214 of the barrel, also referred to as a barrel groove, being a circumferential groove with angled walls. In the embodiment shown here, there is a first receptacle 104 in the reciprocating block 100 locking element holder portion 104 that has a first locking element 106; and there is a second a receptacle 104*a* in the locking element holder portion that has a second locking element 106*a*. In the embodiment the receptacles are through holes and are three in number as is shown in FIG. 3. The receptacle, 106 in FIG. 9A and second receptacle 104*a* in FIG. 9B, has a partial overlap with the barrel groove 214 and first diameter portion 54 of the slide. This keeps the locking element 106, and second locking element 106*a* in FIG. 9B, radially inward within the barrel groove. All locking elements are fully engaged in the barrel groove or grooves, depending on the embodiment, securing the reciprocating block in place.

FIG. 9C is an underside view of the slide assembly 20 showing the slide 30, barrel 200, reciprocating block 100, recoil spring 90, and the right horseshoe tab 96*a* and left horseshoe tab 96*b*. The barrel housing 80 is absent. The hammer end 156 of the firing pin is seen protruding from the dividing section 70 of the slide into the rear internal space 76.

FIG. 9D shows a round of ammunition 650 loaded in the chamber 220 of the breech end 204 of the barrel 200. The ammunition is a casing 652 with an internal space 654 for containing propellant, a seated bullet 656 at the forward end, and a primer 660 at the opposing rear end that is approximately flush with the rear face 653 of the casing. The bullet is oriented towards the muzzle end 202 of the barrel and the primer abuts or is near to abutting (depending on the seating depth of the primer within the casing) the breech face 112 of the reciprocating block.

FIG. 9D further shows a side section view of the fire control unit assembly 400 parts within the trigger guard 314 and adjacent area of the chassis 302 and the hammer housing assembly within the chassis. The trigger shoe 402 is oriented to have its forward-facing front face 404 in the direction of the front end 304 of the chassis and four opposing brackets 412 (though only one is visible completely in the figure) oriented towards the rear end 306 of the chassis. A secondary sear 460 is behind the trigger shoe and is flanked by the brackets. The secondary sear defines a transverse pivot hole 466 between an upper engagement facility 470 and a lower engagement portion 476. The upper engagement facility has a cutout 472. The rear side (shown in other figures) has a sear ledge 480 above a reset ramp 482 with a sear face 484 between the two. The bottom of the secondary sear defines a cutout 486 that accommodates part of the magazine catch 370.

FIG. 9E shows a selectively angled view of the secondary sear 460 with its front portion 462 and rear portion 464 clearly delineated. The upper portion of the rear portion defines a transverse pivot hole 466. The front portion has an upper engagement facility 470 and a lower engagement portion 476. The upper engagement facility has a cutout 472 and groove 474. The rear portion has a sear ledge 480 above a reset ramp 482 with a sear face 484 between the two. The bottom of the secondary sear defines a lower cutout 486.

FIG. 9F shows the primary 420. The primary sear has an elongated body 422 defining two lateral holes 424 and 426 registered with one another, a rearward tab 430 with engagement surface 432, and a forward nose 436.

FIG. 9G shows a side section view of the secondary sear 460 within the trigger shoe 402 brackets 412 and the nose 436 of the primary sear 420 abutting the sear face 484 of the secondary sear between the sear ledge 480 and reset ramp 482. The trigger spring 490 can be seen in the groove 474 just below the upper engagement facility 470 cutout 472 with a trigger spring leg 492 biasing the trigger shoe at the rearward lower portion 410.

FIG. 9H is a selectively angled section view expanding on the parts in FIGS. 9E-9G, showing the sear tab 430 engagement surface 432 contacting the hammer ramp 507 of the hammer tooth of the hammer 500. The hammer's medial channel 510 is visible as is the pivot hole 512. The hammer has a radial strike face 504 at its rear end and a hammer tooth 509 below a rounded forward end 514 (see FIG. 6) and consisting of a spring notch 506, ramp, and bent 508, also referred to as a hammer sear notch.

FIG. 9I shows the hammer housing assembly 500 with the hammer 502, hammer housing 520, and ejector 540. The hammer is set partially within the housing between the right housing leg 524 and left housing leg 526. The ejector is in the division 550 between the left and right half of the housing and in the hammer medial channel 510. The hammer spring 570 goes around the hammer such that the legs 572 and 574 of the spring press against the legs of the housing. As the hammer face 504 is rotated backward, the hammer notch rotates forward, causing the spring to bias the hammer to rotate forward.

With the left safety selector 360 down, the safety bar 564 has moved forward and is disengaged. This allows the hammer 502 to be in a forward position with the hammer's lower ramp 507 below hammer sear notch 508 to contact the tab's engagement surface 432, pushing the rear tab 430 of the primary sear 420 down and the nose 436 of the primary sear up onto the sear ledge 480 of the secondary sear, which blocks further rotation of the primary sear and placing the firearm into a ready-to-fire condition.

FIG. 9D shows the hammer tooth 509 ramp 507 with hammer sear notch 508 rotated backward due to the safety selector going from an up position (see FIG. 17A) to a down position, moving the safety bar 564 forward until the hammer sear notch 508 contacts the engagement surface 432 of the tab 430 of the primary sear 420. This pushes the primary sear down and the nose 436 up against the sear ledge 480 of the secondary sear 460, which blocks further rotation of the primary sear as described previously. The hammer is cocked, held by the engagement surface 432 at the front of the primary sear tab engaging with the hammer ramp 507, preventing the hammer from rotating forward. The secondary sear is engaged, blocking the primary sear from moving. The magazine catch 370 forward hole 372 is inside the lower cutout 386 of the secondary sear (see FIG. 9A). The trigger shoe 402 remains forward.

Figure 10A:
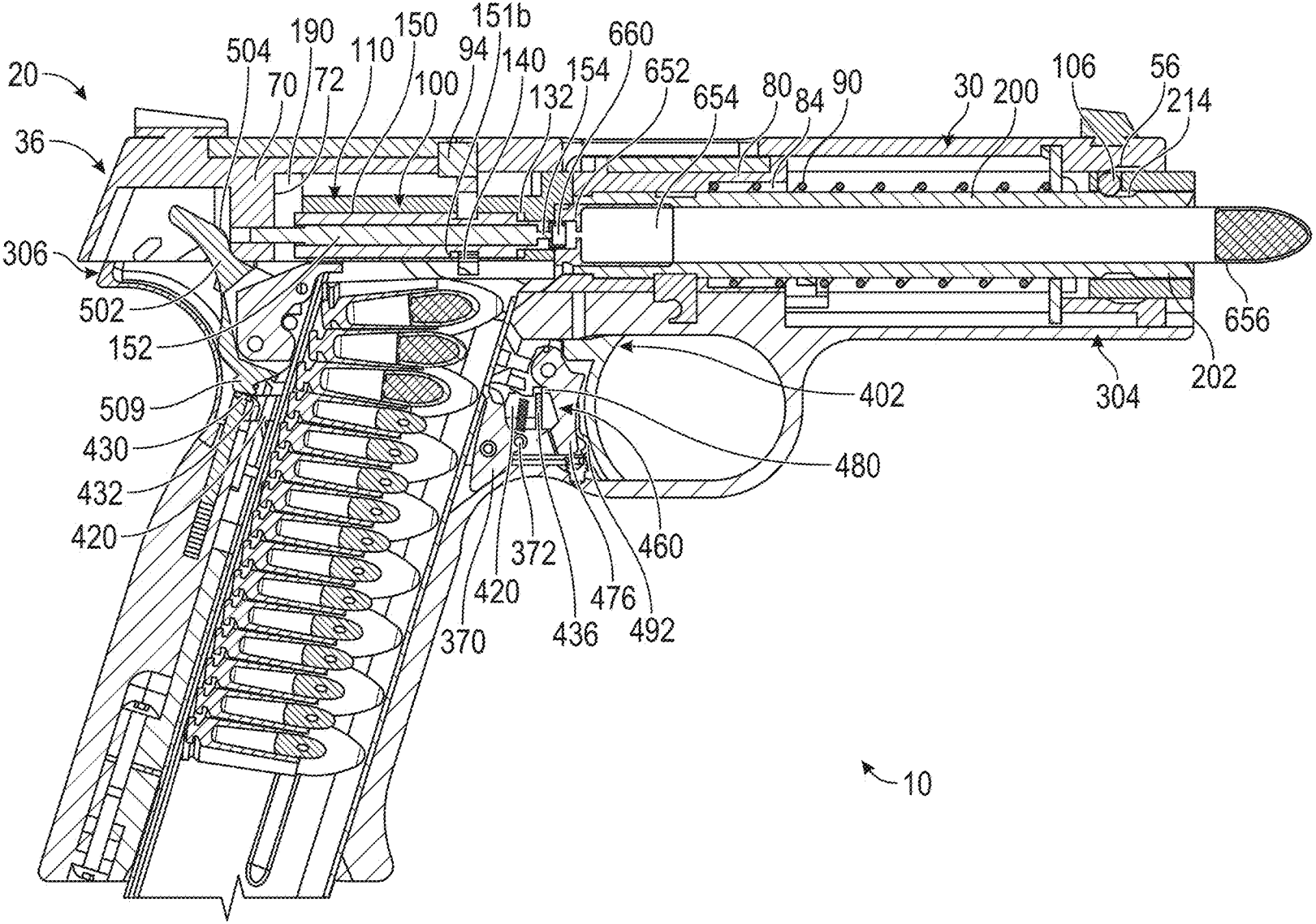
FIG. 10A is a right side section view of the firearm shortly after discharge with the slide assembly still locked.

FIG. 10A shows an early stage of the firing sequence. The trigger shoe 402 is moved rearward, pressing the trigger spring legs 492 and rotating the secondary sear 460 upper engagement facility 472 rearward and lower engagement facility 476 forward. This can also be visualized in the differences in the positioning of the lower cutout 486 and the front hole 372 of the magazine release 370 between FIGS. 9A and 10A. The rearward movement of the trigger shoe 402 moves the upper engagement facility rearward. The ledge 480 of the secondary sear clears the nose 436 of the primary sear 420, causing the primary sear to rotate with its nose moving upwards and its rear tab 430 moving downwards and slides down the hammer ramp 507, allowing the hammer 502 to rotate forward and the strike face 504 to hit the hammer end 156 of the firing pin 152. The rotation of the hammer causes the primary sear to continue to be pressed downward, allowing the trigger shoe to continue traveling rearward and resulting in overtravel.

Upon striking hammer end 156 of the firing pin 152, the firing pin moves forward within the piston 150. The primer end 154 of the firing pin strikes the primer 660, resulting in the activation of the propellant within the cavity 654 of the ammunition casing 652, which generates force with a forward vector to propel the bullet 656 forward towards the muzzle end 202 of the barrel 200. The force has a corresponding simultaneous rearward vector that acts upon the piston and primer.

The rearward force upon the piston is communicated to the first limit surface 72 of dividing section 70 and causing the slide 30 to move rearwards, resulting in a gap 190 between the first limit surface and the face portion 110 of the reciprocating block 100. The piston 150 initially remains in contact with the first limit surface but as the slide begins moving rearward the reciprocating block remains stationary as it is restricted in place by the locking element 106. The piston's first middle shoulder 151*a* in the middle of the piston impacts the piston retainer 140, stopping the piston's rearward motion piston, resulting in the piston protruding beyond the reciprocating block. See also FIG. 10C, which is a bottom view of the slide assembly 20. This ensures that the primer remains seated in the case, preventing disassembly from the casing 652 so that the casing and primer can eject as a single unit. Even though the piston has stopped, the slide continues moving rearward due to inertia.

Before the bullet 656 has left the barrel, the slide begins moving rearward while the reciprocating block 100 and barrel 200 remain stationary. Shortly after the bullet has left the barrel, as shown in FIG. 10A, first diameter portion 54 of the slide 30 still biases the locking element 106 into the front barrel groove 214.

Figure 10B:
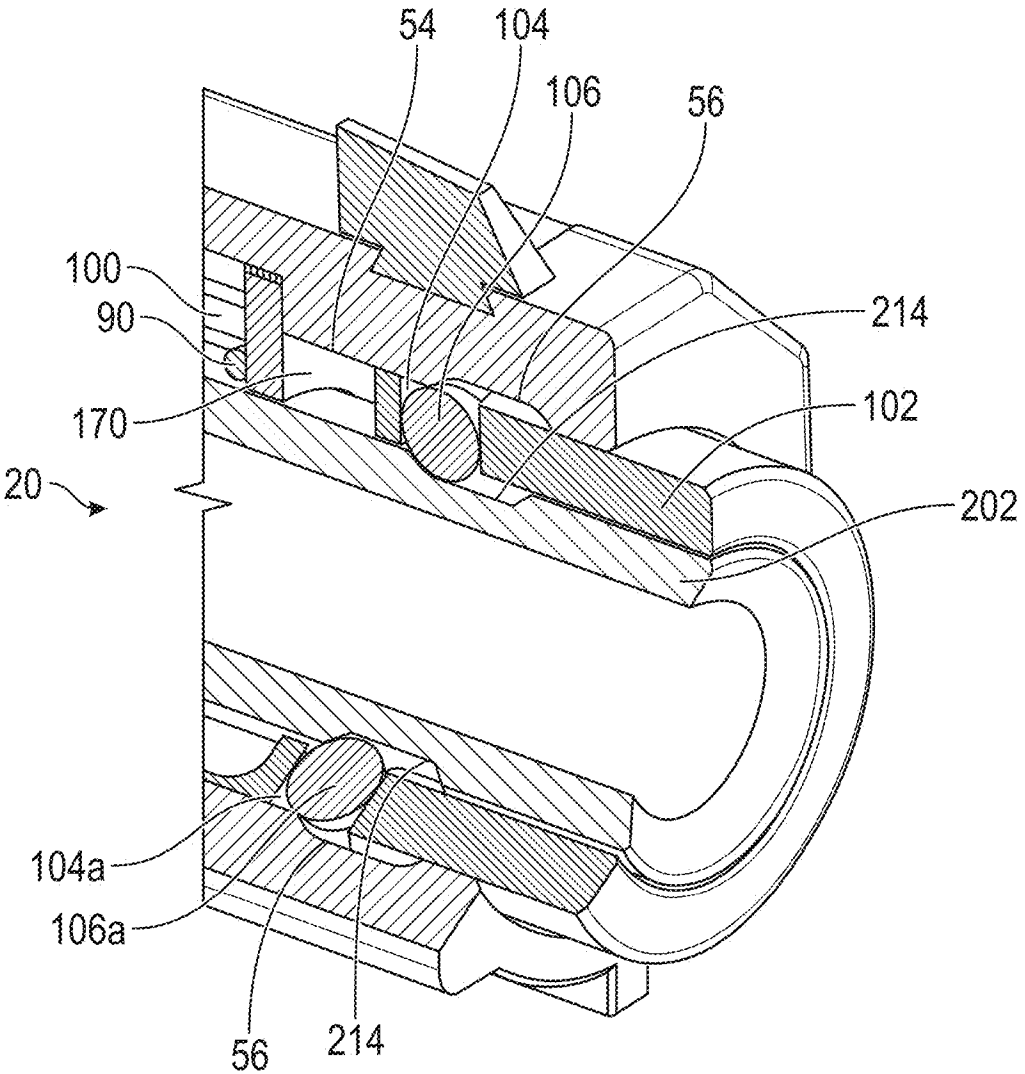
FIG. 10B is a selectively angled two thirds section view of the forward end of the slide assembly in FIG. 10A.

FIG. 10B shows a selectively angled two-thirds section view of the forward portion of the slide assembly 20 in FIG. 10A, but shows two receptacles 104 and 104*a* containing two locking elements 106 and 106*a*. The slide 30 has moved rearward while the reciprocating block 100 and barrel remain stationary. The first diameter portion 54 of the slide 30 still biases the locking element 106 into the front barrel groove 214.

Figure 10C:
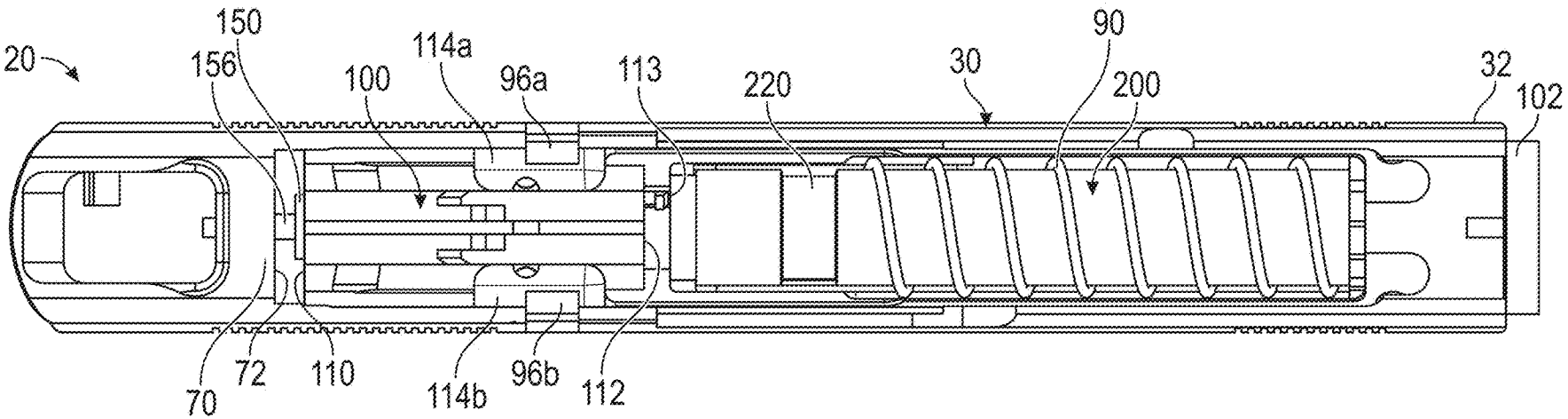
FIG. 10C is an upward view of the slide assembly in FIG. 10A with barrel housing and barrel key removed.

FIG. 10C further shows that the horseshoe 94, shown here the right tab 96*a* and left tab 96*b*, does not yet abut the reciprocating block 100.

Figure 10D:
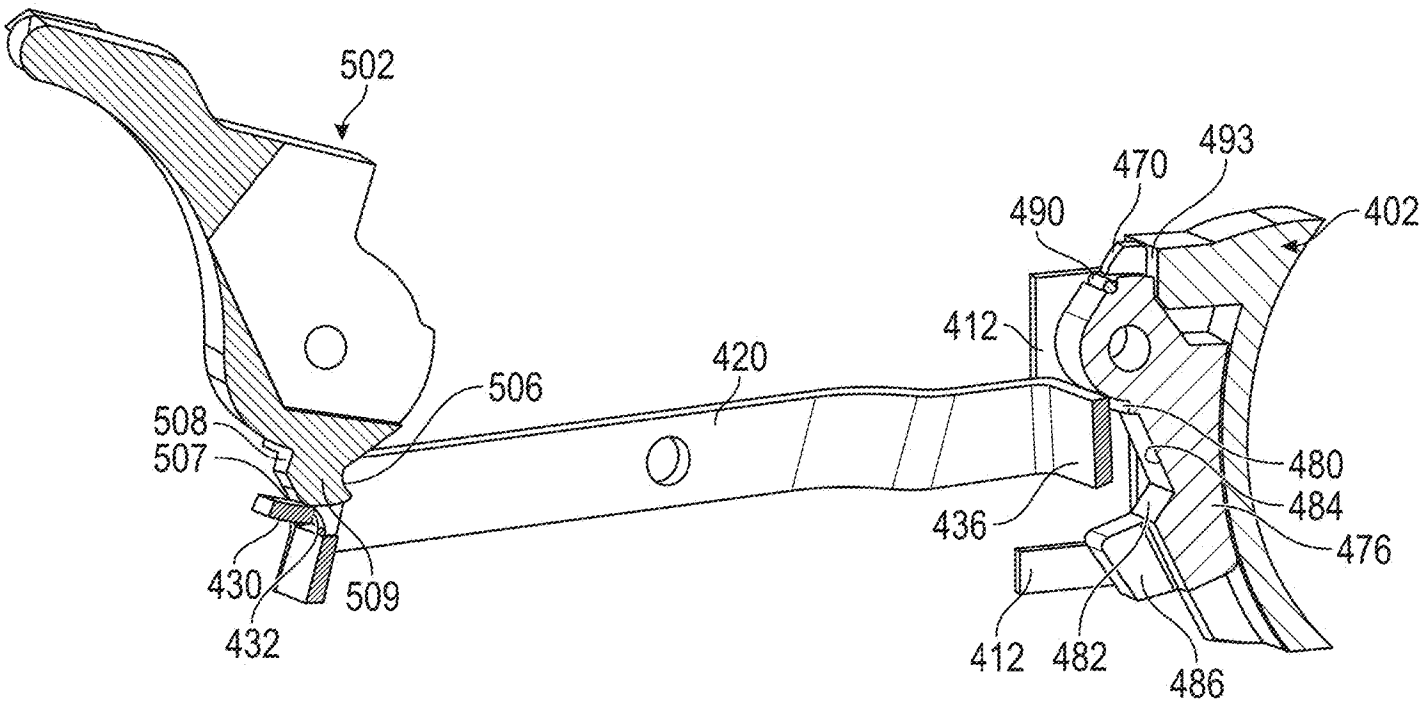
FIG. 10D is a selectively angled partial side section view of some of the components of the fire control housing assembly as they are in FIG. 10A.

FIG. 10D shows an selectively angled section view of the trigger shoe 402, secondary sear 460, primary sear 420, and hammer 502 during full actuation of the fire control unit assembly. The shoe compresses the trigger spring 490 fully, resulting in the rearward lower portion 410 contacting the lower engagement facility 476 of secondary sear. The secondary sear is fully rotated, resulting in the nose 436 of the primary sear traveling past the ledge 480 of the secondary sear, which allows the rear tab 430 to rotate downward and slide past the hammer ramp 507.

Figure 10E:
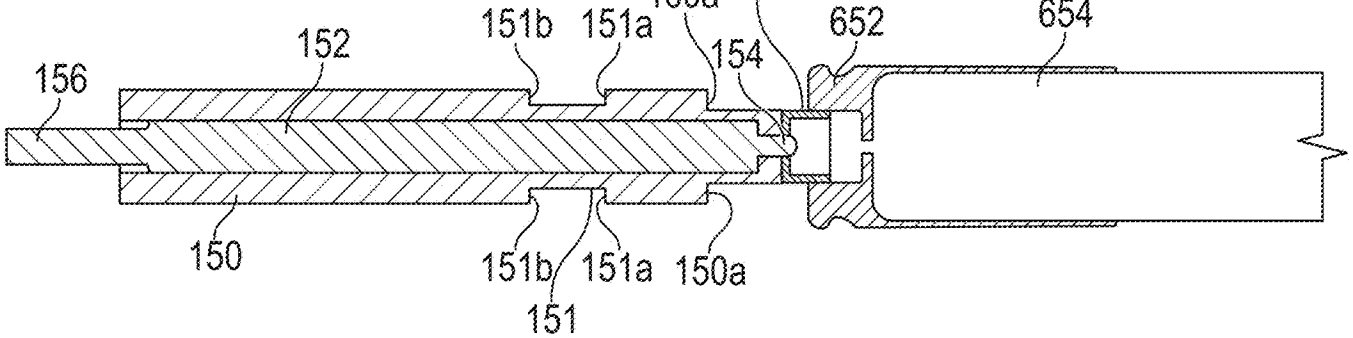
FIG. 10E is an isolated side section view of the piston and firing pin as shown in FIG. 10A.

FIG. 10E more clearly shows how the primer 660 is pushed partially out of the casing 652, just past the rear face 653 of the casing. It further shows more clearly that the piston has a forward internal shoulder 150*a* that restricts forward movement of the firing pin when it is inside the piston, an external first middle shoulder 151*a* towards the tip end of the firing pin, and an opposing external second middle shoulder 151*b* towards the hammer end of the firing pin.

Figure 11A:
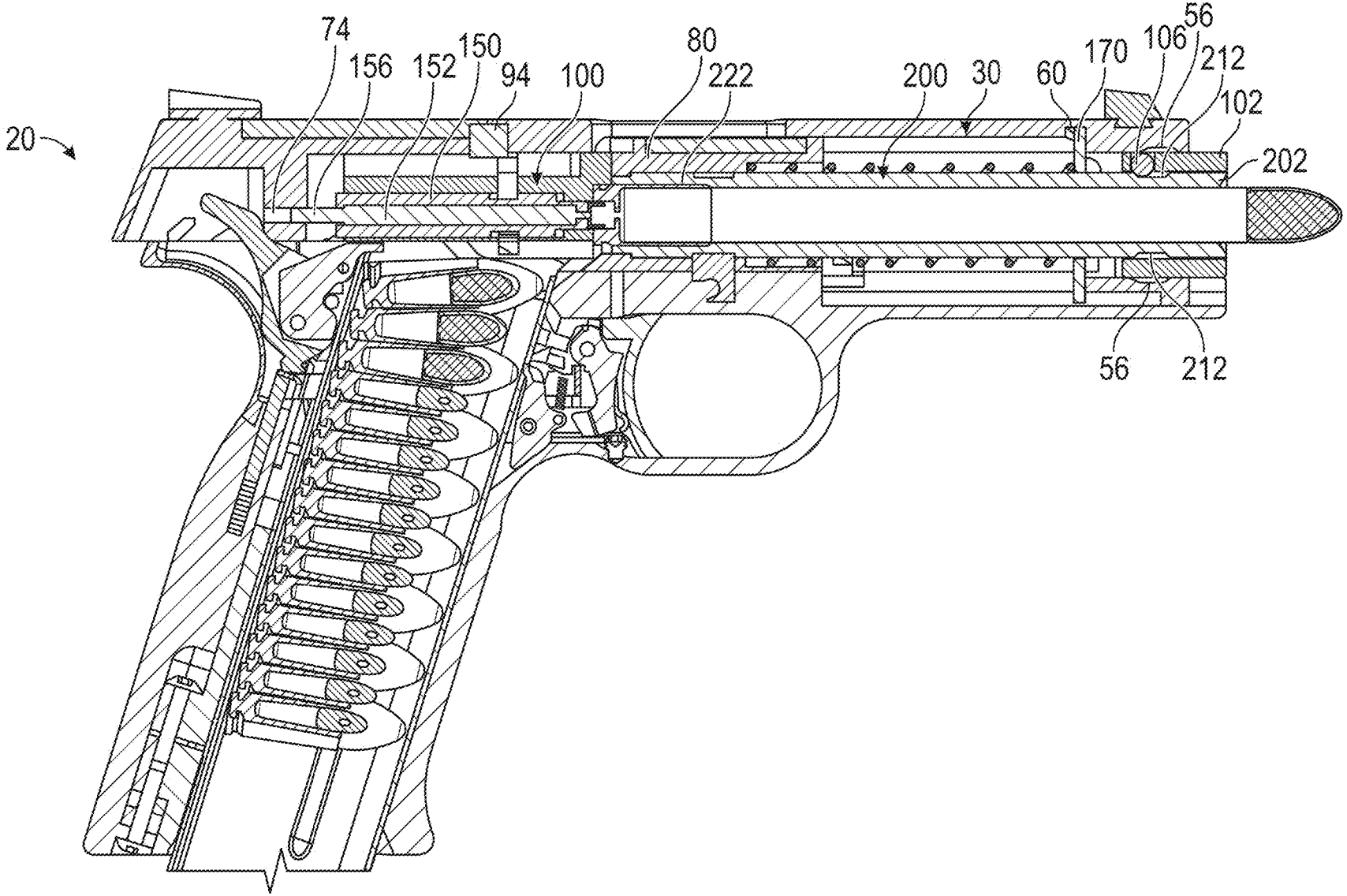
FIG. 11A is a right side section view of the firearm after discharge just before the reciprocating block unlocks from the barrel.
Figure 11B:
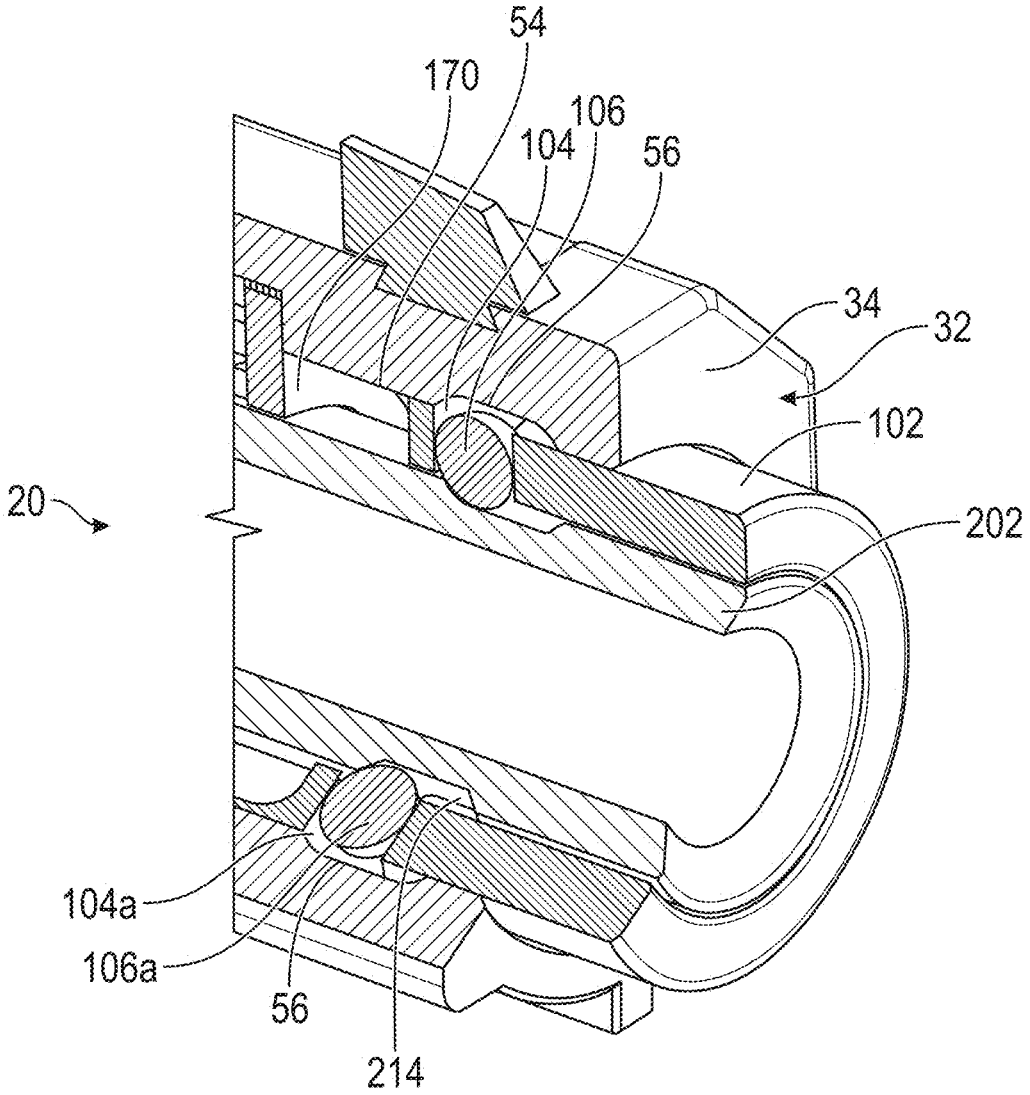
FIG. 11B is a selectively angled two-thirds section view of the forward end of the slide assembly in FIG. 11A.

FIG. 11A through FIG. 11B shows the slide assembly 20 continuing to move rearward. FIG. 11A is a side section view of the firearm 10. FIG. 11B shows a selectively angled two-thirds section view of the forward portion of the slide assembly 20 in FIG. 11A but shows two receptacles 104 and 104*a* containing two locking elements 106 and 106*a*.

The slide 30 moves rearward, resulting in the slide groove 56 to overlap the front barrel groove 214, exposing the locking element 106. Any locking elements can move outward but do not yet because the reciprocating block 100 has insufficient force to move rearward due to the loss of pressure in the chamber 222 after the bullet 656 leaves the barrel 200. The reciprocating block thus remains temporarily in a locked condition. The horseshoe 94 moves rearward and the inward facing tabs 96*a* and 96*b* contact and exert force on the rear of cutouts 114*a* and 114*b* of the reciprocating block respectively. The hammer end 156 of the firing pin 152 is still partly within the rear bore 74.

Figure 12A:
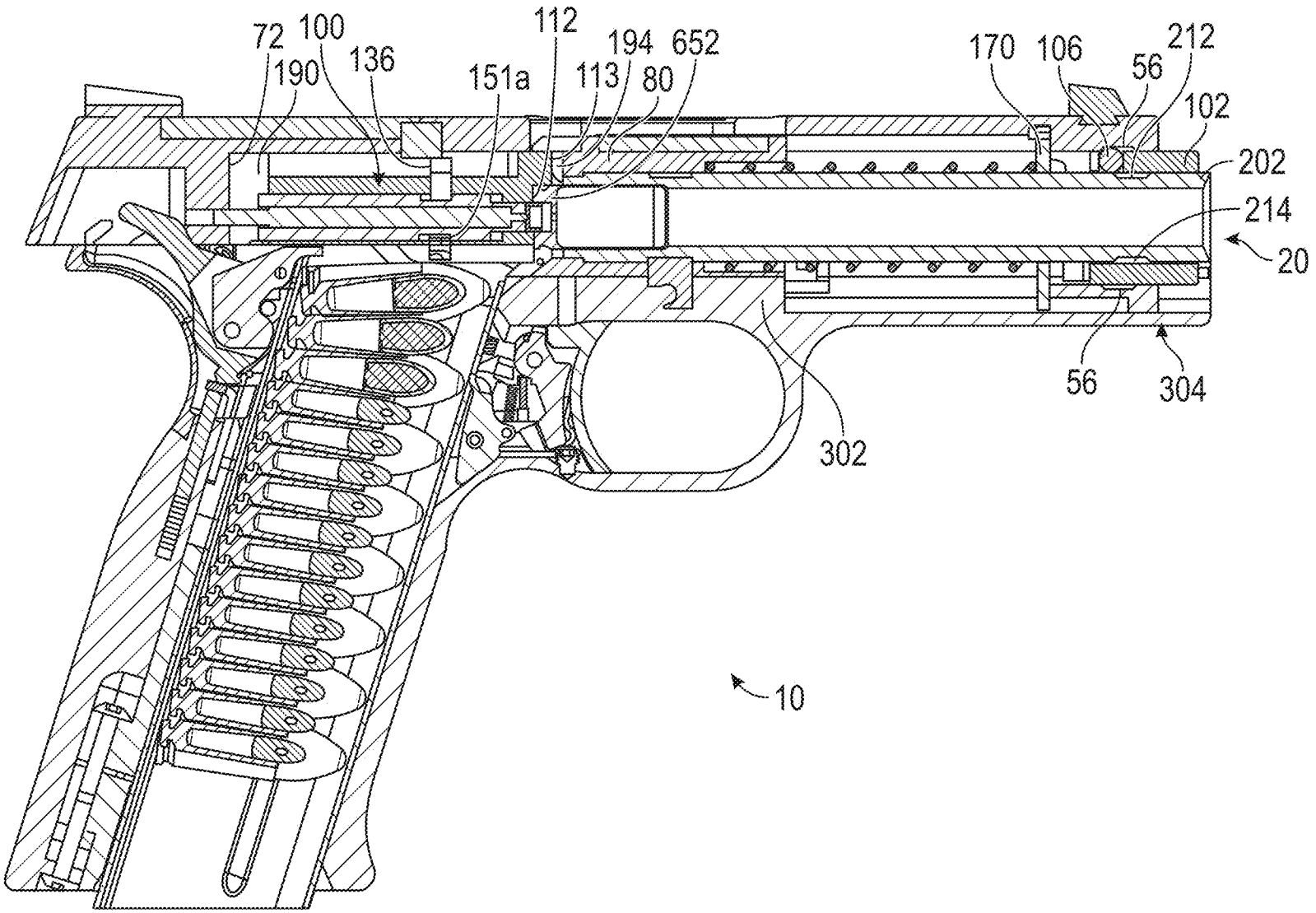
FIG. 12A is a right side section view of the firearm after discharge with the slide assembly unlocked.
Figure 12B:
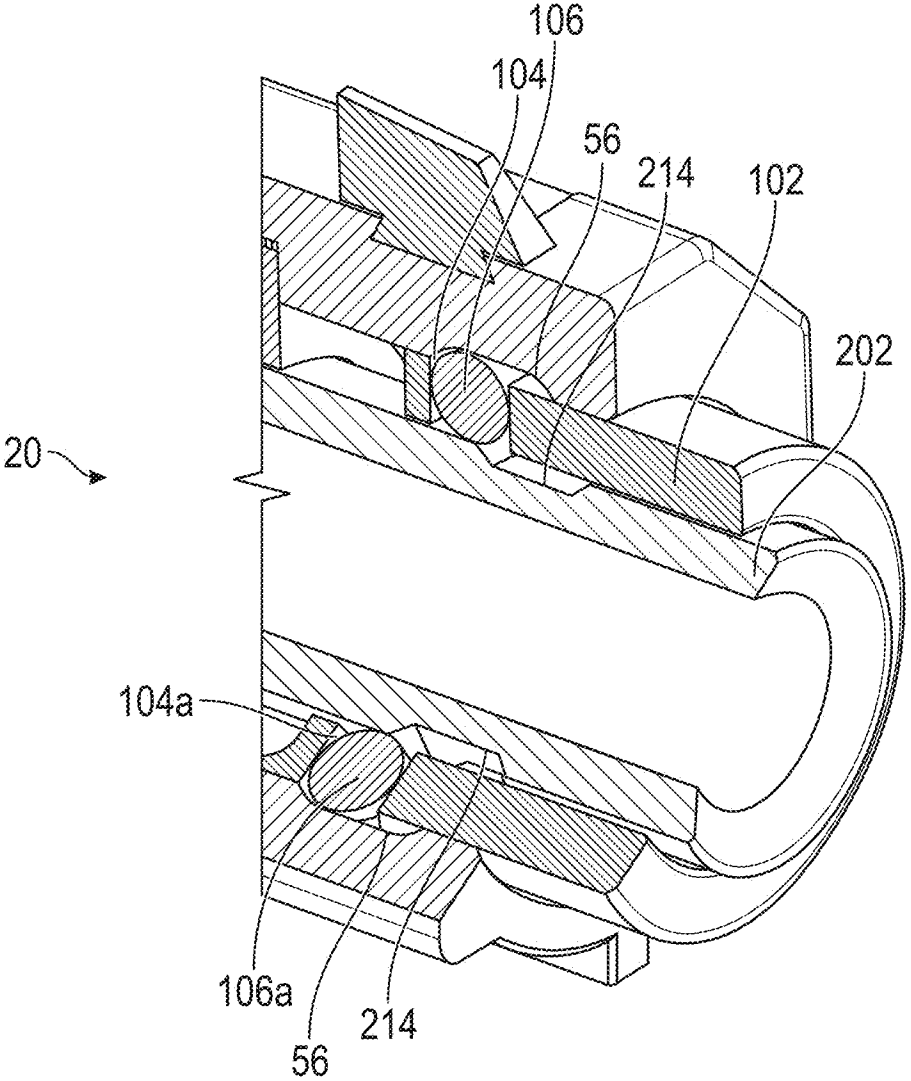
FIG. 12B is a selectively angled two-thirds section view of the forward end of the slide assembly in FIG. 12A.
Figure 12C:
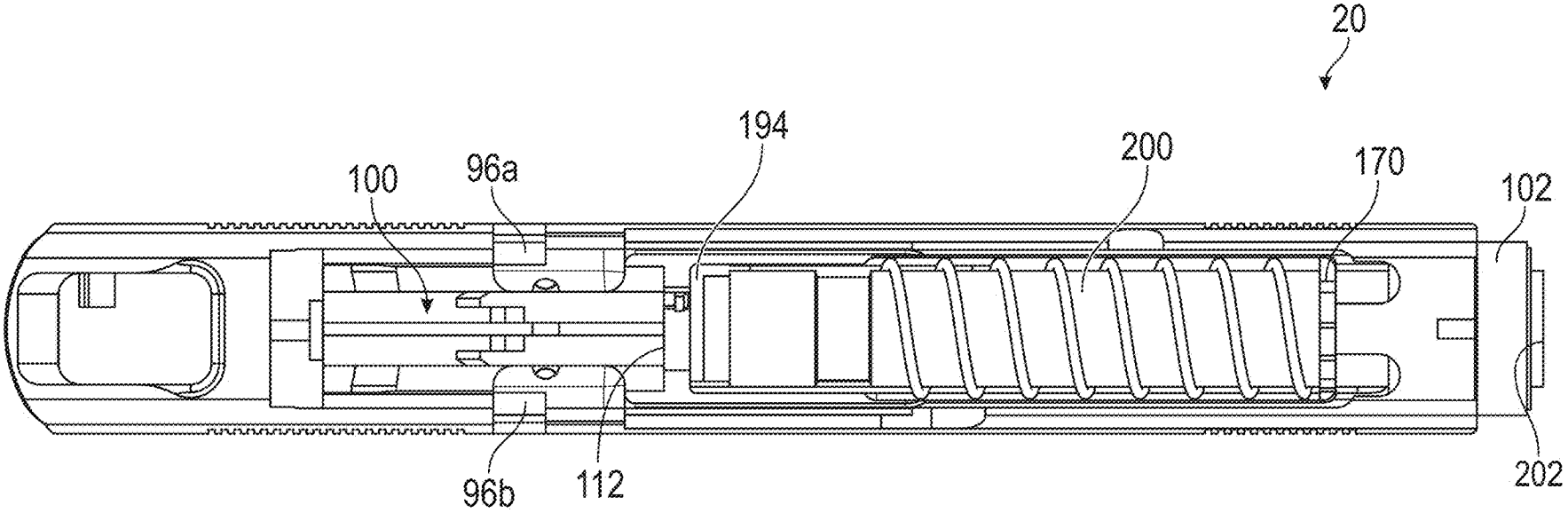
FIG. 12C is an upward view of the slide assembly in FIG. 12A with barrel housing and barrel key removed.

FIG. 12A through FIG. 12C show the slide assembly 20 continuing to move rearward due to momentum. FIG. 12A is a side section view of the firearm. FIG. 12B shows a selectively angled two-thirds section view of the forward portion of the slide assembly 20 in FIG. 12A but shows two receptacles 104 and 104*a* containing two locking elements 106 and 106*a*. The slide travels rearward with the horseshoe 94 in cutout 64 of the slide and in the cross top channel 136 of the reciprocating block 100 face portion 110 towards the rear of the block. The inward facing tabs, 96*a* and 96*b* of the horseshoe contact the rear faces of cutouts 114*a* and 114*b* in the reciprocating block respectively. This causes the horseshoe to transfer rearward force to the reciprocating block. The locking element 106 in receptacle 104, and in the case of FIG. 12B showing two receptacles 104 and 104*a* having locking elements 106 and 106*a*, are fully disengaged from the front barrel groove 214 as the locking element holding portion 102 moves any receptacles rearward, moving any locking element radially rearward out of the barrel groove and into the slide groove 56. This unlocks the reciprocating block, allowing it to move freely rearward, as shown by a gap 194 between the breech face 112 and barrel housing 80, which like the barrel remains fixed to the chassis 302. Any locking elements continue to be disengaged and the reciprocating block continues moving unrestricted rearward. The hammer end 156 of the firing pin is in a forward position in relation to the slide 30, being within the rear bore 74, preventing contact with the strike face 504 of the hammer. The slide dividing section 70 contacts the hammer and rotates the hammer rearward as the slide moves rearward. After the dividing section clears the hammer, the reciprocating block holds the hammer back.

The rear tab's engagement surface 432 of the primary sear 420 catches the hammer 502 by the hammer sear notch 508 behind the hammer tooth 509, stopping future forward rotation of the hammer strike surface 504.

Figure 13A:
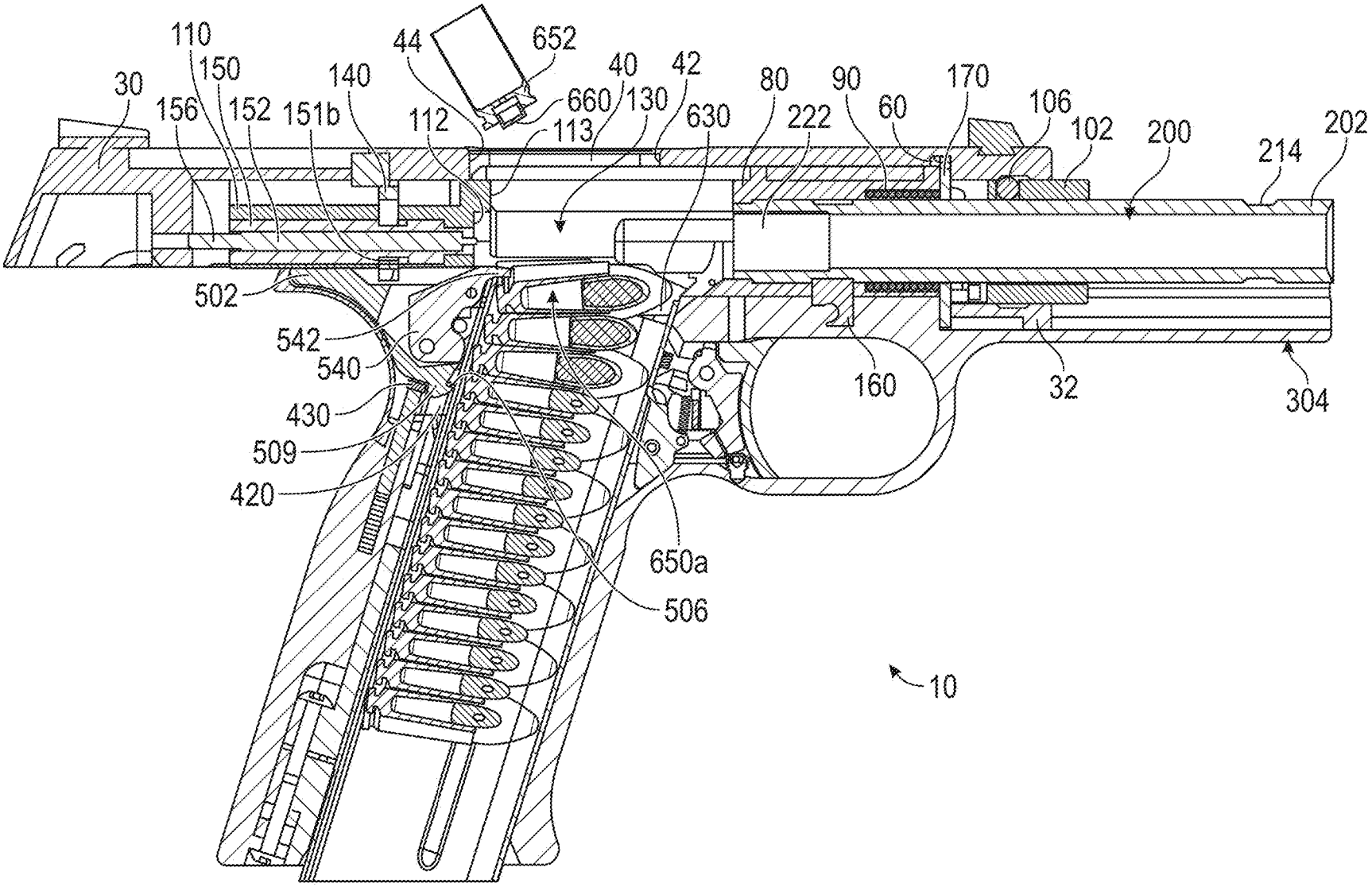
FIG. 13A is a right-side section view of the firearm during discharge with the slide assembly in its rearward-most condition.
Figure 13B:
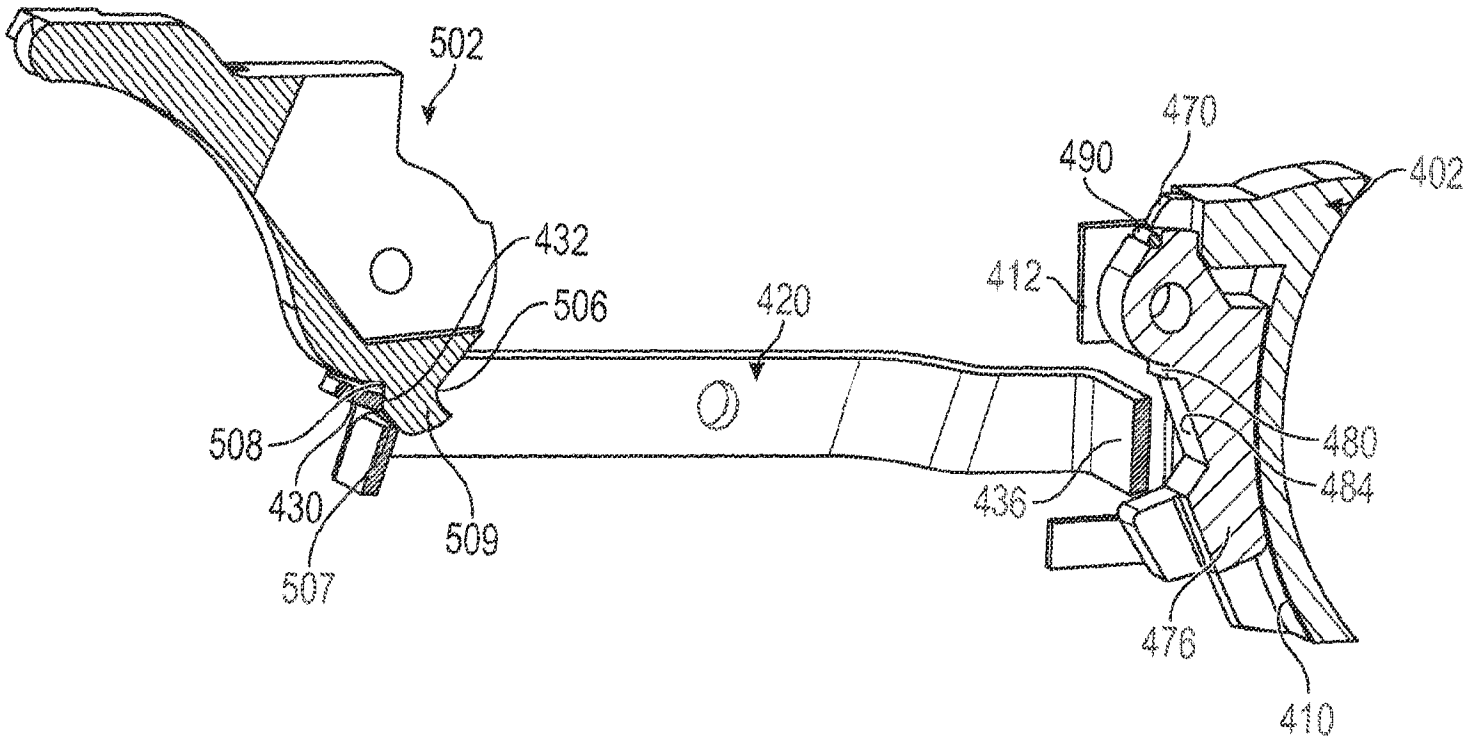
FIG. 13B is a selectively angled partial side section view of selected isolated components of the fire control housing assembly in FIG. 13A.
Figure 13C:
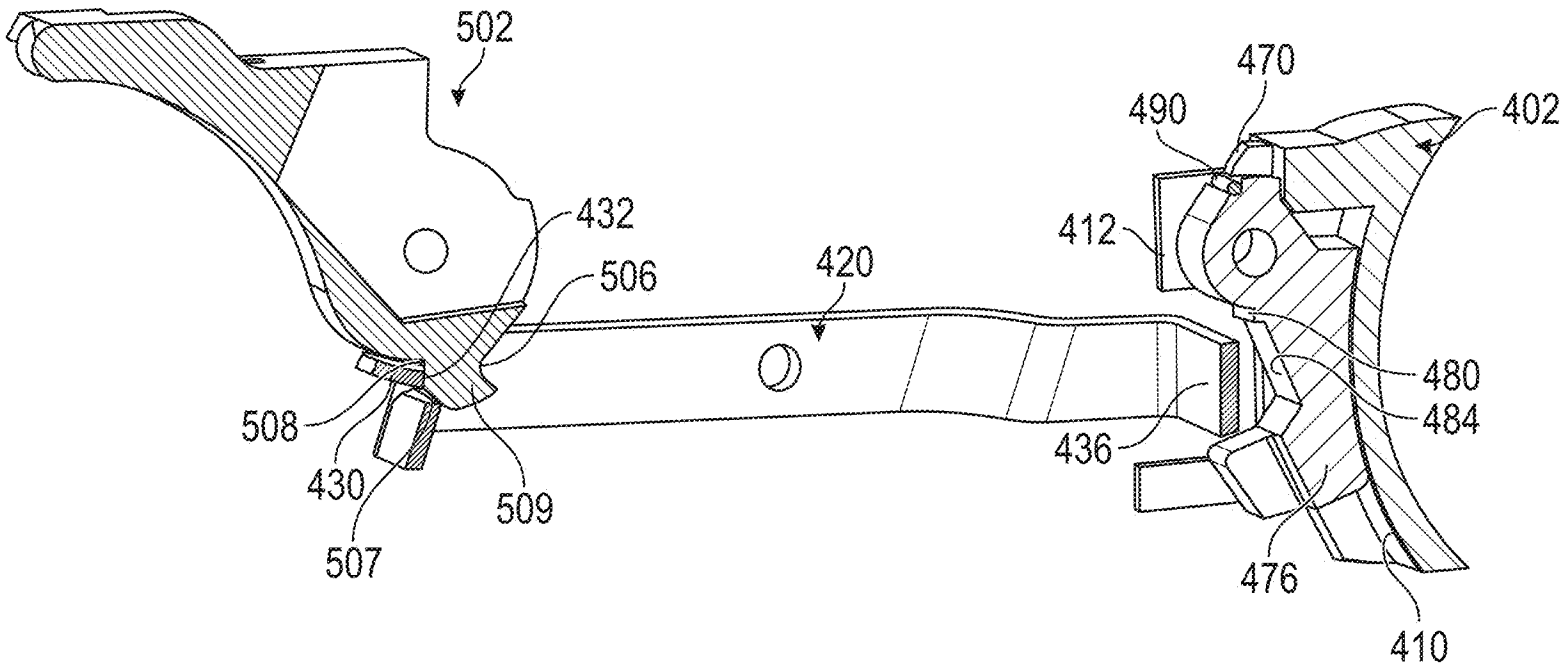

FIG. 13A through FIG. 13B shows slide assembly 20 in its rearward most position. FIG. 13A is a side section view of the firearm 10. The slide 30 and reciprocating block 100 face portion 110 have cleared the top cartridge 750*a* of the magazine. The discharged casing 652 was ejected from the slide by ejector 540 nose 542 pushing the rim of the casing from the extractor (not shown here but visible elsewhere) as the slide moved rearward through the unobstructed path created by the alignment of the ejection port 40, open portion 130 of reciprocating block, and magazine opening 630. The piston 150 and firing pin 152 are at a stop. The piston 150 is aligned with the rear end face portion of the reciprocating block due to the piston retainer 140 hitting the second middle shoulder 151*b* and pushing the piston rearward.

The hammer 502 is fully rearward, and the trigger shoe 402 is still pulled rearward. The primary sear 420 is behind the sear notch 508 of the hammer, preventing the hammer from rotating forward even after the slide begins to move forward again (as in FIG. 14).

FIG. 13B shows the trigger shoe 402, secondary sear 460, primary sear 420, and hammer 502 in an isolated angle side sectional view of their arrangement in FIG. 13A. The primary sear 420 is more clearly seen as behind the sear notch 508 of the hammer, specifically the rear tab 430 is behind the ramp 507. This prevents the hammer from rotating forward. The trigger shoe is fully pressed against the secondary sear 460 and the primary sear's nose 436 is disengaged from the ledge 480 and sear face 484 of the secondary sear.

Figure 14:
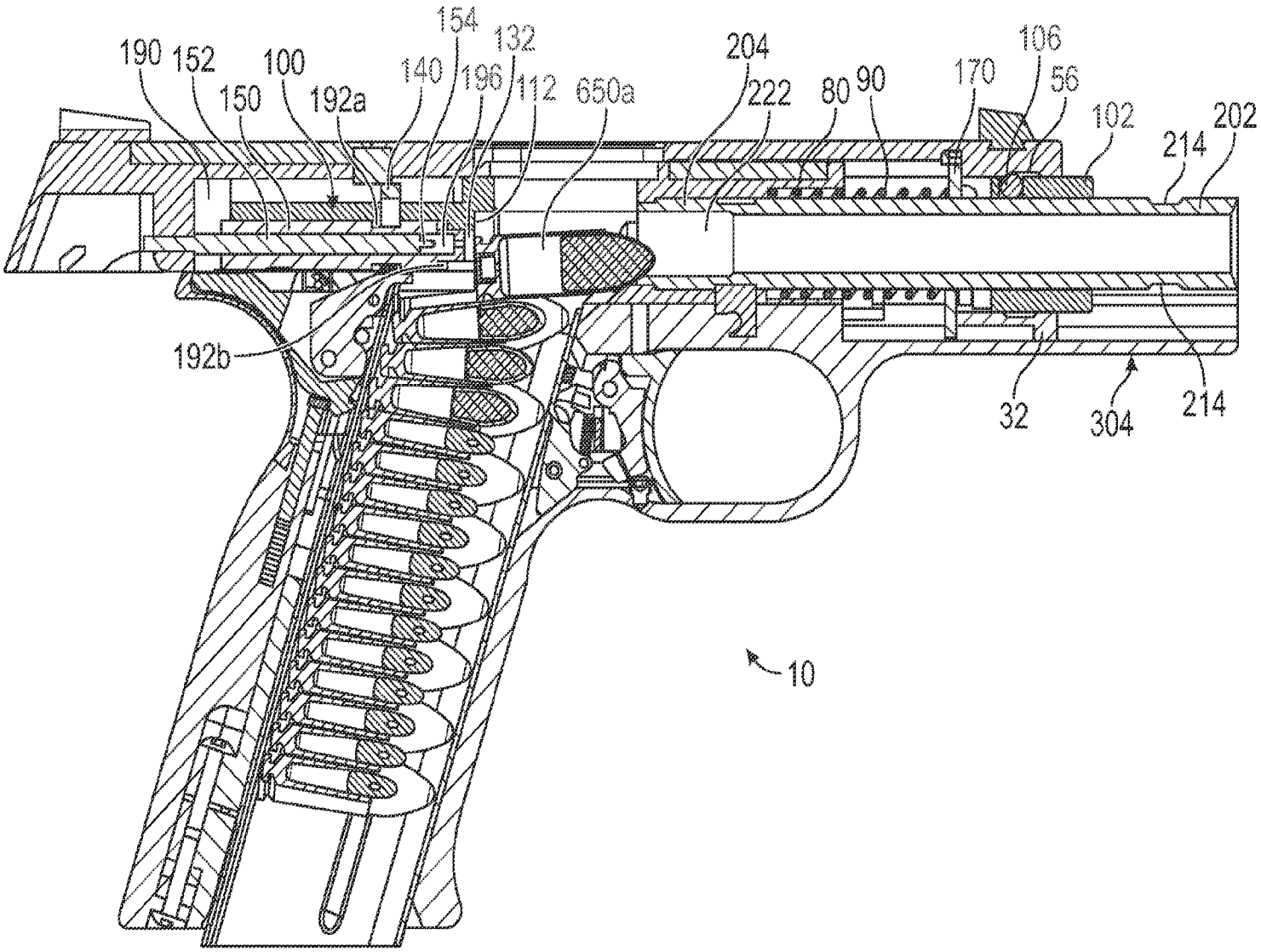
FIG. 14A is a right side section view of the firearm in the early stages of going into battery.

FIG. 14 shows slide assembly 20 is returning to a forward battery condition. FIG. 14 is a side section view of the firearm 10. The slide 30 moves forward under force of the recoil spring 90. The piston 150 and firing pin 152 remain at a stop as the slide moves forward, indicated with the gaps: 190 between the first limit surface and the reciprocating block 100, the gap 192*a* between the middle shoulder of the piston and the piston retainer 140, gap 192*b* between the forward shoulder 150*a* of the piston and breech face 112 of the reciprocating block, and gap 196 between the firing pin 150 forward end 154 and the forward end of the piston towards the breech face. The breech face 112 of the reciprocating block contacts the next ammunition cartridge 650*a* at the top of the magazine opening 630, pushing the casing towards the breech end 204 of the barrel 200 and into the chamber 222. The piston retainer 140 within the reciprocating block contacts the first middle shoulder 151*a* of the piston 150, moving the piston forward with the rest of the slide assembly components.

The movement of the reciprocating block 100 pushes any locking elements forward towards the muzzle end 202 of the barrel 200.

Figure 15A:
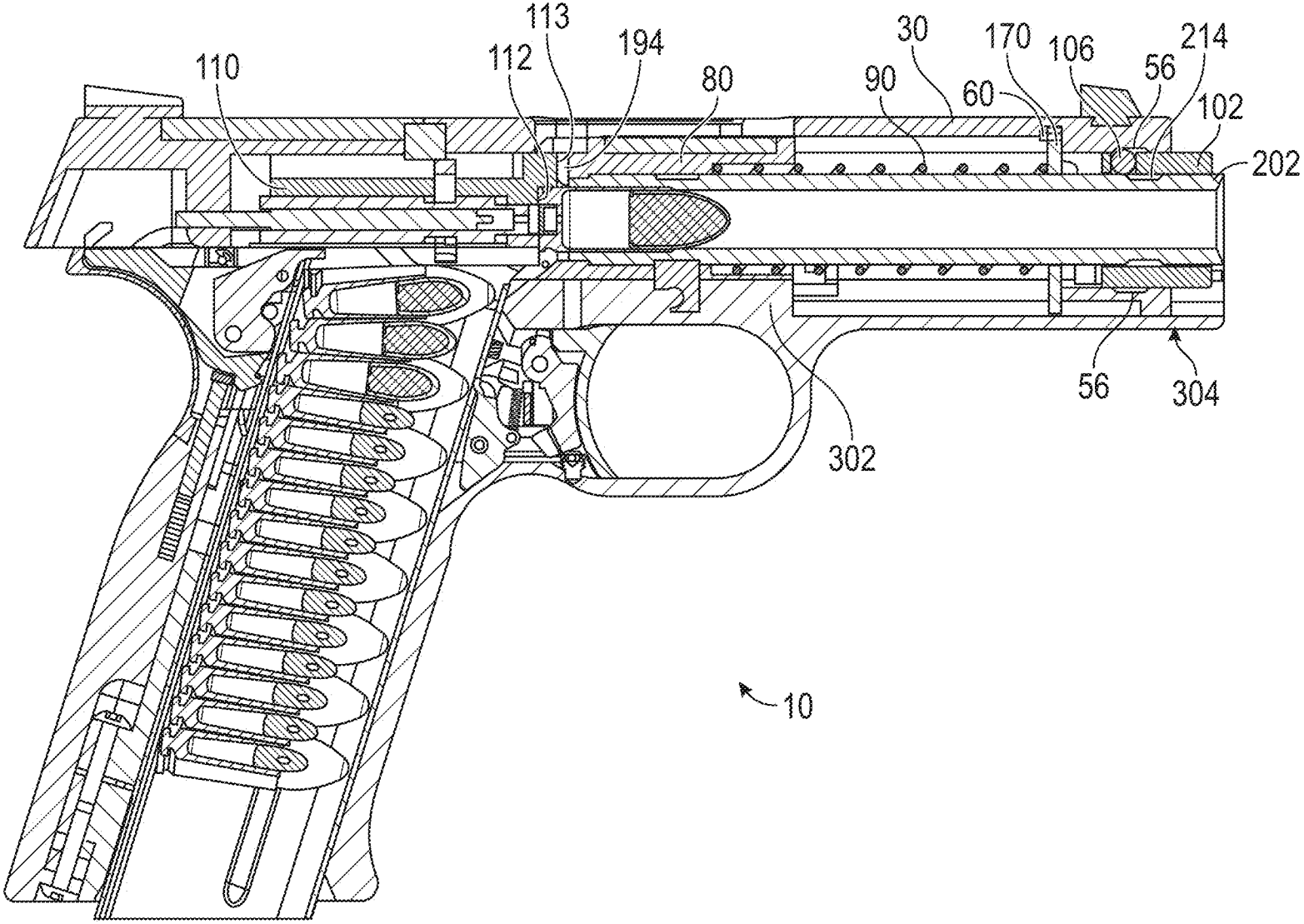
FIG. 15A is a right side-section view of the firearm in the late stage of going into battery.
Figure 15B:
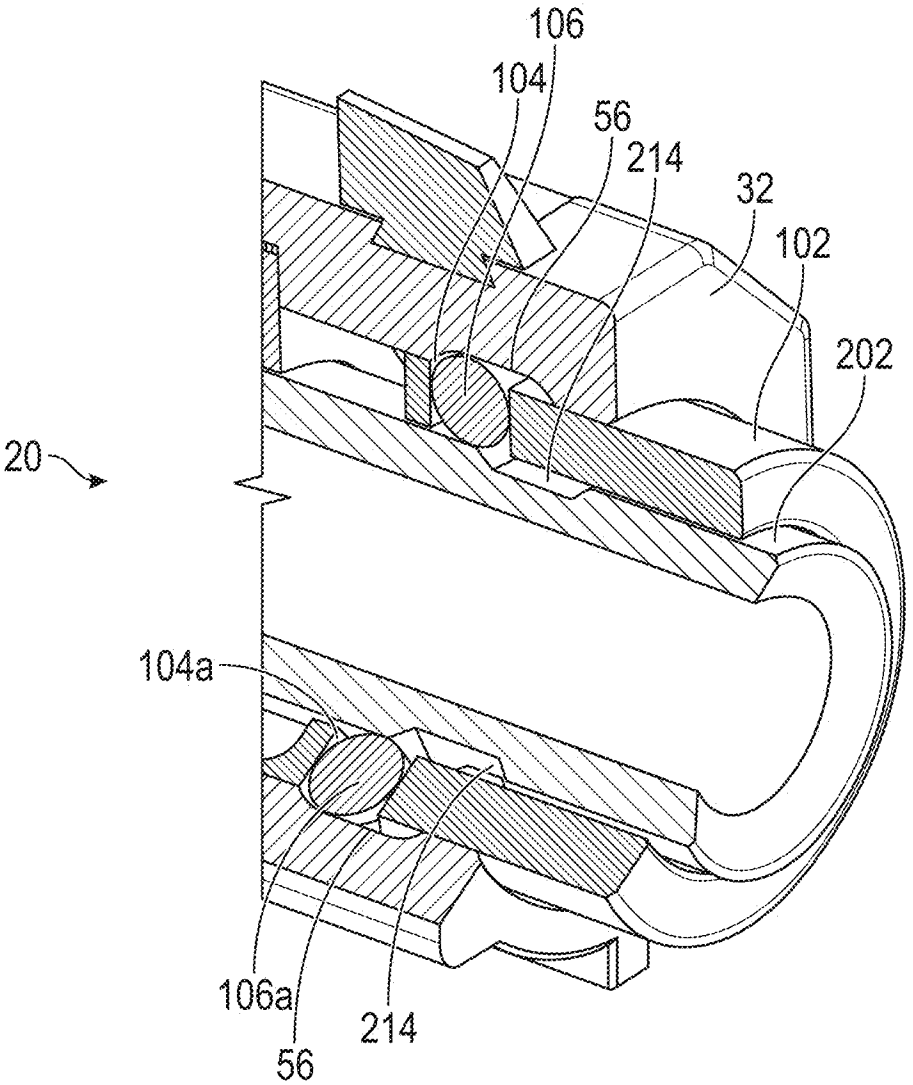
FIG. 15B is a selectively angled two-thirds section view of the forward end of the slide assembly in FIG. 15A.

FIG. 15A through FIG. 15B show the slide assembly 20 continuing to move forward. FIG. 15A is a side section view of the firearm 10. FIG. 15B shows a selectively angled two-thirds section view of the forward portion of the slide assembly 20 in FIG. 15A but shows two receptacles 104 and 104*a* containing two locking elements 106 and 106*a*.

The slide 30 continues to move forward due to the recoil spring 90 forcing the recoil spring retainer 170, which pushes on the slide due to being restricted within cutout 60. Any locking elements have reached the front barrel groove 214 but have not yet been forced into the barrel groove. The reciprocating block 100 has not yet reached a closed position where its face portion 110 would abut the barrel housing 80, as shown by gap 194 between the face portion above the breech face 112 and the barrel housing.

Figure 16A:
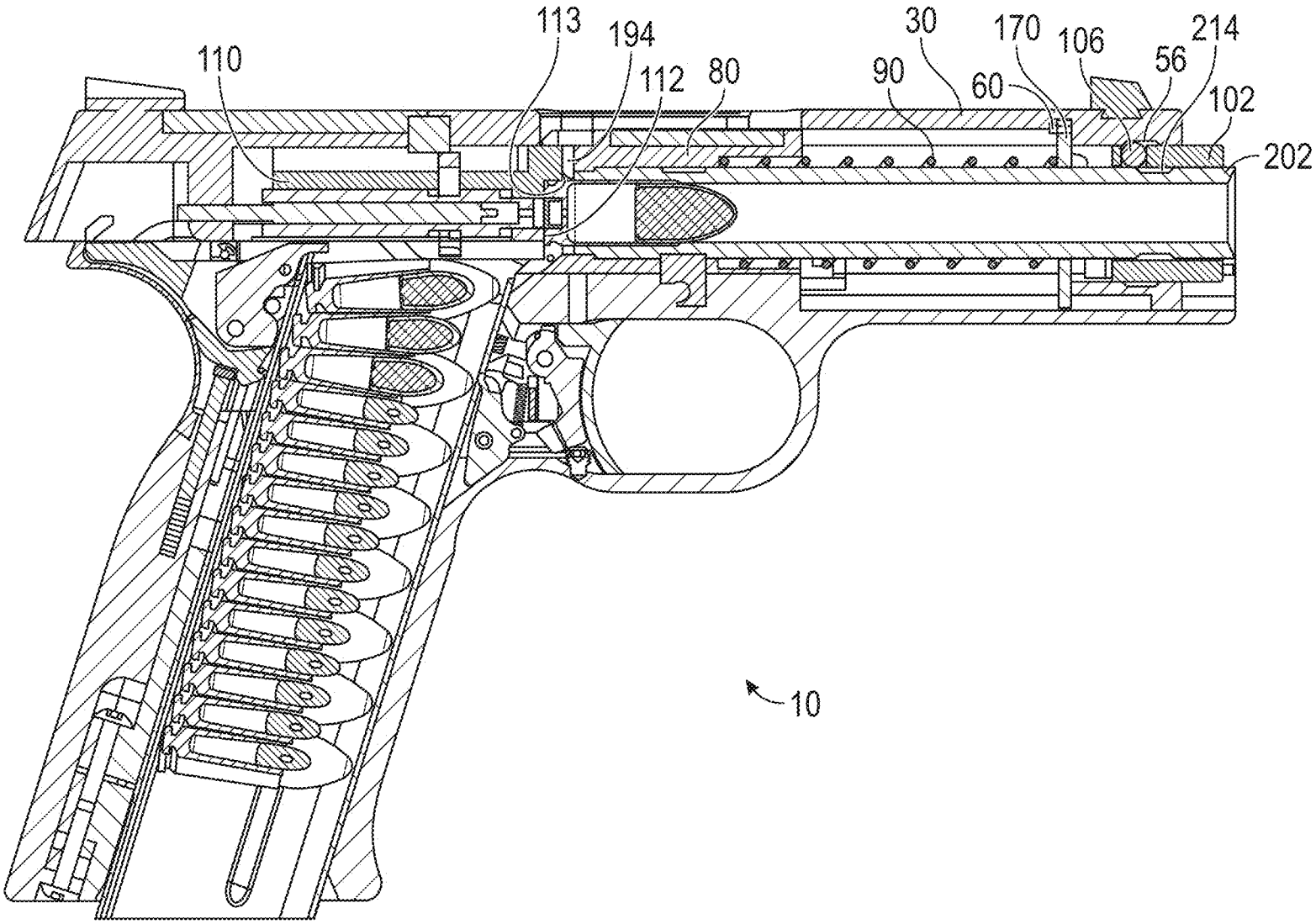
FIG. 16A is a right side section view of the firearm going into battery just prior to the lockup of the slide assembly.
Figure 16B:
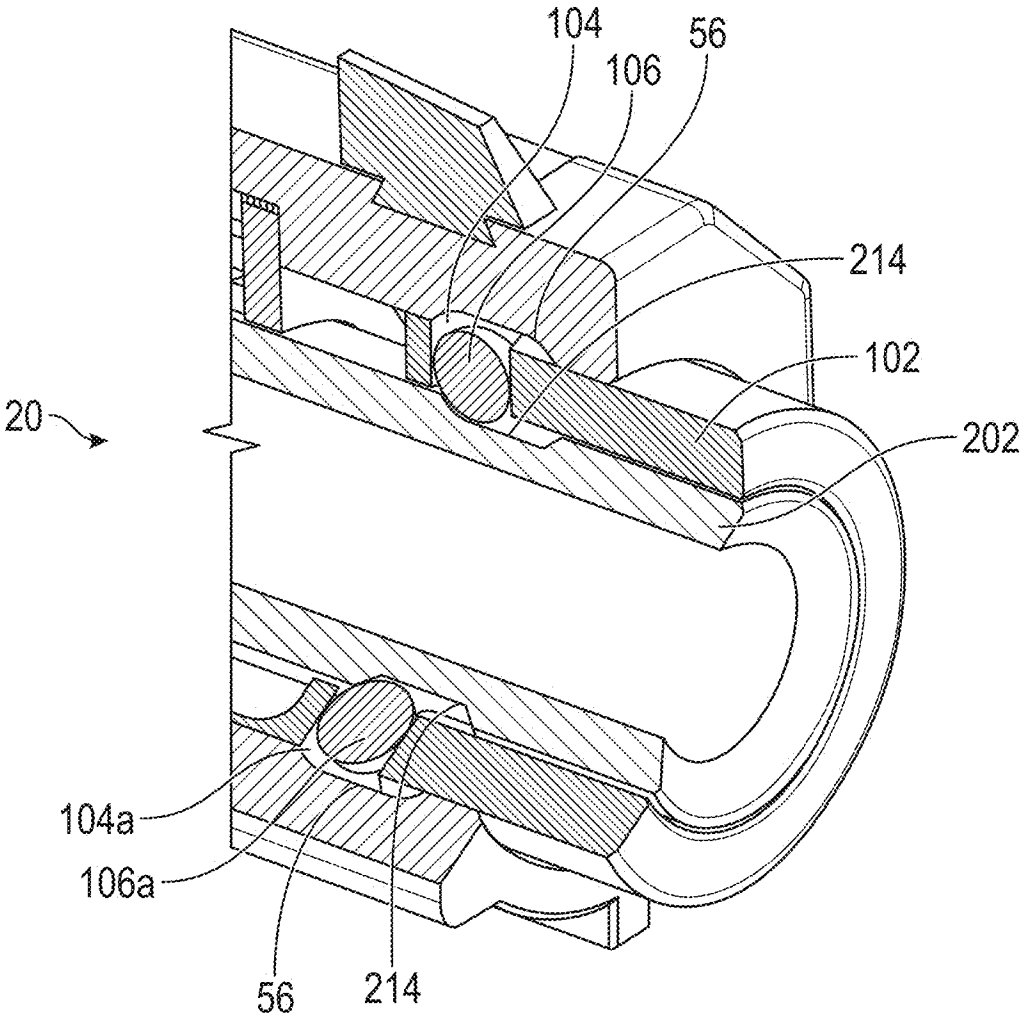
FIG. 16B is a selectively angled two-thirds section view of the forward end of the slide assembly in FIG. 16A.

FIG. 16A through FIG. 16B shows the slide 30 continuing to move forward due to the recoil spring 90 as described above. FIG. 16A is a side section view of the firearm. FIG. 16B shows a selectively angled two-thirds section view of the forward portion of the slide assembly 20 in FIG. 16A but shows two receptacles 104 and 104*a* containing two locking elements 106 and 106*a*.

At the forward end 32 of the slide 30, the slide groove 56 overlaps the front barrel groove 214, and any locking elements 106 are pushed into the barrel groove as they travel in their corresponding receptacle 104 as part of the locking element holder portion 102. The reciprocating block 100 has not yet reached a closed position where its face portion 110 would abut the barrel housing 80, as shown by gap 194 between the face portion above the breech face 112 and the barrel housing.

The slide 30 first diameter portion 54 biases any locking elements 106 into the front barrel groove. The piston 150 still moves forward due to the prior engagement with the piston retainer 140. The hammer still cannot travel forward because it is still held back by primary sear 420 rear tab 430. The slide has pushed the piston 150 and firing pin 152 into the ready-to-fire condition described in FIG. 9A and FIG. 9D. The front of the piston is flush with the breech face 112 of the reciprocating block 100 face portion 110. The reciprocating block is in its locked condition at the forward locking element holder portion 102. The fire control unit 400 parts are in the ready-to-fire condition described in FIG. 9D through FIG. 9I.

Figures 17A, 17B:
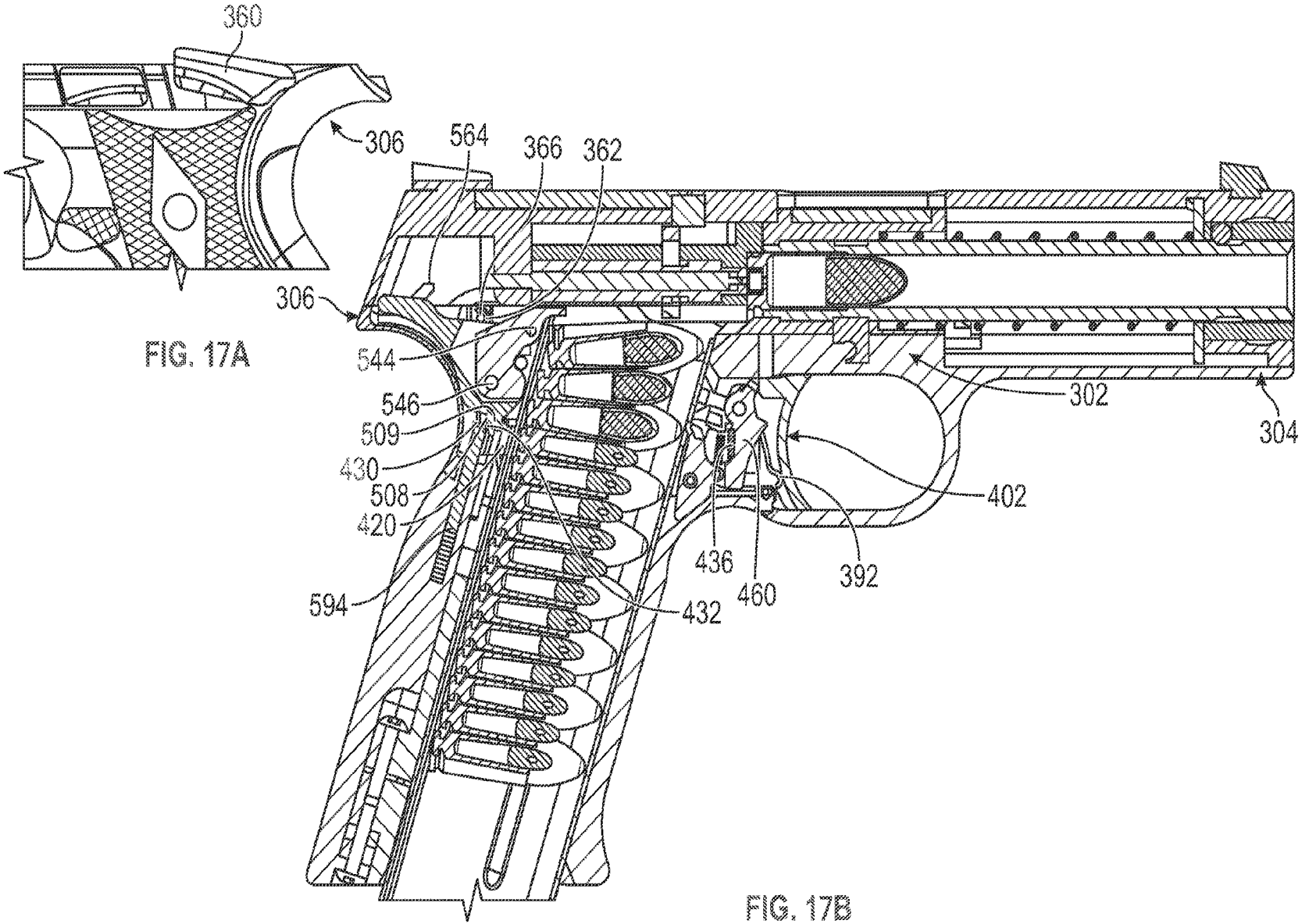
FIG. 17A is a left side view of the left safety selector actuator engaged.
FIG. 17B is a right-side section view of the firearm with the safety engaged.

FIGS. 17A through 17B show the function of the safety system. FIG. 17A shows the firearm in a ready-to-fire condition with the safety engaged. The left safety selector 360 is actuated upward, which causes the cylindrical lower boss 364 of the left selector to push upward into the hollow cylindrical lower boss 354 of the right selector. The upward motion of the selector raises the safety actuator pin 560, which pushes the safety bar 564 rearward.

This rearward displacement of the safety bar causes the hammer 502 to rotate slightly back. This rotation shifts hammer spring pressure off of the primary sear 420 and places it instead on the safety bar 564. With no longer any downward pressure from the hammer's ramp surface 507, the primary sear plunger 594, acting from the primary sear spring 592, pushes the primary sear tab 430 upward. This causes the primary sear nose 436 to be forced downward since the tab's upward motion lifts the rearward end of the sear. The nose 436 moves downward into contact with the top of the reset ramp 482 of the secondary sear 460, where its movement is arrested. This condition is shown in FIGS. 17A and 17B.

At this point, the engagement surface 432 of the primary sear is not contacting the hammer 502, as the hammer is being held back by the safety bar. The firearm cannot discharge in this state.

FIG. 17B is a corresponding side section view of the firearm 10, again showing the safety bar 564 in a rearward position and the hammer 502 slightly rotated back. The right and left safety selectors 350 and 360 include upper bosses that retain the selectors in from pulling outward via selector retainers 366. The hammer ramp 507 is no longer pressing against the engagement surface 432 of the primary sear tab.

If the user pulls the trigger the trigger shoe 402 pivots the secondary sear 460, rotating its lower engagement facility 476 forward and its upper engagement facility 470 backward. This motion allows the primary sear nose 436 to ride down the reset ramp 482. The engagement surface 432 of the primary sear then rises behind the hammer sear notch 508 as the rear tab 430 moves upward. This re-engagement ensures that even if the trigger shoe is pulled while the safety selector is disengaged, the gun will not fire. This is because the engagement surface 432 is behind the hammer sear notch 508, requiring the trigger shoe to be released to reset the system and enable firing upon subsequent trigger shoe pulls.

Figure 18A:
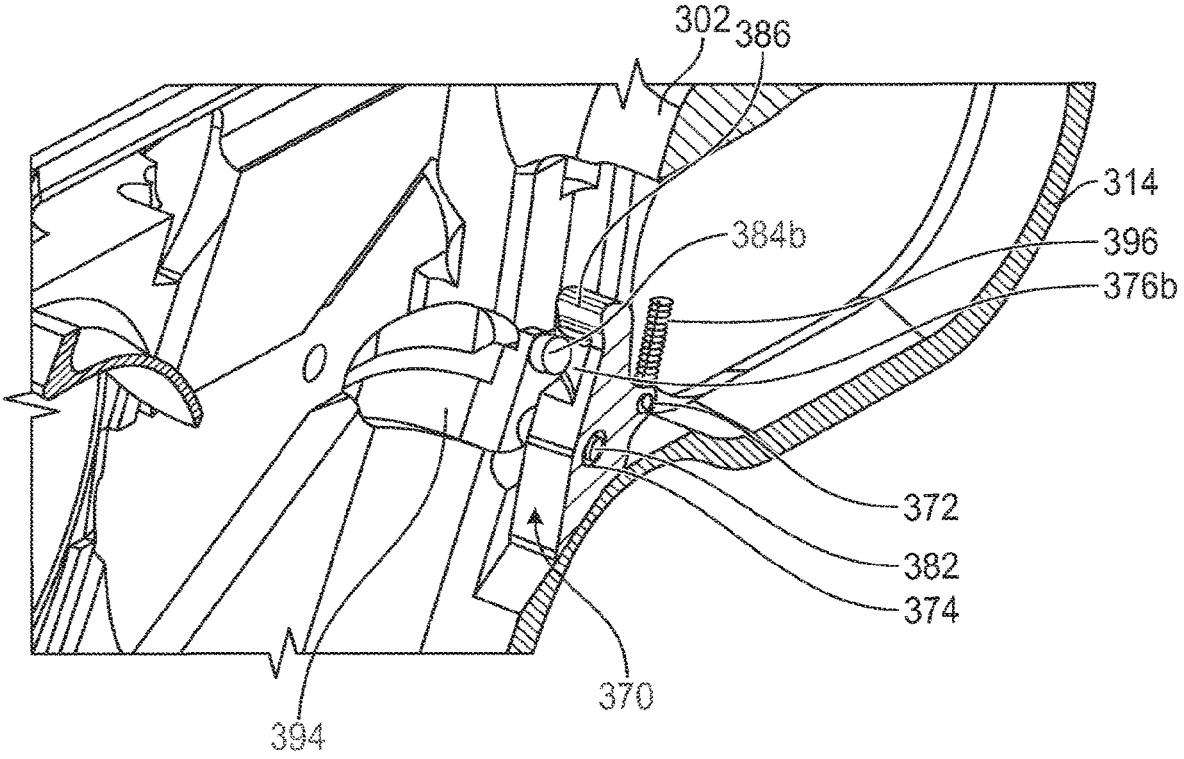
FIG. 18A is a selectively angled side section view showing the magazine release engaged.
Figure 18B:
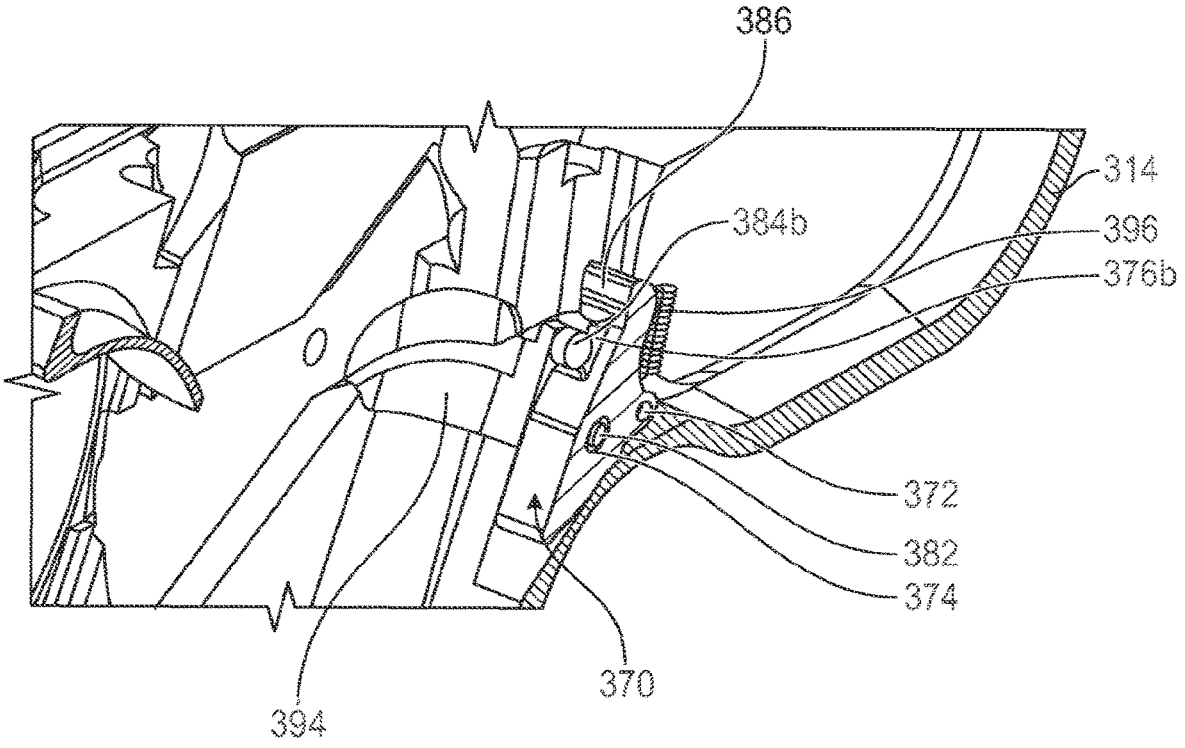
FIG. 18B is a selectively angled side section view showing the magazine release disengaged.

When the safety is disengaged the left selector 360 is rotated downward, which repositions the safety bar 564 forward. This forward movement allows the hammer 502 to rotate forward again. The hammer ramp 507 returns to contacting the primary sear engagement surface 432, which resumes its role in controlling hammer release. FIGS. 18A through 18B show the operation of the magazine catch 370 within the chassis 302. FIGS. 18A-B are selectively angled side section views showing the left magazine actuator 394 interfacing with the magazine catch. The actuator has a boss 382 within magazine catch pivot hole 374 and a rounded nub 384*b* adjacent to or abutting a left slope 376*b*. The forward magazine catch hole 372 controls the magazine release spring 396. FIG. 18B shows when the magazine release actuator is pressed into the chassis, the nub pivots the actuator causing the magazine catch ledge 386 forward to release a magazine (not pictured here) retained by its magazine catch hole 640. The ledge is biased rearwards to return to the original condition.

A central inward-facing tab 98 is located at the apex of the horseshoe arch and rides in the top channel 134 of the reciprocating block, preventing independent rotation of the block. The spring-loaded piston retainer 140 biases upward and rides along the bottom surface of tab 98.

To disassemble the reciprocating block from the slide, the user must first remove the slide from the grip module. Then, by pulling downward on the horseshoe's outward-facing tabs 92*a* and 92*b*, the user compresses the internal springs 146 and lowers the inward-facing tabs beneath the bottom edge of the block cutout 114. Since the cutout is open at the bottom, this permits disengagement of the block from the horseshoe and slide.

In embodiments previously mentioned and further embodiments, the fire control system may contain a hammer, a tooth which has a notch (or catch feature) and a ramp feature. These features on the tooth are designed to interact with an engagement surface or edge of an engagement element which prevents the hammer from rotating to fire by way of a separate interfering element. The engagement surface or edge may be part of a component functionally equivalent to what has been described above as the primary sear, and the interfering element may correspond to what has been referred to as the secondary sear. The interfering element blocks movement of the engagement element or the tooth, thereby mechanically preventing the hammer from rotating forward until the interference is removed by actuation of the trigger. In various embodiments, functions attributed to the engagement surface of the primary sear tab or the geometry of the hammer tooth may be performed by other features or structures with analogous mechanical roles.

In further embodiments, the function of the secondary sear may be accomplished by a trigger bar in which one face, such as the rear-most face of the trigger bar, would act as the reset ramp, and another face, such as the bottom face of the trigger bar, would act as the sear ledge of the interfering element. The trigger bar can also act as a counterbalance in alternate embodiments, similar to the interfering element. Furthermore, in alternate embodiments, the engagement element may be housed by different components, such as the hammer housing or the hammer itself. In some embodiments, the function of the hammer bottom ramp and hammer notch may be accomplished by other components such as the engagement element. In some embodiments, the function of the engagement surface of the rearward tab on the engagement element can be accomplished by other components.

In further embodiments of the firearm, the fire control mechanism may include a hammer with a tooth element, an engagement element, and an interfering element. In this system, firing is prevented by a mechanical interference that is removed by movement of the trigger. The system includes a hammer configured to rotate about a pivot axis and strike a firing pin. A tooth, either integrally formed with or movably attached to the hammer, includes a notch and a ramped surface. An engagement element interfaces with the tooth, engaging the notch during the cocking cycle and transitioning to rest on the ramped surface when reset. An interfering element blocks motion of the engagement element (or in some embodiments the tooth), thereby preventing hammer rotation until removed by trigger actuation.

In the variation of the fire control mechanism described in the primary embodiment, the engagement element is referred to as the primary sear and is configured to slide or pivot relative to the hammer tooth. The interfering element, referred to as the secondary sear, prevents the engagement element from sliding along the ramped surface of the tooth. Pulling the trigger rotates or otherwise actuates the interfering element, removing the interference and allowing the engagement element to release the hammer. This variation allows the fire control to be reset by trigger release, placing the engagement element on the ramp surface, with the hammer held in a ready condition.

In an alternative variation, the tooth is pivotally mounted to the hammer, and the engagement element is fixed or effectively fixed during the trigger pull and hammer release sequence. In this embodiment, the tooth pivots about a pin within the hammer body and includes the same notch and ramp surface geometry. The engagement element is positioned to engage the notch during cocking, and the tooth rotates such that the engagement element rests on the ramp when the system is reset. An interfering element prevents the tooth from rotating until displaced by trigger actuation, at which point the tooth is free to rotate and allow hammer release. This configuration inverts the movement responsibilities between the engagement element and the tooth, while maintaining the same functional principles and timing.

In further embodiments, the tooth may be mounted to the hammer and permitted to translate axially rather than pivotally. The axial movement may occur along a channel or guide and may involve spring biasing or other return features. The engagement element, in this configuration, remains stationary or moves only minimally, while the axial motion of the tooth engages or disengages it from a blocking condition controlled by the interfering element. The interfering element in these cases may prevent axial translation until the trigger is actuated.

All variations share the common characteristic that a physical interference—distinct from traditional sear-only mechanisms—prevents firing, and that this interference is removed intentionally by the movement of the trigger. In contrast to conventional two-stage triggers where the trigger initially moves freely before contacting the sear, these systems begin interacting with the interfering element as part of the primary trigger motion. The presence of an engagement element introduces an intermediate control relationship not typical of standard single-stage triggers. This mechanical blocking approach allows for increased safety, clear reset behavior, and a trigger feel that does not involve gradually increasing resistance as the trigger interfaces with the sear.

These alternative embodiments further support the robustness and versatility of the described fire control concept and enable its application across a range of mechanical layouts and user preferences, without departing from the core innovation of interference removal initiated directly by trigger motion through a distinct engagement element.

In a secondary embodiment of the fire control system, the tooth 816 is pivotally mounted to the hammer 502, while the engagement element remains fixed during the trigger pull sequence. The mechanism includes features designed to interact with slide 30 motion to control timing and enable reset and disconnection.

After firing or dry firing, the hammer 502 is in a forward, fired position and its strike face 504 is in contact with the firing pin 152. As the slide 30 moves rearward—either due to recoil or manual cycling—the hammer 502 is cammed rearward into a cocked position. During this motion, specific geometry in the slide 30 interacts with the trigger bar 810 and engagement components to produce the appropriate timing for reset and disconnection.

Figure 19B:
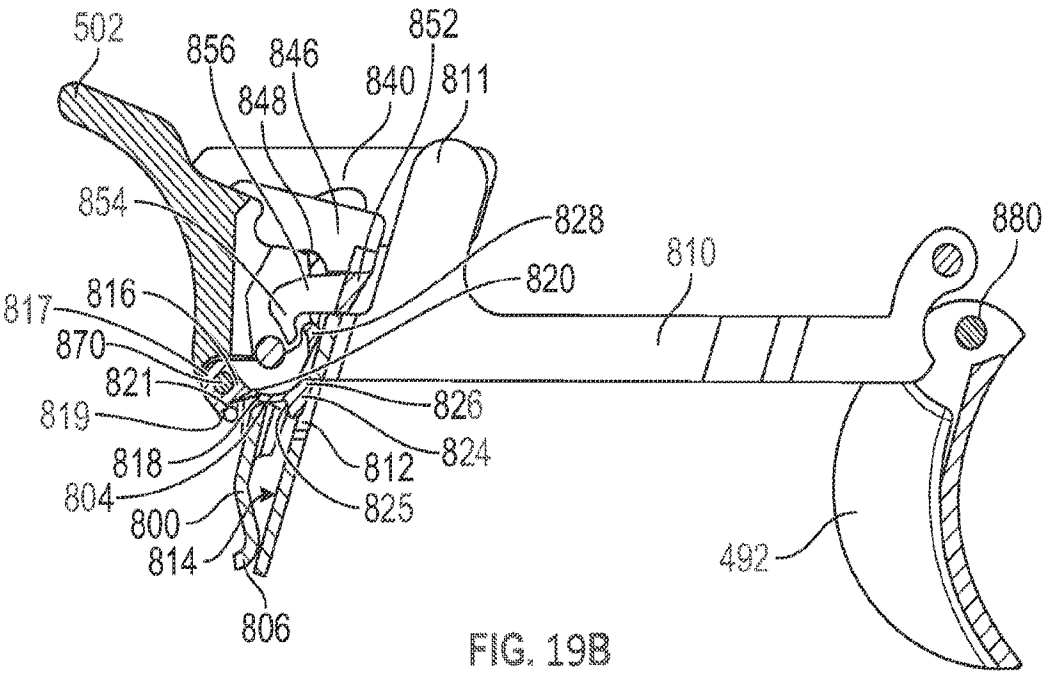
FIG. 19B is a sectional view of the same components as in FIG. 19A, with part features identified.
Figure 19C:
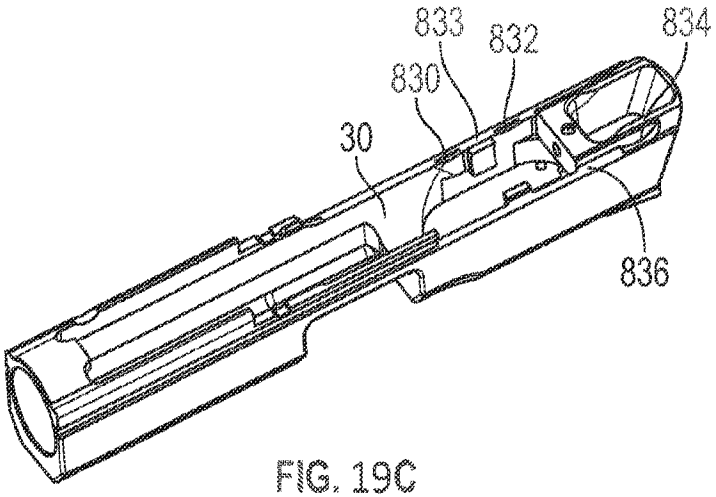
FIG. 19C is a selectively angled view of the underside of the slide, showing the front trigger bar cutout, rear trigger bar cutout, rocker cutout, and the unrelieved surfaces.
Figure 19A:
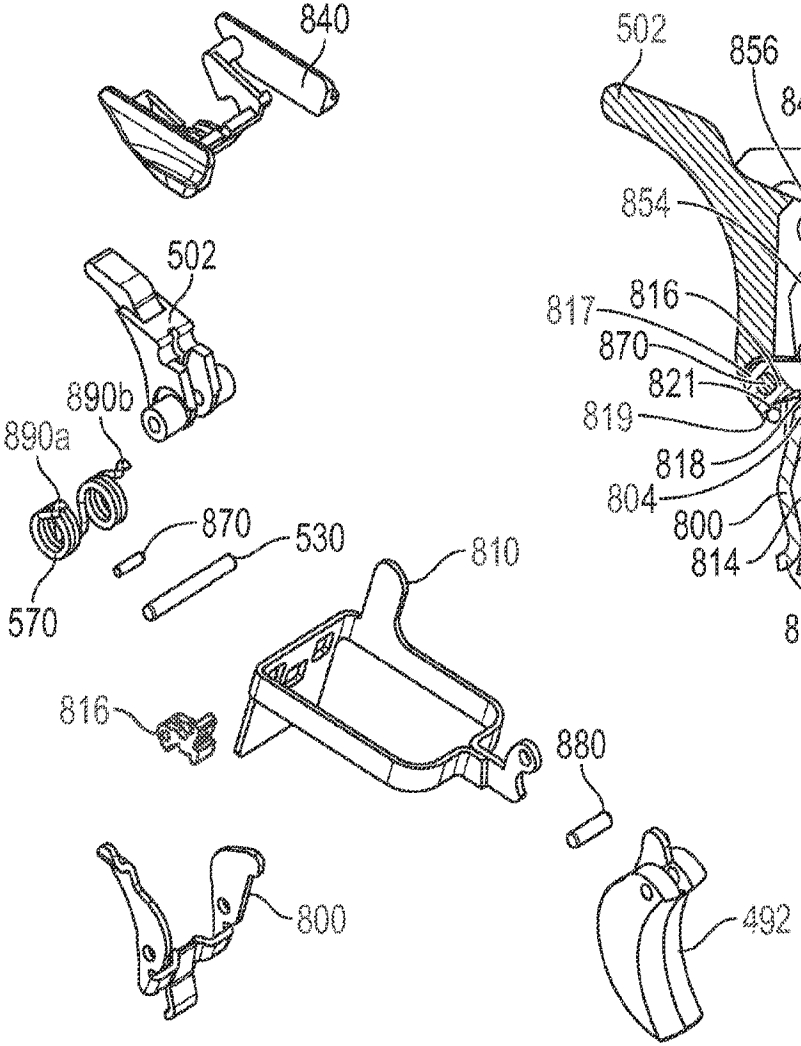
FIG. 19A is an isometric exploded view of the fire control system components, including the trigger spring, trigger pivot pin, trigger bar, tooth, rocker, hammer pin, tooth pin, hammer spring, safety selector, and hammer.

The slide 30 includes two cutouts on the underside of the left side, referred to as the front trigger bar cutout 830 and the rear trigger bar cutout 832 shown in FIG. 19C. These cutouts are analogous to those found in conventional designs where tabs on trigger bars or disconnectors rise into recesses in the slide. In this embodiment, a trigger bar tab 811 on the trigger bar 810 shown in FIG. 21B is positioned on the left side of the firearm and is biased upward such that it rises into these cutouts when aligned. As the slide 30 moves rearward or forward, the cutouts 830 and 832 shift position with the slide 30, eventually presenting an unrelieved surface 833 that pushes the tab 811 downward, influencing the timing and motion of the interfering element.

Figure 20B:
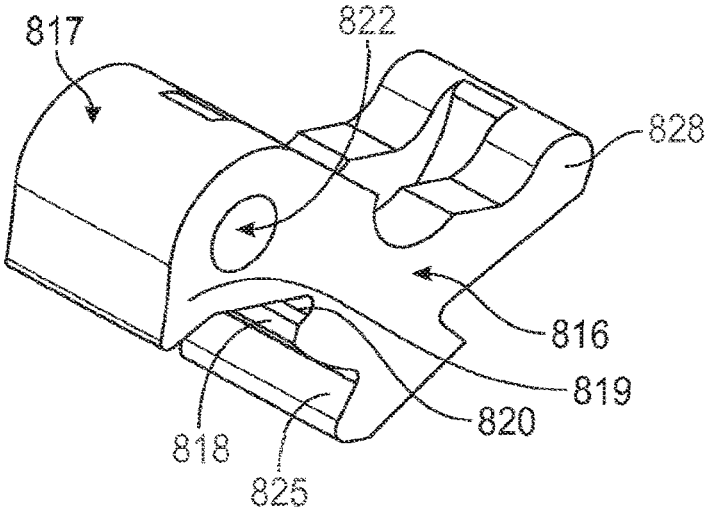
FIGS. 20B and 20C are selectively angled views of the tooth, each showing the same labeled features from different perspectives.
Figure 20A:
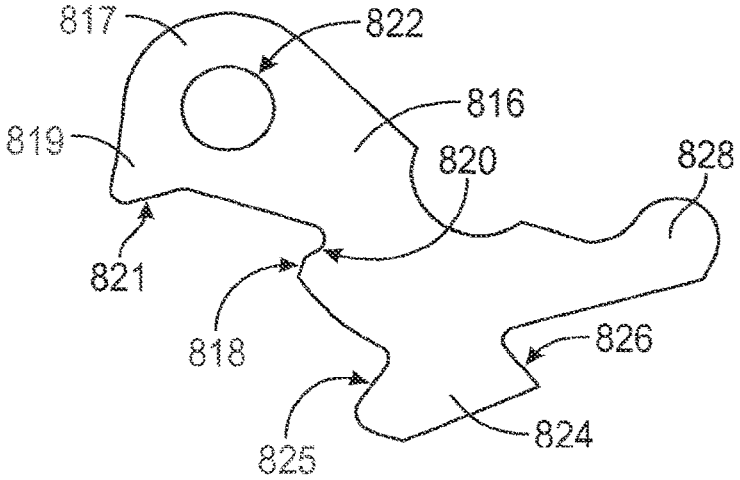
FIG. 20A is a right-side view of the tooth with labels identifying the notch, ramp, head, foot, heel, tail, beak, lower beak, pivot hole, and top of the foot. *For most components in this specification, directional terms such as "front," "rear," "top," and "bottom" are used relative to the firearm's orientation. However, the tooth 816 has a bird-like shape, and its features are described according to that shape rather than the firearm's geometry. For example, the "top of the tail" refers to the top of the bird's tail as it would appear on a standing bird, regardless of its position in the assembly; the "heel" is the rear of the foot; and the "lower beak" refers to the underside of the beak. This convention is used consistently when describing features of the tooth across figures and text.
Figure 21C:
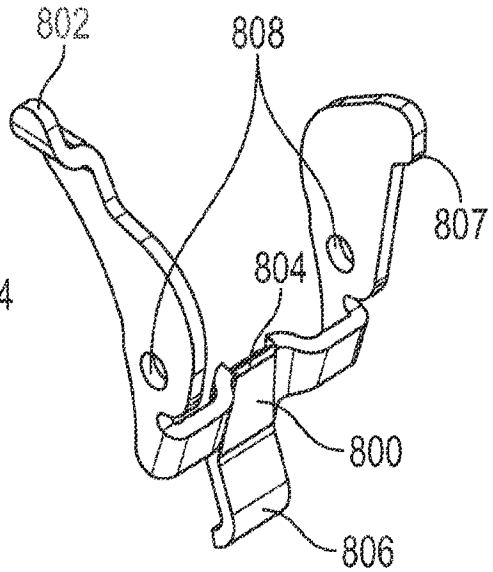
FIG. 21C is a selectively angled view of the rocker, showing the rocker tab, engagement surface, tail, selector contact surface, and pivot hole.
Figure 21B:
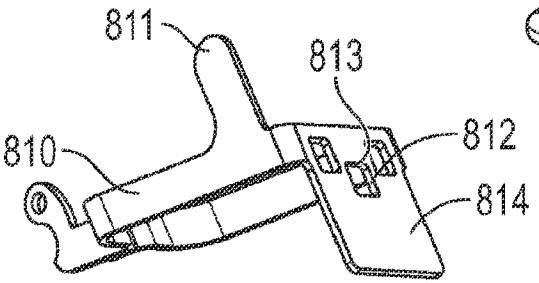
FIG. 21B is a selectively angled view of the trigger bar, showing the tab, central window cut, underside of the window, and rear face.

The engagement element in this embodiment is a component referred to as the rocker 800 shown in FIG. 21C. The rocker 800 contains the engagement surface 804 and is responsible for interacting with the hammer-mounted tooth 816 shown in FIGS. 20A, 20B and 20E. The rocker 800 pivots about the same pin 530 as the hammer 502, and its motion is governed by slide 30 position and safety selector 840 input. On its right side, the rocker 800 includes an upward-projecting rocker tab 802 shown in FIG. 21C located above and rearward of the hammer pivot pin 530. This tab 802 interfaces with a cutout 834 shown in FIG. 19C on the underside of the right side of the slide 30, referred to as the rocker cutout 834. When aligned with the rocker tab 802, the rocker cutout 834 allows the tab 802 to rise into it. As the slide 30 continues moving, the cutout 834 shifts and is replaced by a solid slide surface 836 shown in FIG. 19C that depresses the rocker tab 802, producing timed rotational displacement of the rocker 800. This displacement allows the engagement surface 804 of the rocker to transition between a rocked-back and a rocked-forward position.

Figure 20C:
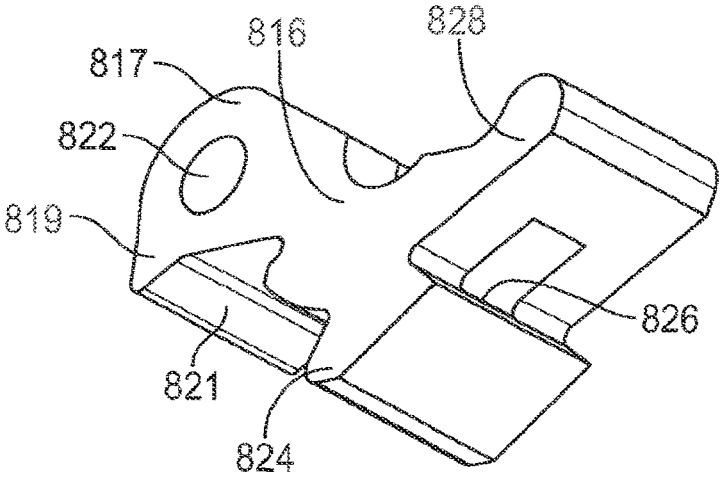

FIGS. 20A, 20B and 20C show the hammer-mounted tooth 816 that pivots relative to the hammer 502 and includes a notch 820 and a ramp surface 818. The tooth 816 is approximately bird-shaped, with the notch 820 and ramp 818 located in the area corresponding to the bird's crop. It pivots about a hole corresponding to the bird's eye 822, in which the pin 870 connecting the hammer 502 to the tooth 818 resides. The head 817 is positioned rearward of its foot 824 in all conditions when assembled. When the hammer 502 is in the fired position, the foot 824 is oriented slightly downward. As the hammer 502 is cocked, the foot 824 rises relative to the hammer pin 530, causing the beak 819 to point more downward. The hairpin section of the double torsion hammer spring 576, located between the two coils, bears against the underside 821 of the beak 819 to bias the hammer 502 toward the fired position and simultaneously bias the tooth 816 to rotate such that the foot 824 moves away from the hammer's pivot pin 530.

In this embodiment, the hammer 502 and tooth 816 share a common spring, with both components receiving torque from the same source. However, the spring's moment arm acting on the hammer 502 is significantly longer than that acting on the tooth 816, resulting in the hammer experiencing much greater rotational force. Although the spring biases the tooth 816 outward from the hammer, this outward force is comparatively weak. As a result, when the rocker 800 is in its rocked-forward position and the engagement surface 804 contacts the ramp surface 818 of the tooth, the stronger rotational force acting on the hammer overcomes the outward bias on the tooth. This causes the rocker engagement surface 804 to ride along the ramp 818, rotating the tooth 816 inward toward the hammer until the ramp terminates, at which point the hammer is released to strike the firing pin.

In this embodiment, a trigger 494 exists rather than a trigger actuator/trigger shoe assembly as one prior embodiment discusses or just a trigger shoe with no separate trigger actuator part as another embodiment discusses.

As the hammer 502 is cocked by the rearward motion of the slide 30, the notch 820 of the tooth 816 drops over the engagement surface 804 of the rocker 800, thereby restraining the hammer 502 in the cocked condition. Upon subsequent forward movement of the slide 30 and trigger 494 reset, the rocker 800 transitions such that the engagement surface 804 is now resting on the ramp surface 818 of the tooth 816.

In this embodiment, the interfering element is the trigger bar 810 shown in FIG. 21B. The interference condition is formed between the underside 813 of the top surface of the central window cut 812 in the trigger bar 810 and the heel 826 of the foot 824 of the bird-shaped tooth 816. The heel 826 must rise in order to slide up the stationary engagement surface 804 along the ramp 818 and initiate hammer release, but the trigger bar 810—biased rearward by the trigger spring 490—is positioned such that it braces against the underside of a feature on the hammer housing 520, or, in some cases, against the relieved surface of the rear trigger bar cutout 832 if it is not deeply recessed. This setup creates a mechanical block since the trigger bar 810 is effectively limited to forward and backward motion, while the tooth 816 must move along a path with a vertical component to release the hammer 502. As the trigger 494 is pulled, the trigger bar 810—mounted above the pivot axis 880 of the trigger 494—moves forward. This forward movement of the underside of the top surface of the central window 812 allows the heel 826 of the bird-shaped tooth 816 to rise and clear the interference, thereby enabling the tooth 816 to rotate and release the hammer 502.

When the rocker 800 is in the rocked-back position, even if the hammer 502 were to begin rotating forward, the top 825 of the foot 824 of the bird-shaped tooth 816 would contact the front face of the rocker 800 just below the engagement surface 804, preventing the hammer 502 from striking the firing pin 152. This blocking effect is also observed when the safety selector 840 is rotated upward into the "safe" position after dry firing. In that condition, with the hammer 502 initially resting on the firing pin 152, the top of the foot 824 of the tooth 816 rotates downward due to the motion of the rocker 800, causing the hammer 502 and rocker 800 to rotate rearward together. This coordinated movement creates a gap between the strike face 504 of the hammer 502 and the firing pin 152, effectively rendering the hammer 502 inert.

Because the rocker 800 is forced into its rocked-back position when the slide 30 is slightly opened, it serves an additional function as an out-of-battery safety. In this position, the rocker 800 does not prevent the tooth 816 from releasing the hammer 502, but rather prevents the hammer 502 from fully rotating. If the hammer 502 were to begin rotating forward, the top of the foot 824 of the tooth 816 would strike the front face of the rocker 800 just below the engagement surface 804, preventing the hammer 502 from reaching the firing pin 152. This limits forward travel and ensures that the hammer 502 cannot make contact even if unintentionally released while the rocker 800 is rocked back.

To reach the ready-to-fire condition and reset the system, the trigger 494 must be released. Releasing the trigger 494 causes the trigger bar 810 to travel rearward, bringing the lower portion of its rear face 814 into contact with a downward-extending tail 806 on the rocker 800 located below the engagement surface 804. When the rocker 800 is rocked back—whether due to the slide 30 opening or engagement of the safety selector 840—the tail 806 on the rocker 800 makes contact with the rear face 814 of the trigger bar 810 so long as the trigger 494 is not actively being pulled, or unless the rocker 800 is in an intermediate state in which a portion of the tooth 816 (such as the bottom of the foot 824 or bottom of the tail 828) is limiting the rearward motion of the trigger bar 810. This interaction between the tail 806 and the trigger bar 810 pushes the trigger bar 810 forward. Once the rocker 800 returns to its forward position, the rear face 814 of the trigger bar 810 then contacts the bottom of the tail 828 of the bird-shaped tooth 816. This interaction is analogous to the reset ramp of the primary embodiment. The notch 820 of the tooth 816 is pushed up and back by the trigger bar 810, lifting it off the engagement surface 804 and transitioning it onto the ramped surface 818 of the rocker 800. The tooth 816 is biased to continue this motion by its spring loading. However, as the trigger bar 810 moves rearward, the underside of the top surface of the central window cut 812 also moves into position to interfere with the heel 826 of the foot 824 once again, completing the reset while preserving the blocking condition until the next trigger pull.

The rocker 800 itself is formed from a single piece of sheet metal that is bent and shaped to define the required features. The sheet metal defines a hole 808 for the hammer pin 530, which serves as the pivot axis for the rocker 800. On the right side, the sheet metal takes a jog upward and outward, terminating in a rounded protrusion with a radiused top that defines the rocker tab 802. Below the pivot axis, the sheet metal bends inward at 90 degrees on both sides, and the bent portions converge toward the center of the rocker 800. In the central region, a precision-cut surface defines the engagement surface 804, and directly below this surface, an integral tail 806 extends downward. This tail 806 interacts with the trigger bar 810 during the reset sequence and may also serve as part of the rocker's blocking function.

Figure 21A:
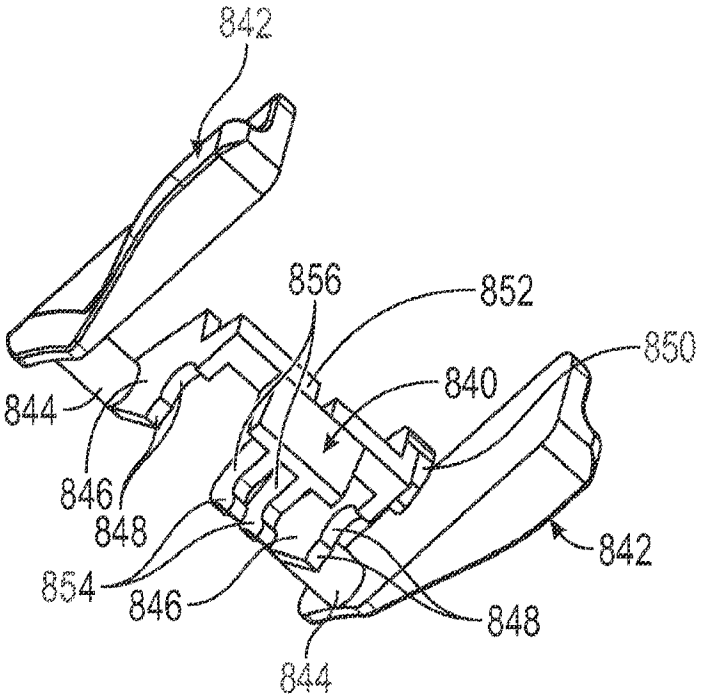
FIG. 21A is a selectively angled view of the safety selector, showing features including control surfaces, pivot bosses, forward-extending portions, detent notches, outboard boss, selector bridge, rearward-extending selector arm, and hooked finger.

Shown in FIG. 21A, this embodiment also features a unified safety selector 840 that services both sides of the firearm. Each side includes an outwardly facing control surface 842*a* and 842*b*, enabling ambidextrous operation by the user. Extending inboard from each control surface 842*a* and 842*b* is a cylindrical boss 844, which acts as the pivot axis for the selector mechanism.

From each cylindrical boss 844, a forward-extending feature 846 continues inboard along the firearm. Each of these forward-extending arms includes two semicircular detent notches 848—an upper notch and a lower notch. The upper notch serves to retain the selector 840 in the downward "fire" position, while the lower notch retains it in the upward "safe" position. These detents 848 interface with the curled tips 890*a* and 890*b* of the hammer spring legs 572 and 574, providing both tactile feedback and mechanical retention in each selector position.

Additionally, the forward-extending portion 846 on the left side of the selector 840 includes an outboard protruding boss 850. This boss 850 is shaped and positioned to mechanically interface with the rocker selector contact surface 807. When the selector 840 is rotated upward into the "safe" position, this outboard boss 850 engages a surface on the rocker 800 and rotates it into its rocked-back position.

Between the left and right selector structures is a rigid bridge 852 that couples both sides of the safety selector 840.

At the center of this bridge 852 is an arm 856 that extends rearward and terminates in a hooked finger 854. When the safety selector 840 is in the "safe" position and the fire control system is cocked and reset, the rearward outer portion of this hooked finger 854 is positioned near the pivot pin 530 of the hammer 502, while the upper portion of the bird-shaped tooth's tail 828 resides within the interior region of the hook without engaging it. In this configuration, the hook 854 remains clear of the tail 828, preserving mechanical separation until the hook is rotated further or re-engaged.

Figure 22A:
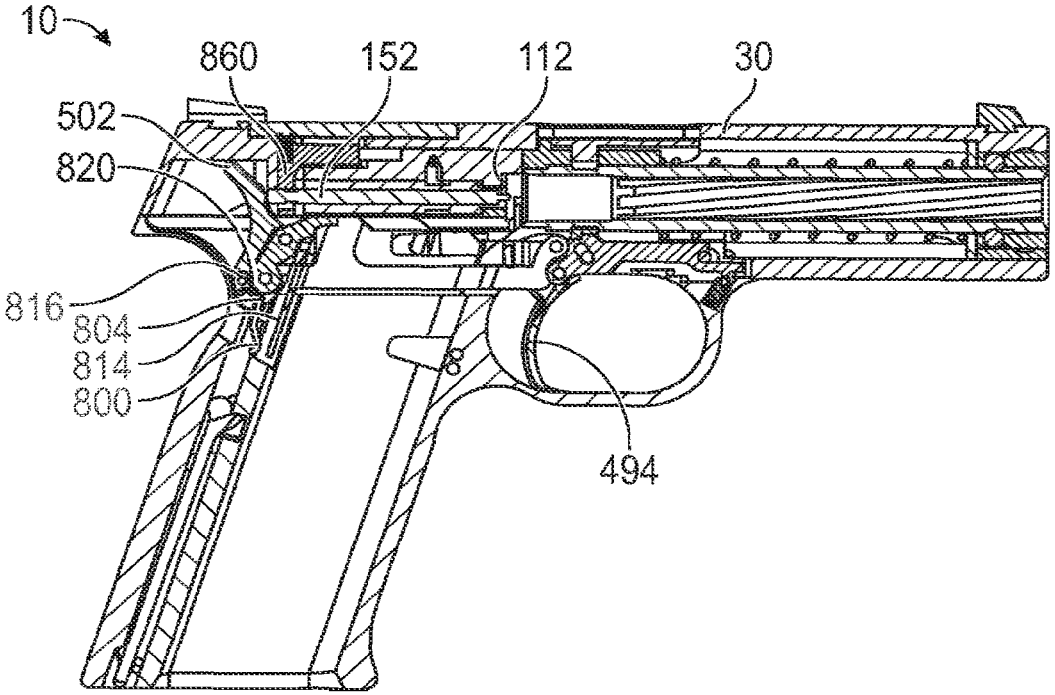
FIG. 22A is a sectional view of the firearm in battery with the hammer in the fired position and the trigger held to the rear. The rocker and tooth are shown prior to engagement, with the notch of the tooth positioned above and to the rear of the rocker engagement surface. The ramp surface is visible, and the trigger bar is shown forward and clear of the rocker and tooth. The firing pin retainer, which is mechanically linked to the slide, is shown in its forward position and not actively retracting the firing pin in this view.
Figure 22B:
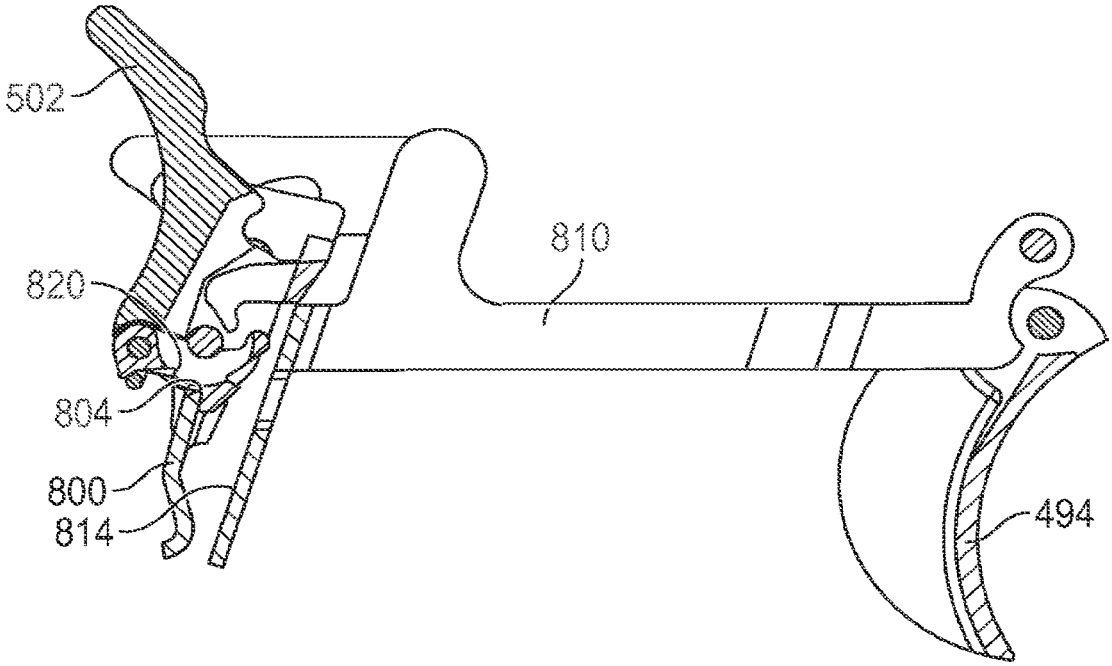
FIG. 22B is a magnified sectional view of the fire control components shown in FIG. 22A, with non-fire control elements removed. The hammer is in the fired position, and the rocker and tooth are shown prior to engagement. The notch of the tooth is positioned above and to the rear of the rocker engagement surface, and the trigger bar is forward and clear of the rocker and tooth.

In this second embodiment, the slide is cycled with the hammer in the fired position and trigger pulled. If the slide 30 is cycled starting with the hammer 502 is in the fired position and the trigger 494 remains pulled (shown in FIG. 22A, 22B), the rocker 800 is rocked back by the motion of the slide 30 forcing the rocker tab 802 out of the rocker cutout 834 in the slide (shown in FIGS. 23A and 23B) and then rocked forward again as the slide 30 returns to battery. The trigger bar 810, which is mechanically linked to the trigger 494, does not move rearward during this cycle, thereby keeping it clear of moving parts such as the rocker 800 and the tooth 816. As the hammer 502 is cocked by the rearward motion of the slide 30, the notch 820 of the tooth 816 drops over the engagement surface 804 of the rocker 800 shown in FIGS. 24A and 24B), thereby restraining the hammer 502 in the cocked condition. Upon subsequent forward movement of the slide 30 and trigger reset, the rocker 800 transitions such that the engagement surface 804 is now resting on the ramp surface 818 of the tooth 816.

Figure 25A:
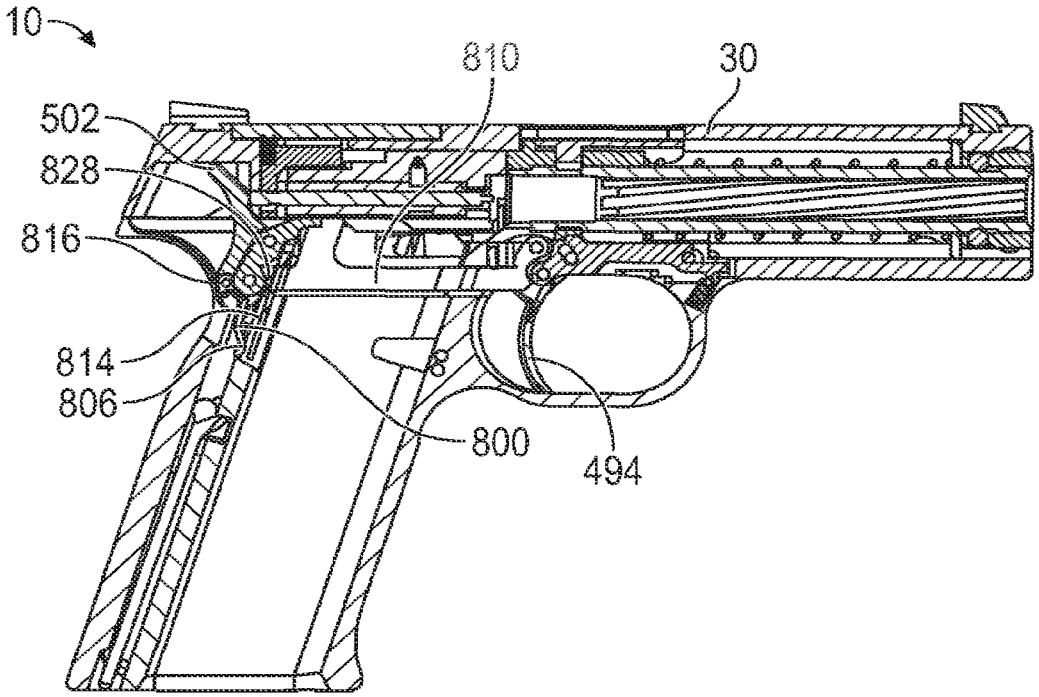
FIG. 25A is a sectional view of the firearm with the slide in battery, the hammer in the fired position, and the trigger released. The trigger bar is slightly rearward, as it is spring biased (spring not shown) in both the rearward and upward directions. Its rear face rests against the underside of the tooth tail, preventing the trigger from fully returning. The rocker is shown in the forward position, with its tail spaced from the trigger bar. The tooth is positioned above the rocker.
Figure 25B:
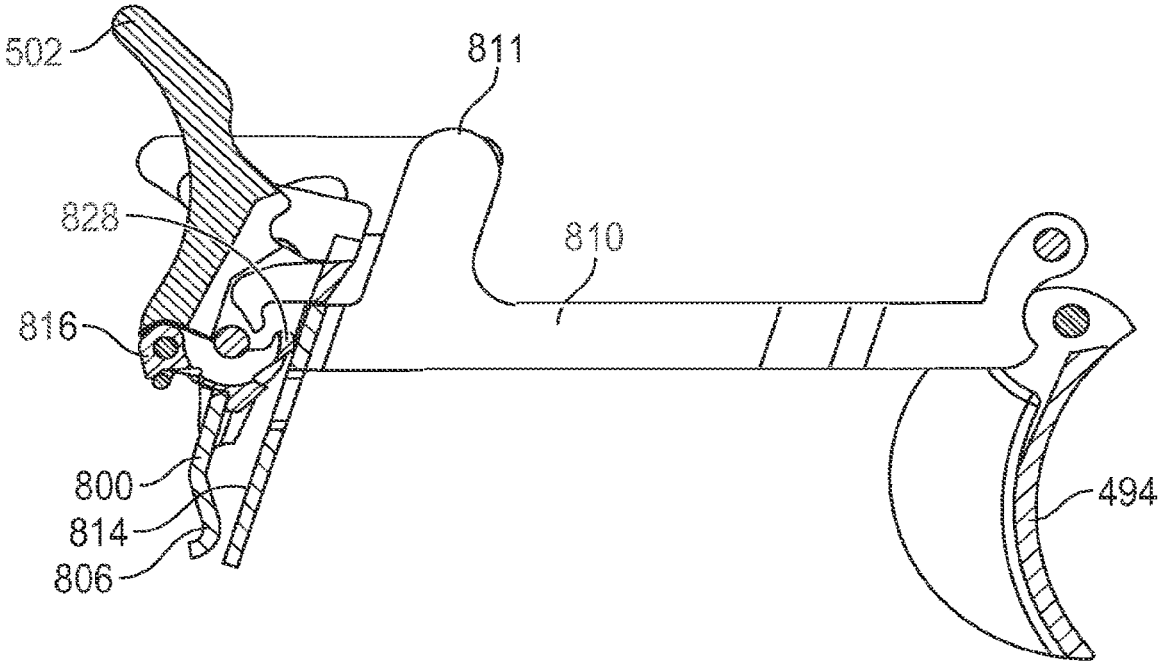
FIG. 25B is a magnified sectional view of the fire control components, showing the hammer in the fired position and the trigger released. The trigger bar is slightly rearward, with its rear face resting against the underside of the tooth tail, preventing the trigger from fully returning. The rocker is shown forward, with its tail spaced from the trigger bar. The trigger bar tab is visible in this view.
Figure 26A:
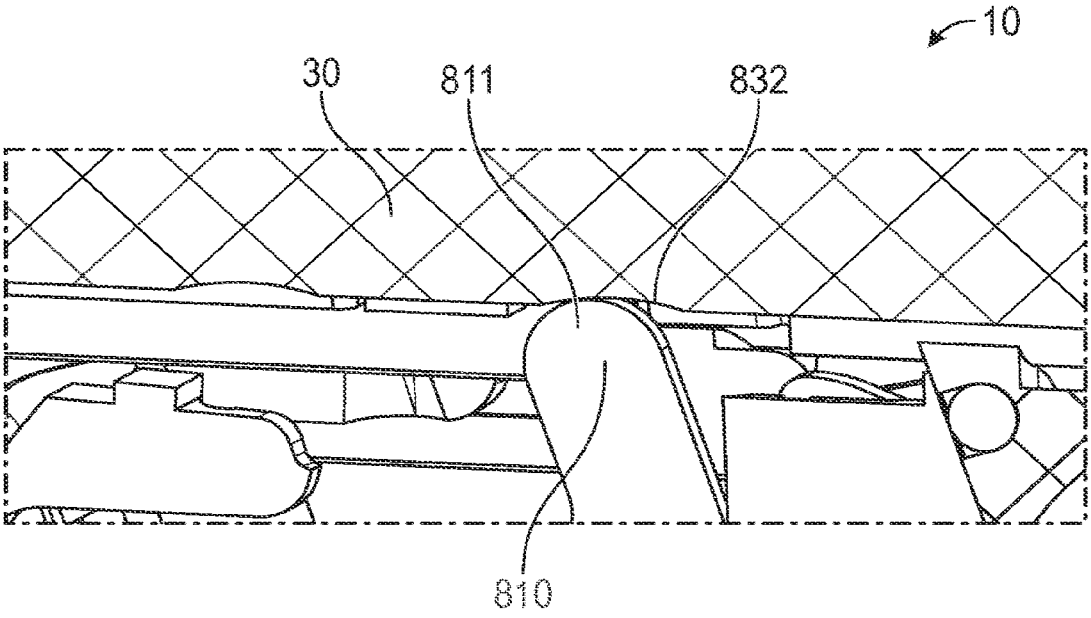
FIG. 26A is a cropped sectional view of the firearm assembly viewed from a selectively angled perspective, showing the trigger bar tab fully seated within the rear trigger bar cutout of the slide. The slide is in battery and has not yet begun rearward motion.
Figure 26B:
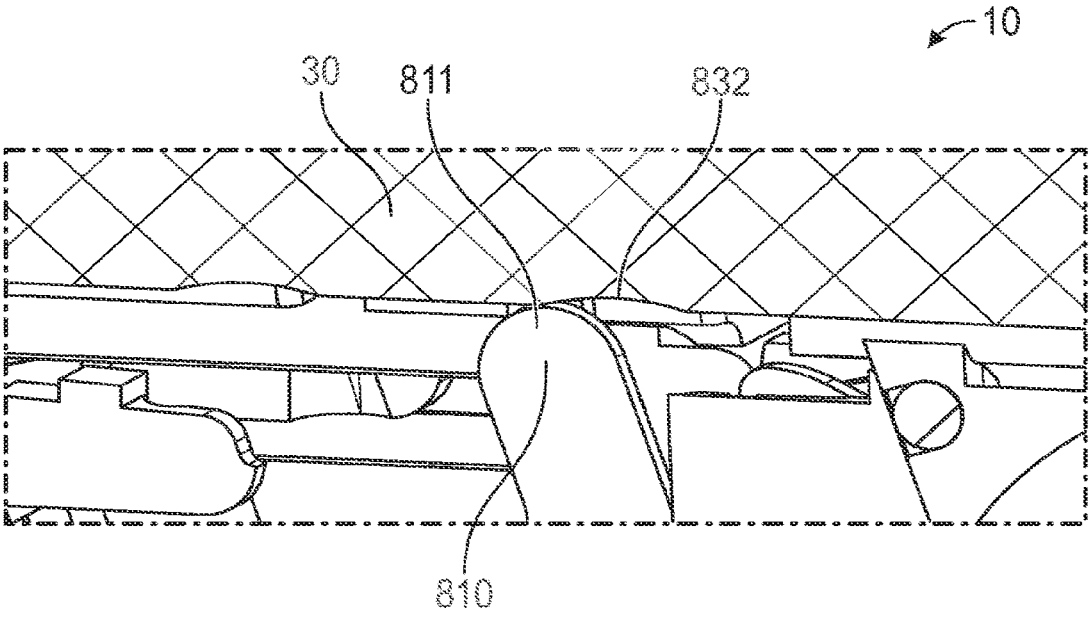
FIG. 26B is a cropped sectional view of the firearm assembly viewed from a selectively angled perspective, showing the trigger bar tab displaced downward as the rear trigger bar cutout moves out of alignment during rearward slide motion.
Figure 27A:
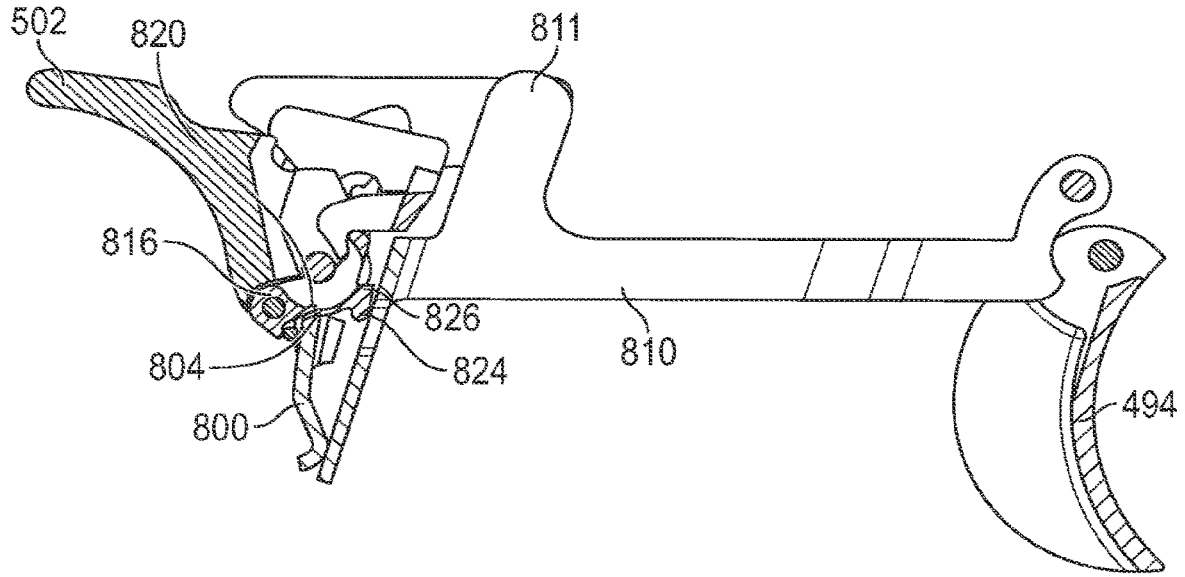
FIG. 27A is a magnified sectional view of the fire control components, showing the trigger bar tab in a downward position, preventing the trigger bar from rising. The heel of the foot of the tooth is obstructed from falling into place. The rocker remains in contact with the tooth, and the trigger is released. The notch and rocker engagement surface 804 are not yet engaged, and the hammer remains unrestrained.
Figure 27B:
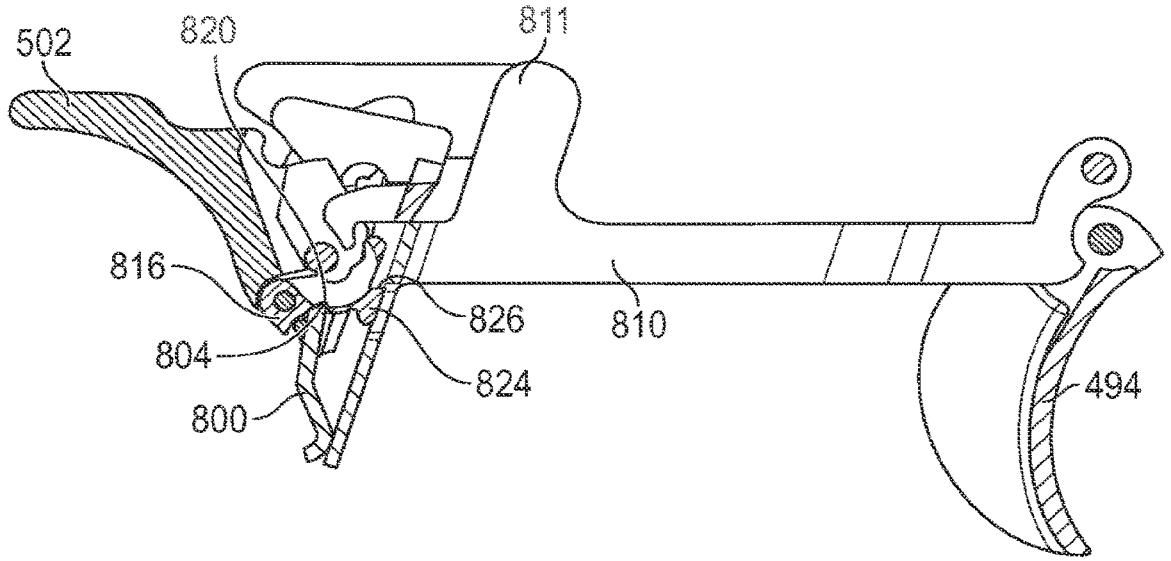
FIG. 27B is a magnified sectional view of the fire control components, showing the trigger bar tab having risen to allow the trigger bar to move upward. This provides clearance for the heel of the foot of the tooth. The notch of the tooth is now fully engaged with the rocker engagement surface, restraining the hammer in the cocked condition. The trigger remains released.

Slide cycled with hammer in fired position and trigger released: FIGS. 25A and 25B show with the slide 30 closed, hammer 502 forward, and trigger 494 released, the rear face 814 of the trigger bar 810 rests on the bottom of the tail 828 of the tooth 816, preventing the trigger 494 from fully returning. This condition holds the trigger 494 in a slightly pulled state, which is expected since the hammer 502 must be cocked before reset can occur. As the slide 30 opens, both the trigger bar tab 811 and the rocker tab 802—initially positioned in the rear trigger bar cutout 832 and the rocker cutout 834, respectively—are driven downward by the moving surface of the slide 30 (FIGS. 23A, 23B, 26A and 26B) This motion causes the rocker 800 to rotate rearward, and in doing so, its tail 806 swings forward makes contact with the rear face 814 of the trigger bar 810, pushing the trigger bar 810 forward and consequently pulling the trigger 494 back even further, though still not to the fully "pulled" position.

If the trigger 494 is released or not fully pulled during this rearward motion, the trigger bar 810 remains slightly rearward from the comparative fully pulled position and may block the heel 826 of the foot 824 of the tooth 816 as it attempts to fall into position on the engagement surface 804 of the rocker 800. To provide clearance for this engagement, the trigger bar tab 811 encounters the front trigger bar cutout 830 when the slide 30 is partially open, (shown in 29A and 27A) allowing the trigger bar 810 to rise slightly (shown in 29B and 27B). Once the tooth 816 has cleared the trigger bar 810, the notch 820 of the tooth 816 drops over the engagement surface 804 of the rocker 800, thereby restraining the hammer 502 in the cocked condition (shown in 27B). The slide 30 continues to open, and the front trigger bar cutout 830 is no longer aligned with the trigger bar tab 811.

Figure 23A:
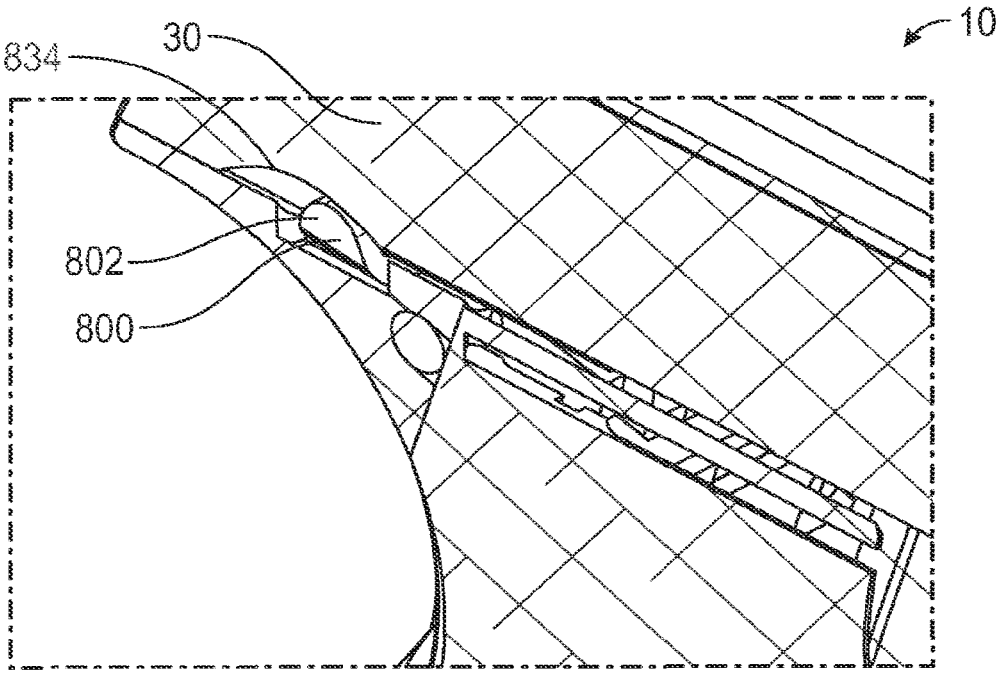
FIG. 23A is a cropped sectional view of the firearm assembly viewed from a selectively angled perspective, showing the rocker tab and its relationship with the rocker cutout in the slide. The rocker tab is fully seated within the cutout, with the rocker in its forward position.
Figure 23B:
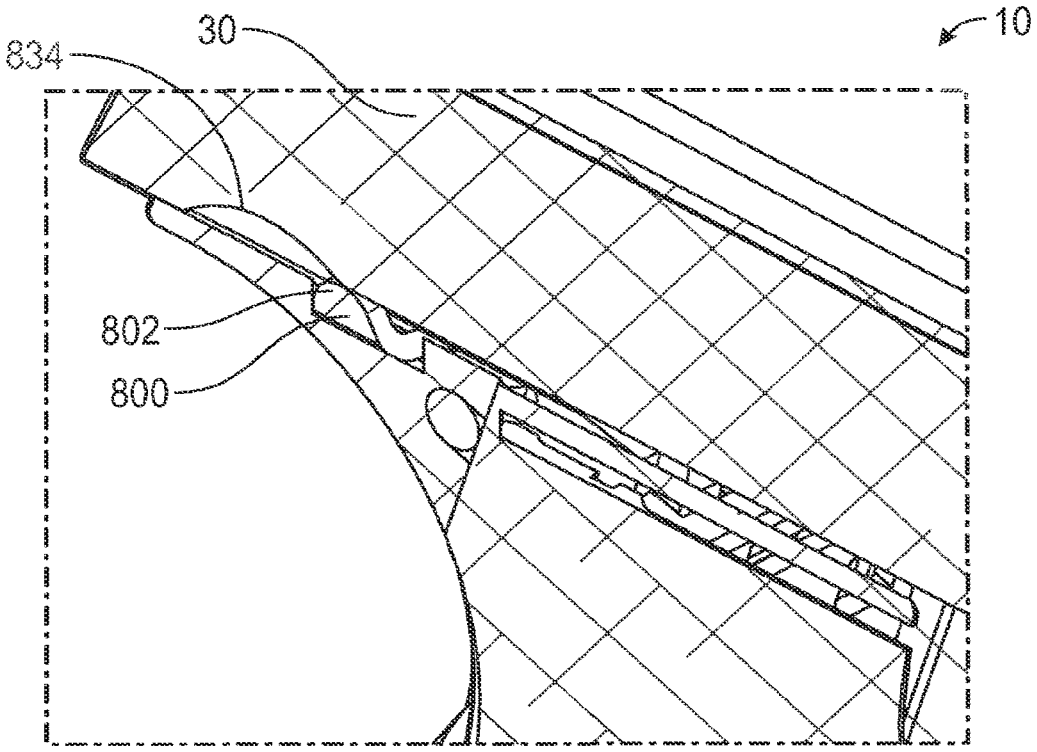
FIG. 23B is a cropped sectional view of the firearm assembly viewed from a selectively angled perspective, showing the rocker tab after displacement from the rocker cutout in the slide. As the slide moves rearward and the cutout shifts out of position, the rocker tab is pushed downward by the underside of the slide, which is not relieved in this region.
Figure 24A:
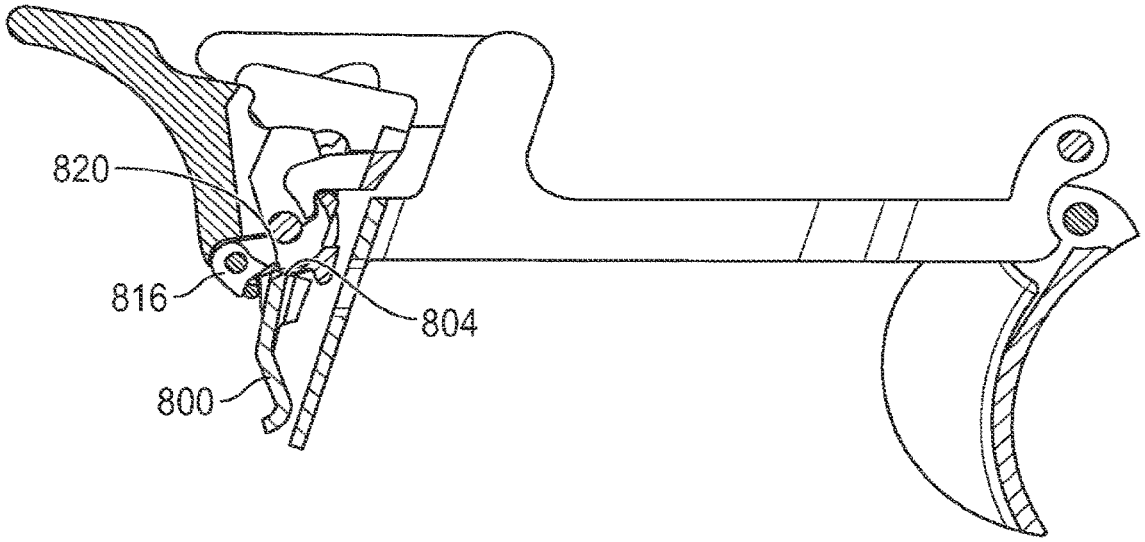
FIG. 24A is a magnified sectional view of the fire control components, showing the notch of the tooth in the process of engaging the rocker engagement surface. The rocker remains in contact with the tooth, with the notch transitioning into position for restraining the hammer.
Figure 24B:
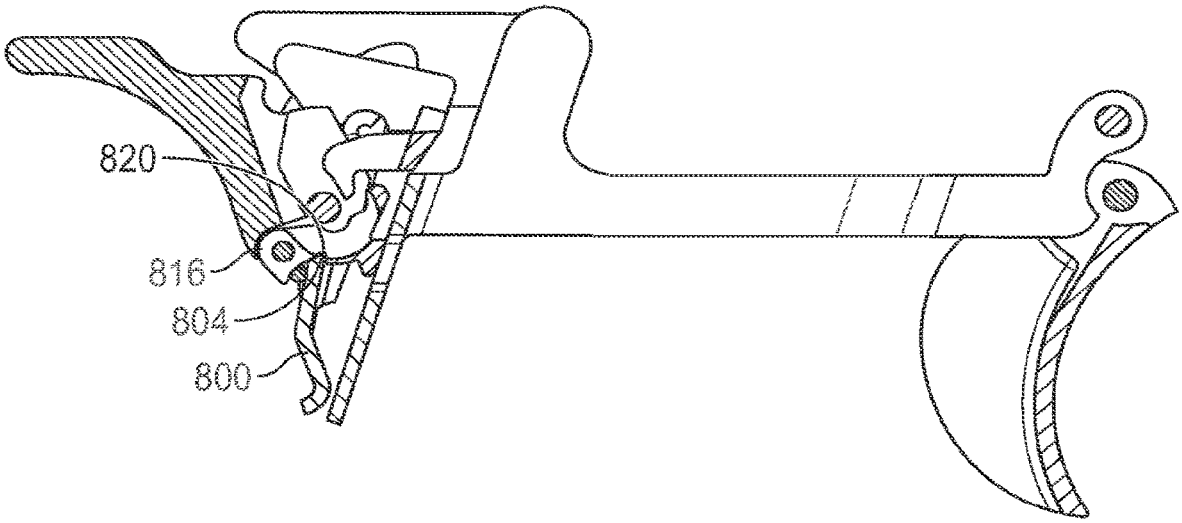
FIG. 24B is a magnified sectional view of the fire control components, showing the notch of the tooth fully engaged with the rocker engagement surface. The tooth is restrained by the rocker in the cocked condition.
Figure 30A:
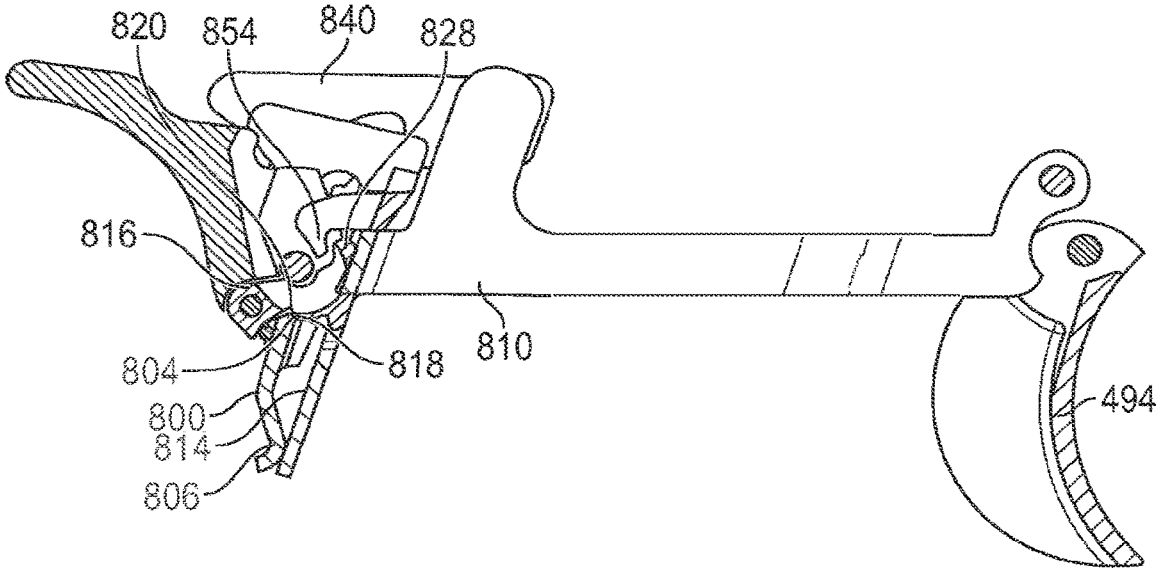
FIG. 30A is a magnified sectional view of the fire control components in the ready-to-fire condition. The trigger is released, and the trigger bar is in a rearward position, spring biased (spring not shown) both rearward and upward. Its rear face is in contact with both the tail of the rocker and the tail of the tooth. The engagement surface 804 of the rocker rests on the ramp surface of the tooth, while the notch remains disengaged. The tooth tail is positioned within the hooked finger of the manual safety selector, without interference.
Figure 31A:
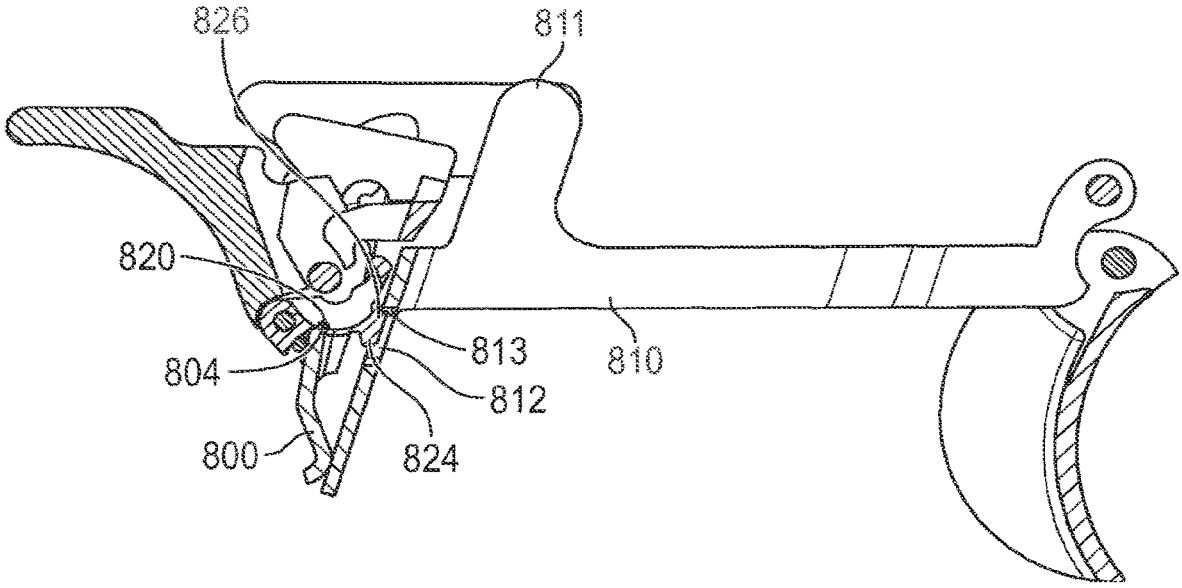
FIG. 31A is a sectional view of the fire control components showing the completion of the reset interaction initiated in FIG. 30B. The rocker has fully rocked back, and its tail has pushed the trigger bar forward via the trigger bar's rear face. Simultaneously, the lowered trigger bar tab has allowed the central window—specifically its underside surface—to press the heel of the foot of the tooth fully downward. This clears the notch of the tooth to re-engage the rocker engagement surface, restraining the hammer in the cocked condition. The trigger remains released.
Figure 31B:
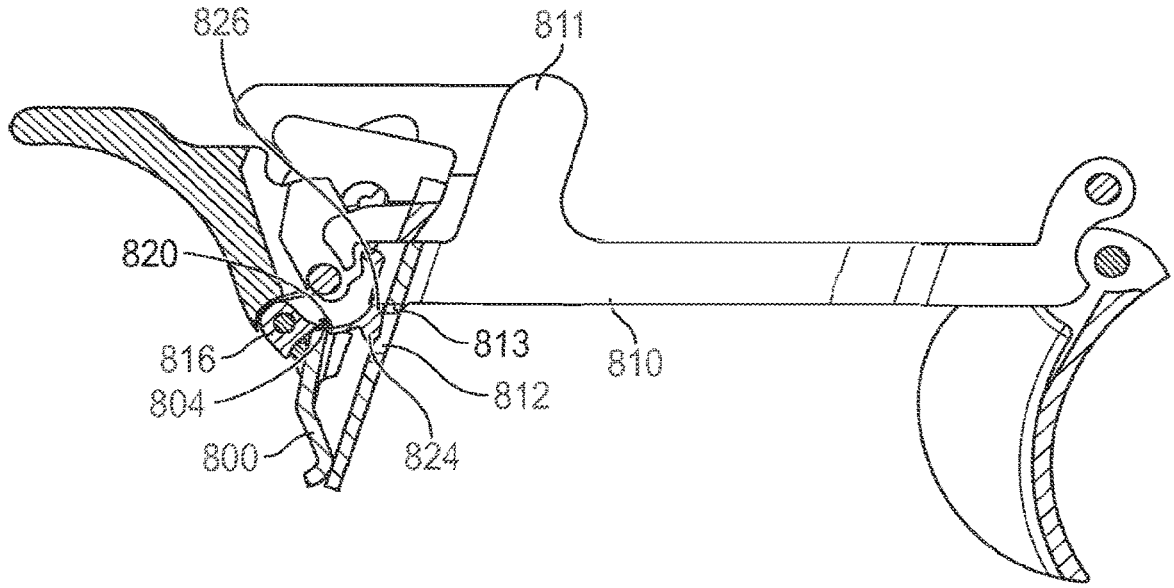
FIG. 31B is a magnified sectional view of the fire control components showing a non-functional condition in which the rocker has rocked back and its tail has pushed the trigger bar forward via rear face, despite the rocker engagement surface not being fully seated in the notch of the tooth. The trigger bar tab is shown in an insufficiently depressed condition, resulting in no interference between the underside of the central window and the heel of the foot. This allows the tooth to rotate inward under spring force shared with the hammer. As a result, the engagement surface rides the ramp of the tooth until the ramp terminates, releasing the hammer unexpectedly. The trigger remains released, and the hammer is prevented from striking the firing pin due to out-of-battery safeties.

Slide cycled with hammer already cocked and trigger released: FIG. 30A shows that because this is the ready-to-fire position, the ramp surface 818 of the tooth 816 is resting on the engagement surface 804 of the rocker 800. When the slide 30 is partially opened, the rocker 800 is rocked back by the rocker tab 802 being pushed down out of its cutout 834 in the slide 30 (FIGS. 23A and 23B). If the trigger 494 is still released, the tail 806 on the rocker 800 contacts the rear face 814 of the trigger bar 810 and pushes it forward, thereby pulling the trigger 494 back slightly (FIG. 31B). This motion would be acceptable if the rocker engagement surface 804 were fully seated in the notch 820 of the tooth 816, because no hammer release would occur. However, in the condition shown in FIG. 31B, the engagement surface 804 is still riding the ramp surface 818. Because the heel 826 of the foot 824 of the tooth 816 is free to clear the underside 813 of the trigger bar 810—either due to improper geometry or insufficient depression of the trigger bar tab 811—the tooth is not actively pushed downward. Meanwhile, the spring acting on the hammer 502 applies a greater rotational force than that acting on the tooth 816, due to a much longer moment arm. As a result, the rocker 800 rides up the ramp, rotating the tooth inward until the ramp terminates, releasing the hammer. Although the hammer cannot strike the firing pin 152 due to interference from the rocker 800 and firing pin retainer 860 (acting as out-of-battery safeties), this condition results in an inert hammer drop. The firearm cannot discharge, but the trigger 494 is rendered inactive, and a user may perceive the condition as a malfunction. This effectively prevents a "squeeze check" unless the slide 30 is fully cycled.

Figure 30B:
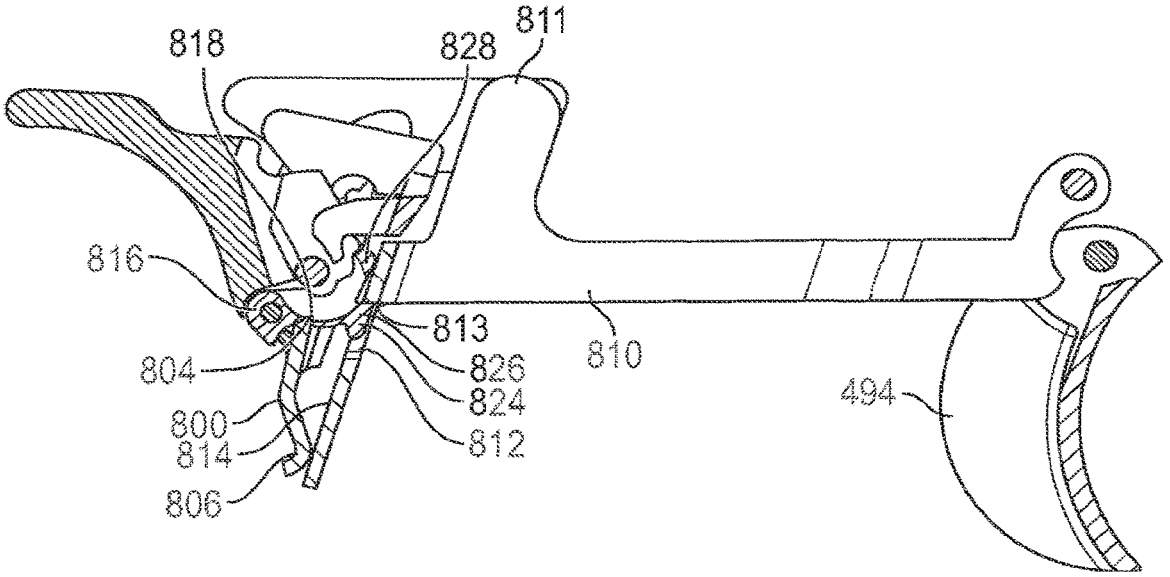
FIG. 30B is a magnified sectional view of the fire control components during a partial slide retraction with the hammer already cocked and the trigger released. The trigger bar tab is shown in a downward position, having been pushed down by the slide (not shown). This causes the trigger bar to pivot downward, and the underside of the central window presses against the heel of the foot of the tooth, displacing the tooth downward. The rocker is rotating backward, and its tail is beginning to contact the rear face of the trigger bar. The tail of the tooth remains in contact with the rear face of the trigger bar. The notch has not yet fully re-engaged with the rocker engagement surface.

To prevent this condition (shown in FIG. 31B) from occurring, the rear trigger bar cutout 832 is positioned to push the trigger bar tab 811 down at the same time the rocker 800 is rocked back. This forces the underside surface 813 of the central window cut 812 of the trigger bar 810 that is contacting the heel 826 of the tooth foot 824 downward (FIGS. 30B and 31A). As a result, the tooth 816 is pressed downward such that its notch 820 re-engages with the engagement surface 804 of the rocker 800 (see difference between 31B and 31A). When the slide 30 returns to battery, the rear trigger bar cutout 832 again permits the trigger bar tab 811 to rise, restoring the mechanism to a proper reset and ready-to-fire condition.

Figure 28A:
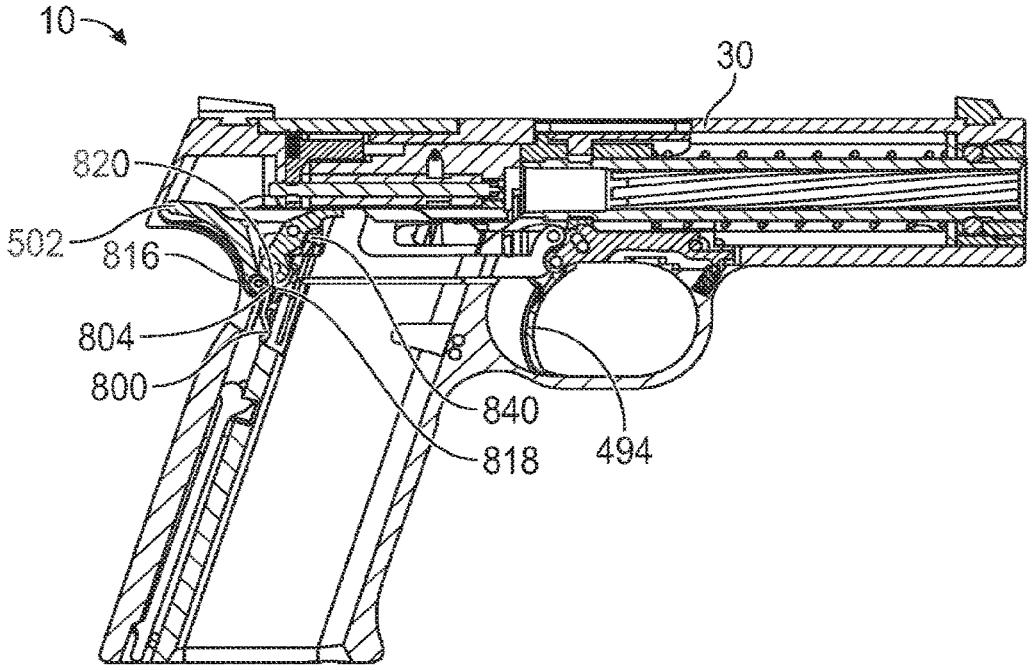
FIG. 28A is a sectional view of the firearm showing the hammer in the cocked position while the trigger remains held to the rear. The notch of the tooth is still engaged with the rocker engagement surface, as the trigger has not been released to allow reset. The rocker has not transitioned to the ramp surface, and the fire control system remains blocked and unfireable in this condition. The manual safety selector is shown present but not yet engaged.
Figure 28B:
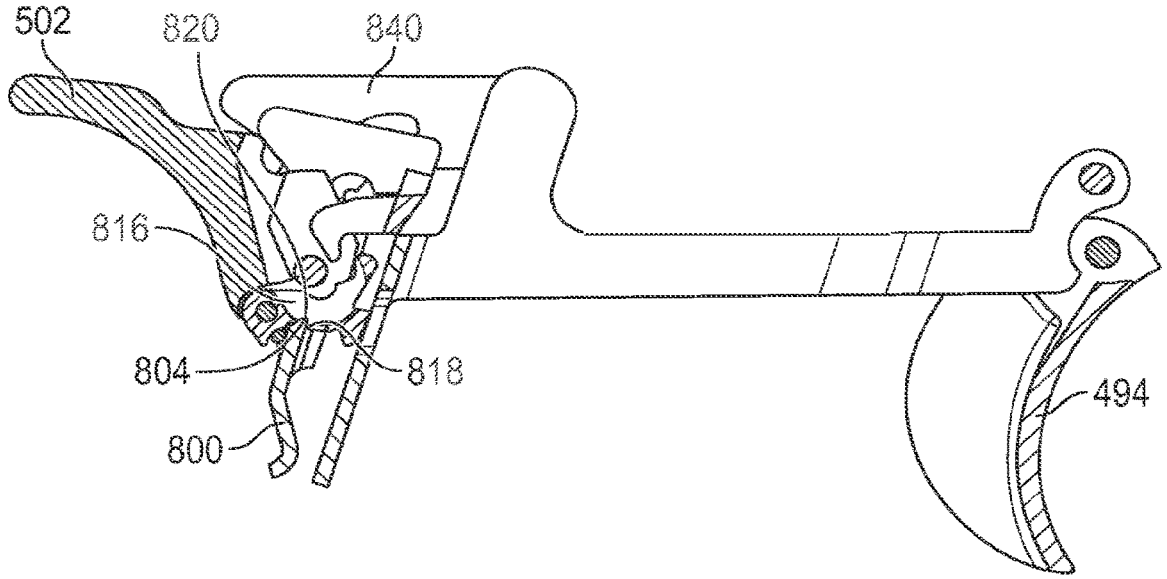
FIG. 28B is a magnified sectional view of the fire control components in the blocked condition shown in FIG. 28A. The notch of the tooth remains engaged with the rocker engagement surface, preventing the hammer from releasing. The trigger is held to the rear, and the rocker has not transitioned to the ramp surface. The manual safety selector is shown in an unengaged state.
Figure 29A:
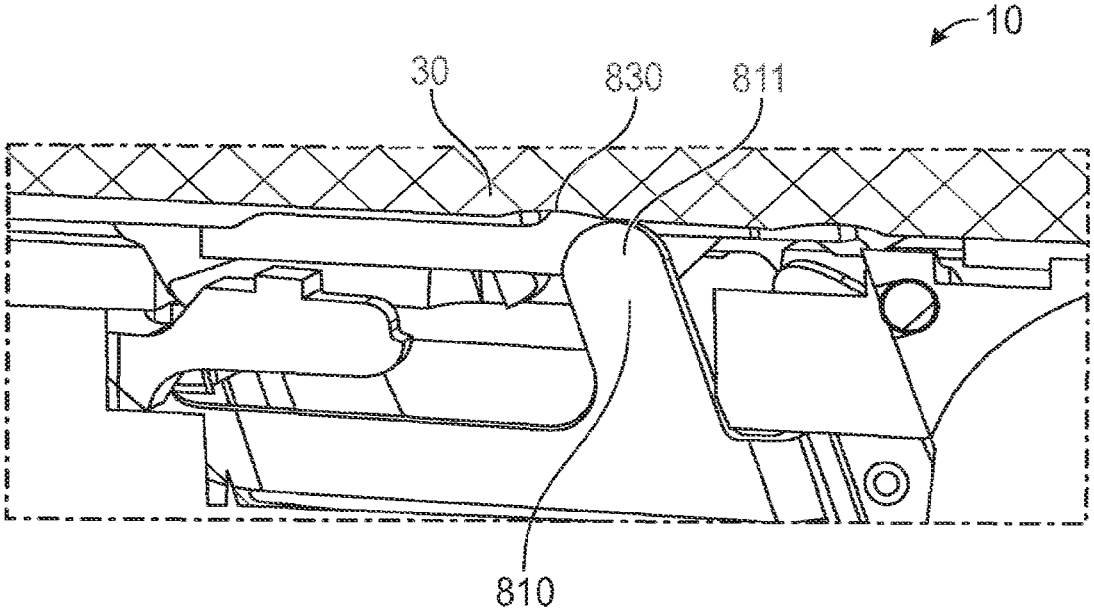
FIG. 29A is a cropped sectional view of the firearm assembly viewed from a selectively angled perspective, showing the trigger bar tab approaching alignment with the front trigger bar cutout in the slide. The trigger bar remains in a lowered position, and the tab has not yet risen into the cutout.
Figure 29B:
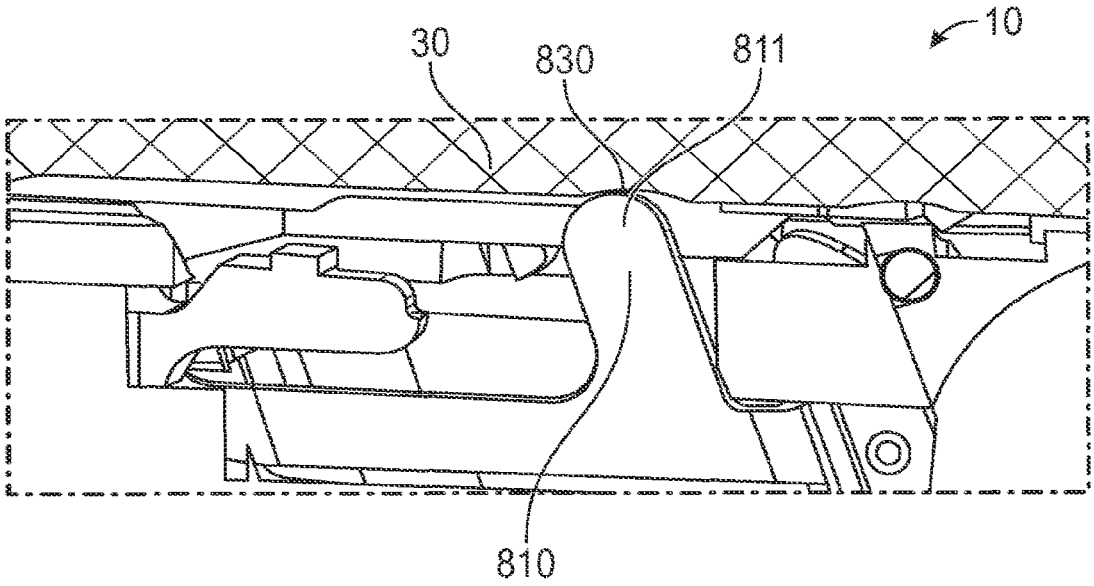
FIG. 29B is a cropped sectional view of the firearm assembly viewed from a selectively angled perspective, showing the trigger bar tab having risen into the front trigger bar cutout in the slide. The trigger bar is shown in a raised position, having been lifted by the relieved area of the slide.

Slide cycled with hammer already cocked and trigger pulled (manual safety engaged or prior trigger hold): This condition can occur if the manual safety selector 840 is engaged before the trigger 494 is pulled and the slide 30 is cycled, or if the user previously pulled the trigger 494 and continued holding it through at least one full cycle of the slide 30—whether by firing or manual operation—and then cycles the slide 30 again without releasing the trigger 494. FIGS. 28A and 28B show if the safety selector 840 is not engaged and the trigger 494 has never been allowed to reset after hammer 502 cocking, then the engagement surface 804 of the rocker 800 remains in the notch 820 of the tooth 816 throughout the cycle. In this scenario, the firearm remains in a blocked and unfireable condition until the slide 30 is in battery and the trigger 494 is released and subsequently pulled again.

Figure 32A:
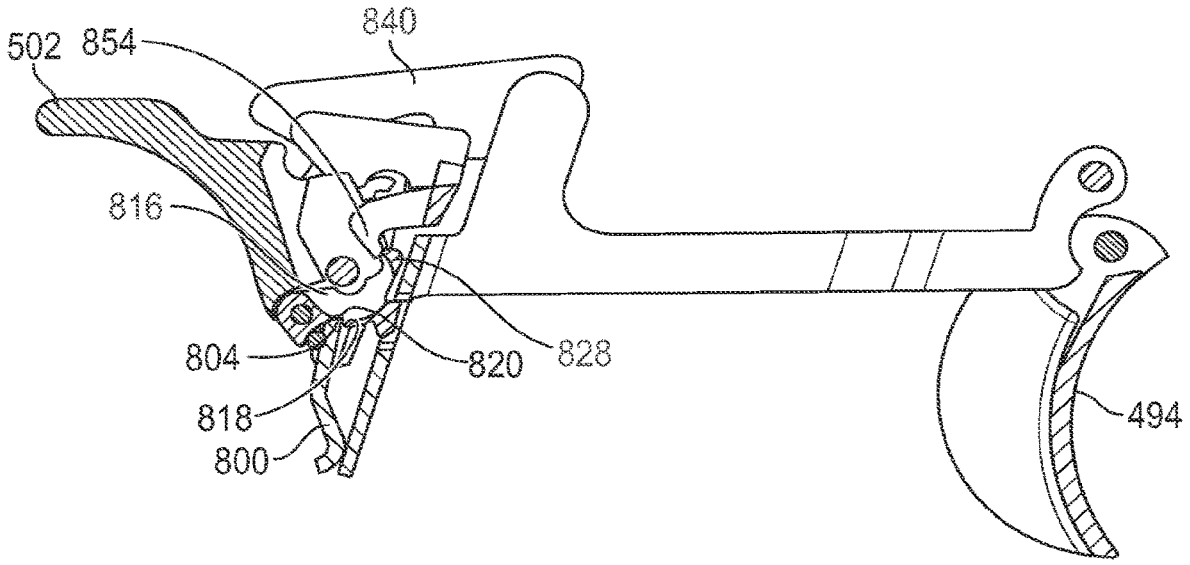
FIG. 32A is a magnified sectional view of the fire control components showing the fire control system partway through manual safety engagement. The rocker is partially rocked back, with its engagement surface nearly seated in the notch of the bird-shaped tooth. The ramp surface of the tooth lies just forward of the engagement surface. The hooked finger of the safety selector is actively displacing the tail of the tooth downward and forward to complete re-engagement. The hammer remains cocked, and the trigger is released.
Figure 32B:
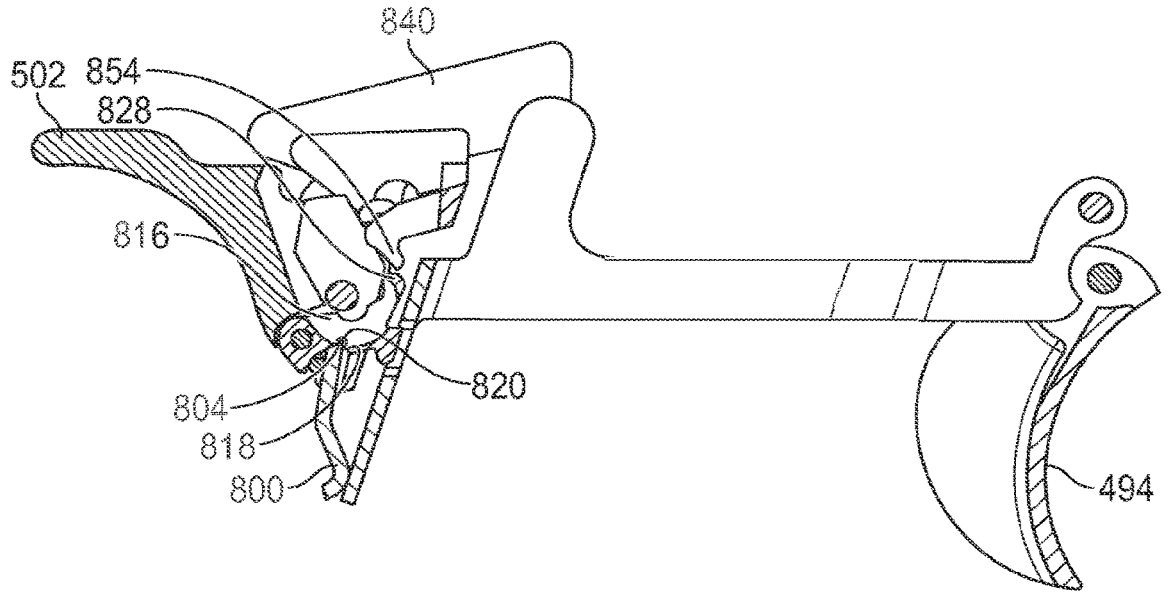
FIG. 32B is a magnified sectional view of the fire control components showing the fire control system in the fully blocked condition following manual safety engagement. The rocker is fully rocked back, with its engagement surface fully seated in the notch of the tooth. The hooked finger of the safety selector has completed displacement of the tooth tail and now resides out of its path. The hammer remains cocked, and the trigger is released.

With the manual safety interaction, the safety is engaged after slide cycle, trigger released: In the proper ready-to-fire condition—where the slide 30 has been cycled and the trigger 494 has been released—the rocker 800 is rocked forward, the engagement surface 804 has transitioned to the ramp 818, and the tail 828 of the bird-shaped tooth 816 is positioned inside the space of the hooked finger 854 on the safety selector 840 without overlapping it (Shown in FIG. 30A) when the engagement of the safety is initiated starting from this condition, the rounded tip of the hook 854 contacts the rounded tip of the tooth's tail 828 (Shown in FIG. 32A). This contact pushes the tail 828 down and forward. That motion drives the notch 820 of the tooth 816 back onto the engagement surface 804 of the rocker 800, ensuring the hammer 502 cannot rotate forward (Shown in FIG. 33B). In the fully engaged safety condition, the front of the hook 854 resides outside the travel path of the tooth's tail 828, maintaining mechanical separation while preserving its ability to displace the tail 828 if reengaged from a hammer-back condition. In this condition, the safety selector 840 can be engaged without interference, and the firearm is safely blocked from firing.

Figure 33A:
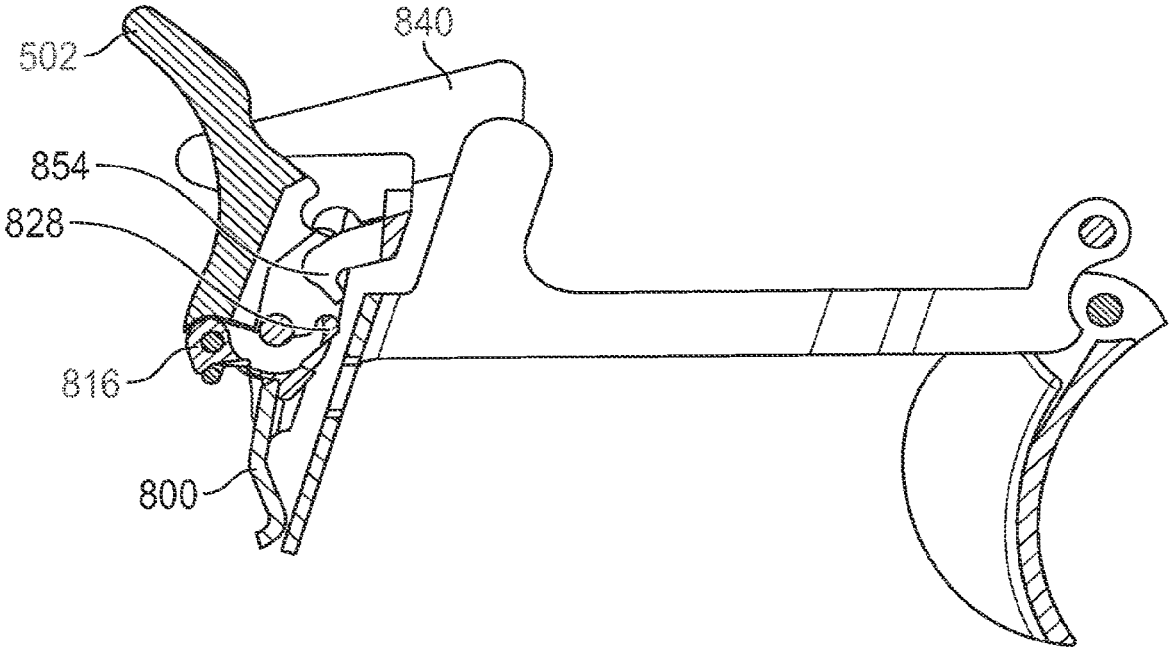
FIG. 33A is a magnified sectional view of the fire control components showing the safety selector engaged while the hammer is in the fired position. The tail of the tooth is forward and low, positioned entirely out of reach of the hooked finger of the safety selector. The rocker remains in the rocked-back position, rocking the hammer back slightly with it.
Figure 33B:
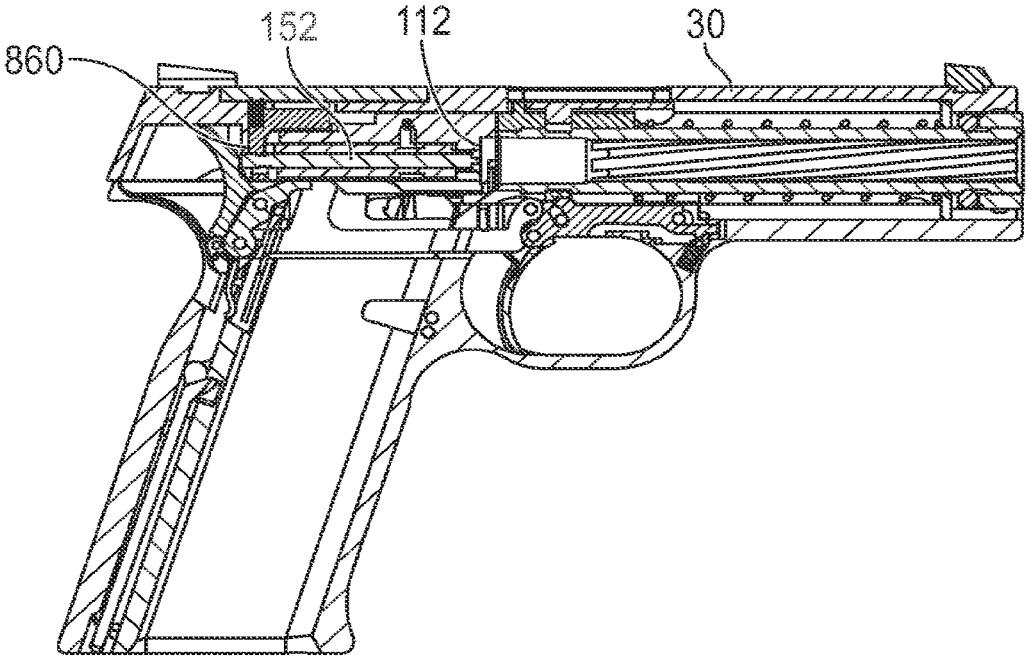
FIG. 33B is a sectional view of the firearm assembly showing rearward movement of the slide and the resulting retraction of the firing pin from the breech face by the firing pin retainer. The firing pin retainer, mechanically linked to the slide, draws the firing pin rearward as the slide opens, preventing primer contact when the firearm is out of battery.
Figure 34A:
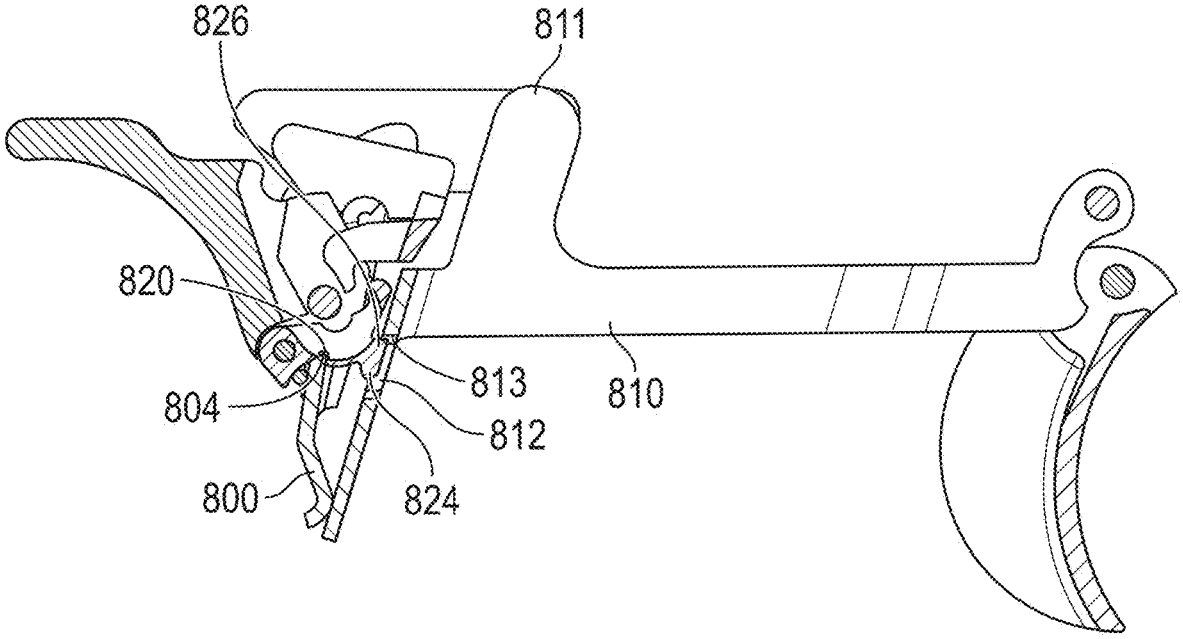
Figure 34B:
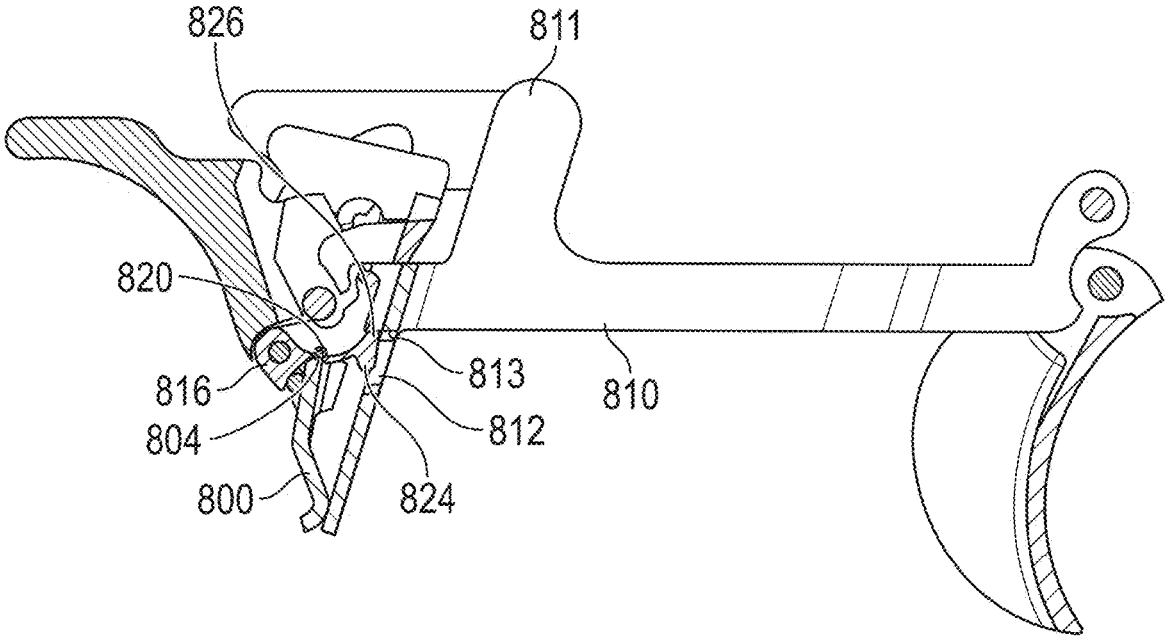
Figure 35A:
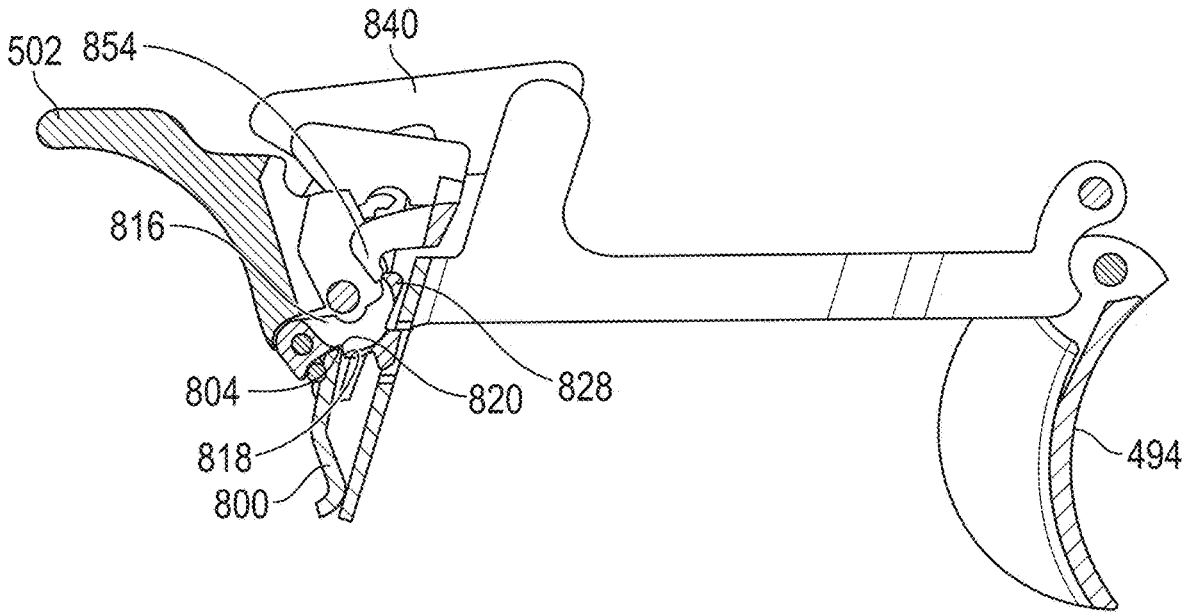
Figure 35B:
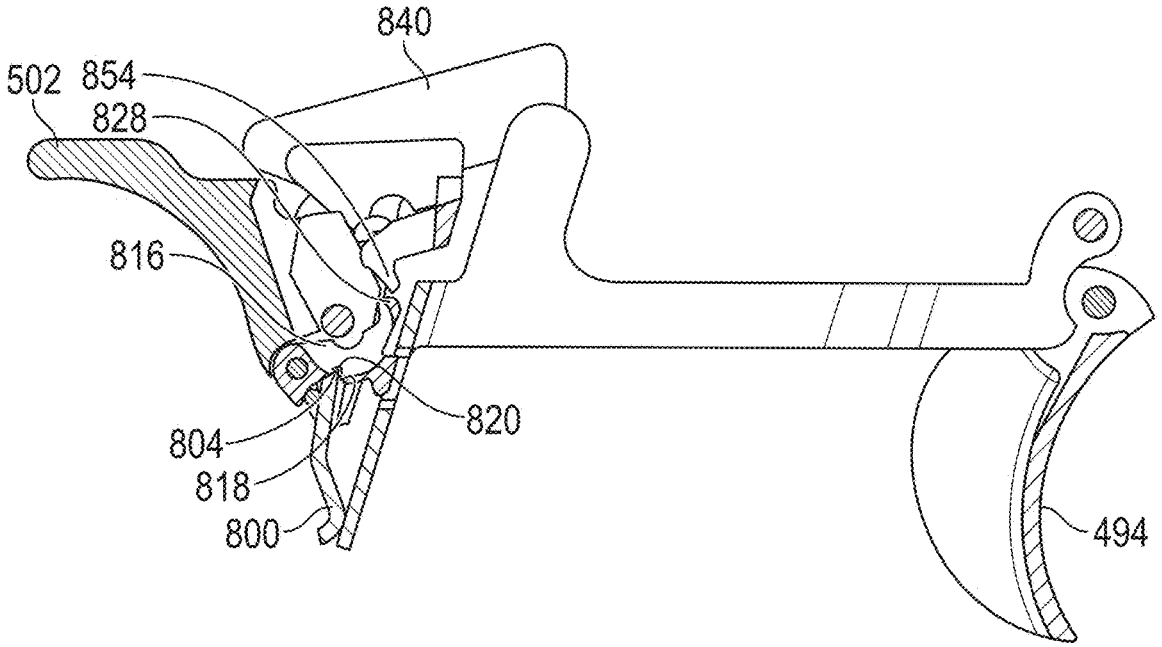
Figure 36A:
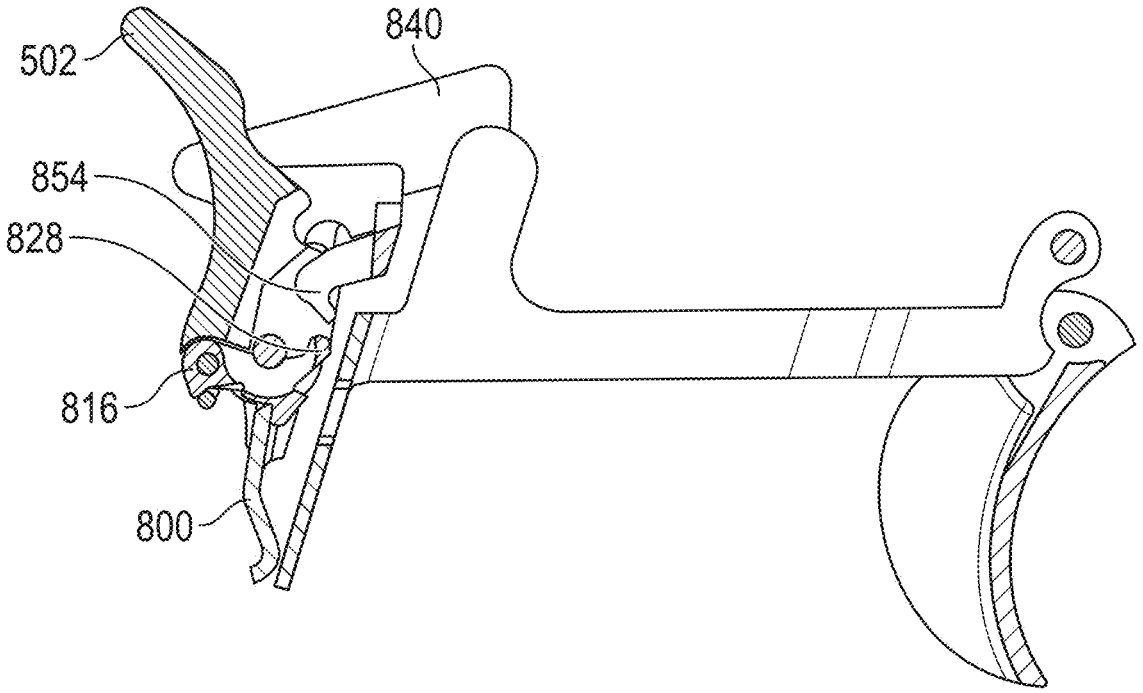
Figure 36B:
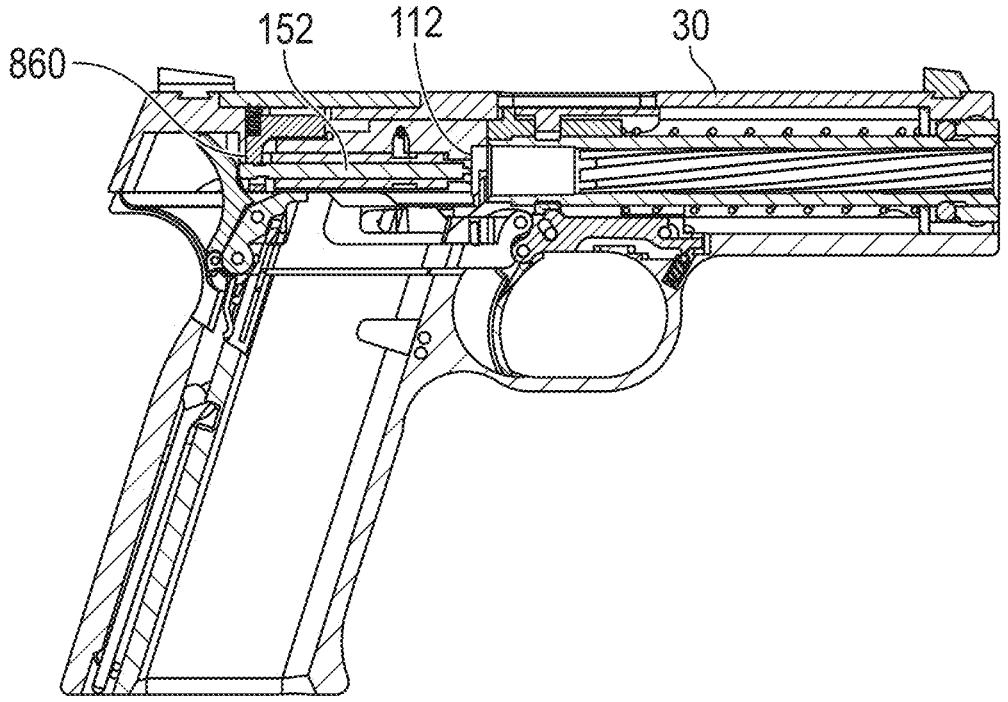

Safety engaged with hammer in fired position: If the user engages the manual safety selector 840 while the hammer 502 is in the fired position, FIG. 33A show the tail 828 of the bird-shaped tooth 816 remains in a low, forward position along with the hammer 502, placing the tail 828 of the tooth 816 outside the vicinity of the hooked finger 854 on the safety selector 840. Accordingly, in this configuration, the hooked finger 854 of the safety selector 840 does not mechanically interface with any component of the fire control system in a manner that contributes to blocking or restraining hammer or sear motion. In this condition, the safety selector 840 still rotates the rocker 800 into its rocked-back position. This rotation pulls the hammer 502 slightly back and off the firing pin 152, creating a mechanical gap and rendering the system inert. The rocker 800 remains in this rocked-back position until the safety selector 840 is disengaged and the slide 30 is in battery. The slide 30 remains operable while the safety is engaged, allowing for manual cycling.

Safety engaged after slide cycle, trigger still pulled: The condition immediately before engagement of the safety selector 840 is depicted in FIGS. 28A and 28B. In this condition, the slide 30 has already been cycled while the trigger 494 remains held in the pulled position. As the trigger 494 was never released, the mechanism did not reset following the cocking of the hammer 502. The engagement surface 804 of the rocker 800 therefore remains engaged with the notch 820 of the tooth 816. Since the rocker 800 has not transitioned to the ramped surface 818, the firing mechanism remains blocked. As a result, the firearm is incapable of firing until the slide 30 is in battery, the safety selector 840 is disengaged, and the trigger 494 is subsequently released and pulled again.

Additional Blocking Interactions are shown in 22A and 33B, this embodiment also includes a firing pin retainer 860 that acts as a secondary out-of-battery safety. The firing pin retainer 860 is mechanically linked to the slide 30 and pulls the firing pin 152 rearward as the slide 30 moves rearward. Once the slide 30 has moved rearward approximately the distance that the firing pin 152 normally protrudes from the breech face 112 when fired, the firing pin 152 is fully retracted and incapable of striking the primer 660. Together, the rocker 800 and the firing pin retainer 860 ensure that the firearm cannot discharge when out of battery.

This embodiment showcases the alternate arrangement where the engagement element (rocker 800) is fixed and the tooth 816 pivots, emphasizing the flexibility and modularity of the overall fire control concept.

I claim:

1. A firearm comprising:

a chassis;

a barrel connected to the chassis and having breech end defining a chamber;

a slide operable to reciprocate with respect to the chassis between a forward battery position and a rearward recoil position;

a reciprocating block connected to the chassis and operable to reciprocate with respect to the slide between a block rear position in which a first limit surface of the slide abuts the block, and a block forward position in which the block is spaced apart from the first limit surface of the slide, the reciprocating block operable to reciprocate with respect to the barrel between a chamber open position in which a face portion of the block is spaced apart from the breech end of the barrel and a chamber closed position in which the face portion of the block is proximate the breech end of the barrel; and a plurality of locking elements selectively engaging at least the slide and the block and operable to prevent rearward movement of the block when the slide is in the battery position, and to enable rearward movement of the block when the slide has moved rearward with respect to the block by a limited distance to an intermediate position forward of the recoil position.

2. The firearm of claim 1, wherein the plurality of locking elements are operable to engage the block to the slide rearward of the intermediate position.

3. The firearm of claim 1, wherein the slide defines a bore having a first diameter portion configured to engage the plurality of locking elements over a first range of motion of the slide, and a different second diameter portion configured to engage the plurality of locking elements over a second range of motion of the slide.

4. A firearm comprising:

a chassis;

a barrel connected to the chassis and having a breech end defining a chamber;

a slide operable to reciprocate with respect to the chassis between a forward battery position and a rearward recoil position;

a reciprocating block connected to the chassis and operable to reciprocate with respect to the slide between a block rear position in which a first limit surface of the slide abuts the block, and a block forward position in which the block is spaced apart from the first limit surface of the slide, the reciprocating block operable to reciprocate with respect to the barrel between a chamber open position in which a face portion of the block is spaced apart from the breech end of the barrel and a chamber closed position in which the face portion of the block is proximate the breech end of the barrel; and a plurality of locking elements selectively engaging at least the slide and the block and operable to prevent rearward movement of the block when the slide is in the battery position, and to enable rearward movement of the block when the slide has moved rearward with respect to the block by a limited distance to an intermediate position forward of the recoil position, wherein the barrel defines a cylindrical exterior surface having a first diameter portion configured to engage the plurality of locking elements over a first range of motion of the block, and a different second diameter portion configured to engage the plurality of locking elements over a second range of motion of the block.

5. The firearm of claim 1, wherein the block includes a locking element holder portion defining a receptacle receiving the locking element.

6. The firearm of claim 5, wherein the locking element holder portion is interposed between a portion of the slide and the barrel.

7. The firearm of claim 1, wherein the plurality of locking elements are balls.

8. The firearm of claim 1, wherein the slide defines a bore encompassing at least a portion of the barrel, and defining a slide recess in the bore.

9. The firearm of claim 8, wherein the barrel has an exterior surface defining a barrel recess, and wherein the plurality of locking elements are constrained to reside in at least one of the slide recess and the barrel recess.

10. The firearm of claim 1, wherein the block includes a breech face.

11. The firearm of claim 1, wherein the block includes a firing pin operable to reciprocate with respect to the block.

12. A firearm comprising:

a chassis;

a barrel connected to the chassis and having a breech end defining a chamber;

a slide operable to reciprocate with respect to the chassis between a forward battery position and a rearward recoil position;

a reciprocating block connected to the chassis and operable to reciprocate with respect to the slide between a block rear position in which a first limit surface of the slide abuts the block, and a block forward position in which the block is spaced apart from the first limit surface of the slide, the reciprocating block operable to reciprocate with respect to the barrel between a chamber open position in which a face portion of the block is spaced apart from the breech end of the barrel and a chamber closed position in which the face portion of the block is proximate the breech end of the barrel; and a plurality of locking elements selectively engaging at least the slide and the block and operable to prevent rearward movement of the block when the slide is in the battery position, and to enable rearward movement of the block when the slide has moved rearward with respect to the block by a limited distance to an intermediate position forward of the recoil position, wherein the block includes a piston operable to reciprocate with respect to the block, and having a forward end responsive to discharge of a cartridge in the chamber to move the piston rearward, and a rear end abutting a portion of the slide and operable to motivate the slide rearward.

13. The firearm of claim 1, wherein the slide has a second limit surface contacting the block when in the block forward position.

14. The firearm of claim 1, wherein the slide defines a bore, and the block includes a sleeve portion received in the bore, and a portion of the barrel is received in the sleeve.

15. The firearm of claim 12, wherein the sleeve portion defines an aperture receiving the locking elements.

16. The firearm of claim 1, wherein the block is an elongated body extending from proximate to a forward portion of the slide to proximate to a rear portion of the slide.

* * * * *